US009651342B2

(12) United States Patent
Johnson

(10) Patent No.: US 9,651,342 B2
(45) Date of Patent: May 16, 2017

(54) ARCHERY TARGETS

(71) Applicant: Raptor Enterprises, Inc., Janesville, WI (US)

(72) Inventor: Brian L. Johnson, Hayward, WI (US)

(73) Assignee: RAPTOR ENTERPRISES, INC., Janesville, WI (US)

( * ) Notice: Subject to any disclaimer, the term of this patent is extended or adjusted under 35 U.S.C. 154(b) by 125 days.

(21) Appl. No.: 14/511,196

(22) Filed: Oct. 10, 2014

(65) Prior Publication Data

US 2015/0102564 A1 Apr. 16, 2015

Related U.S. Application Data

(60) Provisional application No. 61/890,406, filed on Oct. 14, 2013, provisional application No. 61/921,767, filed on Dec. 30, 2013.

(51) Int. Cl.
*F41J 1/00* (2006.01)
*F41J 3/00* (2006.01)

(52) U.S. Cl.
CPC ..... *F41J 1/00* (2013.01); *F41J 3/0004* (2013.01)

(58) Field of Classification Search
CPC ..... F41J 3/00; F41J 1/00; F41J 7/02
USPC ..... 273/403, 406; 434/274; 473/407
See application file for complete search history.

(56) References Cited

U.S. PATENT DOCUMENTS

| | | | | | |
|---|---|---|---|---|---|
| 5,503,403 | A * | 4/1996 | Morrell | F41J 3/0004 | 273/403 |
| 5,593,162 | A * | 1/1997 | Minuskin | F41J 1/00 | 273/403 |
| 6,254,100 | B1 * | 7/2001 | Rinehart | F41J 3/0004 | 273/403 |
| 6,575,469 | B2 * | 6/2003 | Love | F41J 3/0004 | 273/403 |
| 7,455,298 | B1 * | 11/2008 | Nettle | F41J 3/0004 | 273/403 |
| 7,946,588 | B1 * | 5/2011 | Hockman | F41J 3/00 | 273/406 |
| 8,801,438 | B2 * | 8/2014 | Sakezles | G09B 23/30 | 434/274 |
| 2008/0054570 | A1 * | 3/2008 | Potterfield | F41J 5/24 | 273/403 |
| 2009/0039603 | A1 * | 2/2009 | Clark | F41J 3/0004 | 273/408 |

* cited by examiner

*Primary Examiner* — Alvin Hunter
*Assistant Examiner* — Christopher Glenn
(74) *Attorney, Agent, or Firm* — Foley & Lardner LLP

(57) ABSTRACT

Anatomically correct archery targets. At least one arrangement includes at least one aiming aid configured to assist in desired arrow placement through the target when the arrow is shot from at least one predetermined elevation at a predetermined horizontal distance from the target.

18 Claims, 49 Drawing Sheets

| TREE STAND PLATFORM HEIGHT "H" | DISTANCE OF DEER FROM BASE OF TREE "X" | ANGLE | # ON BODY |
|---|---|---|---|
| 10 FEET | 5 YARDS (15 ft.) | 41 deg | 6.25 |
| | 10 YARDS (30 ft.) | 23 deg | 9 |
| | 15 YARDS (45 ft.) | 15 deg | 10.25 |
| | 20 YARDS (60 ft.) | 12 deg | 10.75 |
| | 25 YARDS (75 ft.) | 10 deg | 11.25 |
| | 30 YARDS (90 ft.) | 8 deg | 11.5 |
| | 35 YARDS (99 ft.) | 7 deg | 11.5 |
| | 40 YARDS (120 ft.) | 6 deg | 11.75 |
| | 45 YARDS (135 ft.) | 5 deg | 12 |
| | 50 YARDS (150 ft.) | 5 deg | 12 |
| | 55 YARDS (165 ft.) | 4 deg | 12 |
| | 60 YARDS (180 ft.) | 4 deg | 12 |

FIG. 14

| TREE STAND PLATFORM HEIGHT "H" | DISTANCE OF DEER FROM BASE OF TREE "X" | ANGLE | # ON BODY |
|---|---|---|---|
| 15 FEET | 5 YARDS (15 ft.) | 50 deg | 5 |
| | 10 YARDS (30 ft.) | 31 deg | 9 |
| | 15 YARDS (45 ft.) | 22 deg | 10.25 |
| | 20 YARDS (60 ft.) | 17 deg | 10.75 |
| | 25 YARDS (75 ft.) | 14 deg | 11.25 |
| | 30 YARDS (90 ft.) | 11 deg | 11.5 |
| | 35 YARDS (99 ft.) | 10 deg | 11.25 |
| | 40 YARDS (120 ft.) | 9 deg | 11.5 |
| | 45 YARDS (135 ft.) | 7 deg | 11.5 |
| | 50 YARDS (150 ft.) | 7 deg | 11.5 |
| | 55 YARDS (165 ft.) | 6 deg | 11.75 |
| | 60 YARDS (180 ft.) | 6 deg | 11.75 |

FIG. 15

| TREE STAND PLATFORM HEIGHT "H" | DISTANCE OF DEER FROM BASE OF TREE "X" | ANGLE | # ON BODY |
|---|---|---|---|
| 20 FEET | 5 YARDS (15 ft.) | 57 deg | 4.25 |
| | 10 YARDS (30 ft.) | 37 deg | 7 |
| | 15 YARDS (45 ft.) | 27 deg | 8.25 |
| | 20 YARDS (60 ft.) | 21 deg | 9.25 |
| | 25 YARDS (75 ft.) | 17 deg | 10 |
| | 30 YARDS (90 ft.) | 15 deg | 10.5 |
| | 35 YARDS (99 ft.) | 13 deg | 10.75 |
| | 40 YARDS (120 ft.) | 11 deg | 11 |
| | 45 YARDS (135 ft.) | 10 deg | 11.25 |
| | 50 YARDS (150 ft.) | 9 deg | 11.25 |
| | 55 YARDS (165 ft.) | 8 deg | 11.5 |
| | 60 YARDS (180 ft.) | 7 deg | 11.5 |

FIG. 16

| TREE STAND PLATFORM HEIGHT "H" | DISTANCE OF DEER FROM BASE OF TREE "X" | ANGLE | # ON BODY |
|---|---|---|---|
| 25 FEET | 5 YARDS (15 ft.) | 62 deg | 3.25 |
| | 10 YARDS (30 ft.) | 43 deg | 6.25 |
| | 15 YARDS (45 ft.) | 32 deg | 7.75 |
| | 20 YARDS (60 ft.) | 25 deg | 8.5 |
| | 25 YARDS (75 ft.) | 20 deg | 9.5 |
| | 30 YARDS (90 ft.) | 17 deg | 10 |
| | 35 YARDS (99 ft.) | 16 deg | 10.25 |
| | 40 YARDS (120 ft.) | 13 deg | 10.5 |
| | 45 YARDS (135 ft.) | 12 deg | 11 |
| | 50 YARDS (150 ft.) | 11 deg | 11 |
| | 55 YARDS (165 ft.) | 10 deg | 11.25 |
| | 60 YARDS (180 ft.) | 9 deg | 11.25 |

FIG. 17

| TREE STAND PLATFORM HEIGHT "H" | DISTANCE OF DEER FROM BASE OF TREE "X" | ANGLE | # ON BODY |
|---|---|---|---|
| 30 FEET | 5 YARDS (15 ft.) | 66 deg | 2.5 |
| | 10 YARDS (30 ft.) | 48 deg | 5.25 |
| | 15 YARDS (45 ft.) | 36 deg | 7.25 |
| | 20 YARDS (60 ft.) | 29 deg | 8.25 |
| | 25 YARDS (75 ft.) | 24 deg | 8.75 |
| | 30 YARDS (90 ft.) | 20 deg | 9.5 |
| | 35 YARDS (99 ft.) | 18 deg | 9.75 |
| | 40 YARDS (120 ft.) | 15 deg | 10.25 |
| | 45 YARDS (135 ft.) | 14 deg | 10.5 |
| | 50 YARDS (150 ft.) | 12 deg | 10.75 |
| | 55 YARDS (165 ft.) | 11 deg | 11 |
| | 60 YARDS (180 ft.) | 10 deg | 11.25 |

FIG. 18

| TREE STAND PLATFORM HEIGHT "H" | DISTANCE OF DEER FROM BASE OF TREE "X" | ANGLE | # ON BODY |
|---|---|---|---|
| 35 FEET | 5 YARDS (15 ft.) | 68 deg | 2.25 |
| | 10 YARDS (30 ft.) | 52 deg | 5 |
| | 15 YARDS (45 ft.) | 40 deg | 6.5 |
| | 20 YARDS (60 ft.) | 32 deg | 7.75 |
| | 25 YARDS (75 ft.) | 27 deg | 8.25 |
| | 30 YARDS (90 ft.) | 23 deg | 9 |
| | 35 YARDS (99 ft.) | 21 deg | 9.75 |
| | 40 YARDS (120 ft.) | 18 deg | 10.25 |
| | 45 YARDS (135 ft.) | 16 deg | 10.25 |
| | 50 YARDS (150 ft.) | 14 deg | 10.5 |
| | 55 YARDS (165 ft.) | 13 deg | 10.75 |
| | 60 YARDS (180 ft.) | 12 deg | 10.75 |

FIG. 19

| TREE STAND PLATFORM HEIGHT "H" | DISTANCE OF DEER FROM BASE OF TREE "X" | ANGLE | # ON BODY |
|---|---|---|---|
| 40 FEET | 5 YARDS (15 ft.) | 71 deg | 2 |
| | 10 YARDS (30 ft.) | 55 deg | 4.5 |
| | 15 YARDS (45 ft.) | 44 deg | 6 |
| | 20 YARDS (60 ft.) | 36 deg | 7.25 |
| | 25 YARDS (75 ft.) | 30 deg | 8 |
| | 30 YARDS (90 ft.) | 26 deg | 8.5 |
| | 35 YARDS (99 ft.) | 23 deg | 9 |
| | 40 YARDS (120 ft.) | 20 deg | 9.5 |
| | 45 YARDS (135 ft.) | 18 deg | 9.75 |
| | 50 YARDS (150 ft.) | 16 deg | 10.25 |
| | 55 YARDS (165 ft.) | 15 deg | 10.5 |
| | 60 YARDS (180 ft.) | 13 deg | 10.5 |

FIG. 20

| TREE STAND PLATFORM HEIGHT "H" | DISTANCE OF DEER FROM BASE OF TREE "X" | ANGLE | # ON BODY |
|---|---|---|---|
| 10 FEET | 5 YARDS (15 ft.) | 41 deg | 27.75 |
| | 10 YARDS (30 ft.) | 23 deg | 30.25 |
| | 15 YARDS (45 ft.) | 15 deg | 31.25 |
| | 20 YARDS (60 ft.) | 12 deg | 31.75 |
| | 25 YARDS (75 ft.) | 10 deg | 32.25 |
| | 30 YARDS (90 ft.) | 8 deg | 32.5 |
| | 35 YARDS (99 ft.) | 7 deg | 32.5 |
| | 40 YARDS (120 ft.) | 6 deg | 32.5 |
| | 45 YARDS (135 ft.) | 5 deg | 32.75 |
| | 50 YARDS (150 ft.) | 5 deg | 32.75 |
| | 55 YARDS (165 ft.) | 4 deg | 33 |
| | 60 YARDS (180 ft.) | 4 deg | 33 |

FIG. 21

| TREE STAND PLATFORM HEIGHT "H" | DISTANCE OF DEER FROM BASE OF TREE "X" | ANGLE | # ON BODY |
|---|---|---|---|
| 15 FEET | 5 YARDS (15 ft.) | 50 deg | 26 |
| | 10 YARDS (30 ft.) | 31 deg | 29 |
| | 15 YARDS (45 ft.) | 22 deg | 30.25 |
| | 20 YARDS (60 ft.) | 17 deg | 31 |
| | 25 YARDS (75 ft.) | 14 deg | 31.5 |
| | 30 YARDS (90 ft.) | 11 deg | 32 |
| | 35 YARDS (99 ft.) | 10 deg | 32 |
| | 40 YARDS (120 ft.) | 9 deg | 32.25 |
| | 45 YARDS (135 ft.) | 7 deg | 32.5 |
| | 50 YARDS (150 ft.) | 7 deg | 32.5 |
| | 55 YARDS (165 ft.) | 6 deg | 32.5 |
| | 60 YARDS (180 ft.) | 6 deg | 32.5 |

FIG. 22

| TREE STAND PLATFORM HEIGHT "H" | DISTANCE OF DEER FROM BASE OF TREE "X" | ANGLE | # ON BODY |
|---|---|---|---|
| 20 FEET | 5 YARDS (15 ft.) | 57 deg | 24.5 |
| | 10 YARDS (30 ft.) | 37 deg | 28.25 |
| | 15 YARDS (45 ft.) | 27 deg | 29.5 |
| | 20 YARDS (60 ft.) | 21 deg | 30.25 |
| | 25 YARDS (75 ft.) | 17 deg | 31 |
| | 30 YARDS (90 ft.) | 15 deg | 31.25 |
| | 35 YARDS (99 ft.) | 13 deg | 31.5 |
| | 40 YARDS (120 ft.) | 11 deg | 32 |
| | 45 YARDS (135 ft.) | 10 deg | 32 |
| | 50 YARDS (150 ft.) | 9 deg | 32.25 |
| | 55 YARDS (165 ft.) | 8 deg | 32.5 |
| | 60 YARDS (180 ft.) | 7 deg | 32.5 |

FIG. 23

| TREE STAND PLATFORM HEIGHT "H" | DISTANCE OF DEER FROM BASE OF TREE "X" | ANGLE | # ON BODY |
|---|---|---|---|
| 25 FEET | 5 YARDS (15 ft.) | 62 deg | 23.75 |
| | 10 YARDS (30 ft.) | 43 deg | 27.5 |
| | 15 YARDS (45 ft.) | 32 deg | 28.75 |
| | 20 YARDS (60 ft.) | 25 deg | 30.25 |
| | 25 YARDS (75 ft.) | 20 deg | 30.5 |
| | 30 YARDS (90 ft.) | 17 deg | 31 |
| | 35 YARDS (99 ft.) | 16 deg | 31.25 |
| | 40 YARDS (120 ft.) | 13 deg | 31.75 |
| | 45 YARDS (135 ft.) | 12 deg | 31.75 |
| | 50 YARDS (150 ft.) | 11 deg | 32 |
| | 55 YARDS (165 ft.) | 10 deg | 32 |
| | 60 YARDS (180 ft.) | 9 deg | 32.25 |

FIG. 24

| TREE STAND PLATFORM HEIGHT "H" | DISTANCE OF DEER FROM BASE OF TREE "X" | ANGLE | # ON BODY |
|---|---|---|---|
| 30 FEET | 5 YARDS (15 ft.) | 66 deg | 23.25 |
| | 10 YARDS (30 ft.) | 48 deg | 26.5 |
| | 15 YARDS (45 ft.) | 36 deg | 28.75 |
| | 20 YARDS (60 ft.) | 29 deg | 29.25 |
| | 25 YARDS (75 ft.) | 24 deg | 30 |
| | 30 YARDS (90 ft.) | 20 deg | 30.5 |
| | 35 YARDS (99 ft.) | 18 deg | 30.75 |
| | 40 YARDS (120 ft.) | 15 deg | 31.5 |
| | 45 YARDS (135 ft.) | 14 deg | 31.5 |
| | 50 YARDS (150 ft.) | 12 deg | 31.75 |
| | 55 YARDS (165 ft.) | 11 deg | 32 |
| | 60 YARDS (180 ft.) | 10 deg | 32 |

FIG. 25

| TREE STAND PLATFORM HEIGHT "H" | DISTANCE OF DEER FROM BASE OF TREE "X" | ANGLE | # ON BODY |
|---|---|---|---|
| 35 FEET | 5 YARDS (15 ft.) | 68 deg | 22.75 |
| | 10 YARDS (30 ft.) | 52 deg | 25.75 |
| | 15 YARDS (45 ft.) | 40 deg | 27.75 |
| | 20 YARDS (60 ft.) | 32 deg | 28.75 |
| | 25 YARDS (75 ft.) | 27 deg | 29.5 |
| | 30 YARDS (90 ft.) | 23 deg | 30.25 |
| | 35 YARDS (99 ft.) | 21 deg | 30.5 |
| | 40 YARDS (120 ft.) | 18 deg | 30.75 |
| | 45 YARDS (135 ft.) | 16 deg | 31.25 |
| | 50 YARDS (150 ft.) | 14 deg | 31.5 |
| | 55 YARDS (165 ft.) | 13 deg | 31.5 |
| | 60 YARDS (180 ft.) | 12 deg | 31.75 |

FIG. 26

| TREE STAND PLATFORM HEIGHT "H" | DISTANCE OF DEER FROM BASE OF TREE "X" | ANGLE | # ON BODY |
|---|---|---|---|
| 40 FEET | 5 YARDS (15 ft.) | 71 deg | 22.25 |
| | 10 YARDS (30 ft.) | 55 deg | 25 |
| | 15 YARDS (45 ft.) | 44 deg | 27.25 |
| | 20 YARDS (60 ft.) | 36 deg | 28.5 |
| | 25 YARDS (75 ft.) | 30 deg | 29 |
| | 30 YARDS (90 ft.) | 26 deg | 29.5 |
| | 35 YARDS (99 ft.) | 23 deg | 30 |
| | 40 YARDS (120 ft.) | 20 deg | 30.5 |
| | 45 YARDS (135 ft.) | 18 deg | 30.75 |
| | 50 YARDS (150 ft.) | 16 deg | 31.25 |
| | 55 YARDS (165 ft.) | 15 deg | 31.25 |
| | 60 YARDS (180 ft.) | 13 deg | 31.5 |

FIG. 27

ARCHERY TARGETS

CROSS REFERENCE TO RELATED APPLICATIONS

This non-provisional patent application claims the benefit of and priority under 35 U.S.C. §119(e) from U.S. Provisional Patent Application Ser. No. 61/890,406, filed Oct. 14, 2013, entitled ARCHERY TARGETS, the entire disclosure of which is hereby incorporated by reference herein and from U.S. Provisional Patent Application Ser. No. 61/921,767, filed Dec. 30, 2013, entitled ARCHERY TARGETS, the entire disclosure of which is also hereby incorporated by reference herein.

FIELD OF THE INVENTION

The present invention relates to targets and more particularly, to archery targets formed in the shape of an animal and configured to be shot with arrows from an elevated or level shooting position relative to the target or a shooting position that is below the target.

BACKGROUND

Over the years, a variety of different targets have been developed for stopping arrows shot from long bows, recurve bows, compound bows, crossbows, etc. Some targets, for example, comprise sacks that are filled with materials, such as foam, cloth, straw, etc. that serve to stop the arrows as they pass into the target. Bulls-eyes, animal images, etc. may be printed on or otherwise attached to the sack. Still other targets have been developed that are formed from a foam material in the shape of a cube, ball, etc. that has bulls-eyes, animal forms or other shapes printed thereon. To better facilitate practice for the bowhunter, various foam targets exist that replicate the size and shape of a target animal such as, for example, a deer, elk, sheep, caribou, etc.

Many bowhunters, particularly those hunting for whitetail deer, hunt out of elevated treestands and platforms. Such approach places the hunter above the animal's line of sight and also helps to keep the hunter's scent from being detected by the animal. It is every hunter's goal to make a quick humane kill of their quarry with just one arrow. To do so, the arrow must be carefully aimed so that it passes through one or more of the animal's vital organs (e.g., the lungs, heart, and/or liver).

To assist the bowhunter in learning where to aim to achieve such desired arrow placement, some foam archery targets have been formed that have shapes of the various vital organs printed or otherwise formed on the outer surface or outer perimeter of the target. Such arrangements lack anatomical accuracy and do not provide the hunter with a realistic scenario as the organs of a live animal are not viewable through its fur or skin. Moreover, because the organ depictions are printed or otherwise formed on the exterior surface of the target, they do not provide the hunter with an accurate point of aim when practicing from a treestand or elevated platform. Indeed, such arrangements can lead the hunter into adopting a method of aiming or placing an arrow that he or she believes will strike vital organs, when in fact, an arrow passing through a live animal in that location would miss the animal's vital organs. If an arrow strikes an animal just a fraction of an inch from the aiming mark, it could pass through the animal without striking an organ and thus the hit might not be fatal. Similar problems may be encountered by hunters using guns.

Thus, there is a need for anatomically accurate animal and/or bird targets that can be employed to educate hunters on proper arrow placement.

There is a further need for animal targets that are configured to assist the archer or gun hunter in assessing where to aim on the exterior of the target to ensure that the arrow, bullet or other projectile passes through one or more vital organs.

There is still another need for a kit arrangement that may be employed with existing animal-shaped targets that will assist the hunter in determining placement of an arrow, bullet or other projectile from an elevated position to ensure that when placed in the same spot on a live animal, the arrow or bullet will pass through one or more vital organs.

There is yet another need for an animal-shaped target with one or more of the above-discussed attributes that can accommodate arrows tipped with field points and arrows tipped with broadheads.

Another need exists for a target system that may be used to extend the life of three dimensional archery targets that are often used for competitive shooting events.

Yet another need exists for a target system that will assist the hunter in determining the placement of an arrow, bullet or other projectile from a shooting position that is not directly broadside relative to the target and may or may not be positioned on the same elevation as the target.

Still another need exists for a scoring system and method for scoring the accuracy of shots made on a target during a competitive archery shoot.

Various embodiments disclosed herein may address one or more of the needs identified above and others. The foregoing discussion is intended only to illustrate some of the shortcomings present in the field of the invention at the time, and should not be taken as a disavowal of claim scope.

BRIEF DESCRIPTION OF THE FIGURES

The accompanying drawings, which are incorporated in and constitute a part of this specification, illustrate embodiments, and, together with the general description given above, and the detailed description given below, serve to explain the principles of the various forms and embodiments disclosed herein.

FIG. 14 comprises a chart that sets forth first aiming marks (numbers) and shot angles for different horizontal distances for a shot location having a treestand height of ten feet when the target is positioned broadside relative to the shot location;

FIG. 15 comprises a chart that sets forth first aiming marks (numbers) and shot angles for different horizontal distances for a shot location having a treestand height of fifteen feet when the target is positioned broadside relative to the shot location;

FIG. 16 comprises a chart that sets forth first aiming marks (numbers) and shot angles for different horizontal distances for a shot location having a treestand height of twenty feet when the target is positioned broadside relative to the shot location;

FIG. 17 comprises a chart that sets forth first aiming marks (numbers) and shot angles for different horizontal distances for a shot location having a treestand height of twenty-five feet when the target is positioned broadside relative to the shot location;

FIG. 18 comprises a chart that sets forth first aiming marks (numbers) and shot angles for different horizontal distances for a shot location having a treestand height of thirty feet when the target is positioned broadside relative to the shot location;

FIG. 19 comprises a chart that sets forth first aiming marks (numbers) and shot angles for different horizontal distances for a shot location having a treestand height of thirty-five feet when the target is positioned broadside relative to the shot location;

FIG. 20 comprises a chart that sets forth first aiming marks (numbers) and shot angles for different horizontal distances for a shot location having a treestand height of forty feet when the target is positioned broadside relative to the shot location;

FIG. 21 comprises a chart that sets forth second aiming marks (numbers) and shot angles for different horizontal distances for a shot location having a treestand height of ten feet when the target is positioned quartering away from (45 degree angle) the shot location;

FIG. 22 comprises a chart that sets forth second aiming marks (numbers) and shot angles for different horizontal distances for a shot location having a treestand height of fifteen feet when the target is positioned quartering away from (45 degree angle) the shot location;

FIG. 23 comprises a chart that sets forth second aiming marks (numbers) and shot angles for different horizontal distances for a shot location having a treestand height of twenty feet when the target is positioned quartering away from (45 degree angle) the shot location;

FIG. 24 comprises a chart that sets forth second aiming marks (numbers) and shot angles for different horizontal distances for a shot location having a treestand height of twenty-five feet when the target is positioned quartering away from (45 degree angle) the shot location;

FIG. 25 comprises a chart that sets forth second aiming marks (numbers) and shot angles for different horizontal distances for a shot location having a treestand height of thirty feet when the target is positioned quartering away from (45 degree angle) the shot location;

FIG. 26 comprises a chart that sets forth second aiming marks (numbers) and shot angles for different horizontal distances for a shot location having a treestand height of thirty-five feet when the target is positioned quartering away from (45 degree angle) the shot location;

FIG. 27 comprises a chart that sets forth second aiming marks (numbers) and shot angles for different horizontal distances for a shot location having a treestand height of forty feet when the target is positioned quartering away (45 degree angle) from the shot location;

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments is defined solely by the claims. The features illustrated or described in connection with one exemplary embodiment may be combined with the features of other embodiments. Such modifications and variations are intended to be included within the scope of the present invention.

When an arrow is shot from a bow towards a target, as the arrow loses velocity, it will drop until it hits the ground, unless it hits the target before it hits the ground. A variety of different sighting devices have been used to assist the archer in the aiming process. For example, some archery sights that are attached to the bow consist of a device containing a series of stacked pins. The device is configured to be attached to the bow so that when the archer is at full draw, the pins are viewable to the archer. The uppermost pin is generally used for the closest distance to the target and every succeeding pin corresponds to a farther distance. For example, a sighting device may contain five pins. The archer may elect to preset the upper pin to correspond to a horizontal distance of 20 yards to the target. The second pin may correspond to a horizontal distance of 30 yards. The third pin may correspond to a horizontal distance of 40 yards. The fourth pin may correspond to a horizontal distance of 50 yards and the fifth pin may correspond to a horizontal distance of 60 yards. Thus, if the archer is located a horizontal distance of 30 yards from the target, the archer will place the second pin on the point on the target that he or she wishes to hit and then release the arrow. Other sighting devices include a single pin that is movable relative to the riser. Such sighting devices have a reference wheel which can be used to adjust the height of the pin to the desired horizontal distance.

Figure 1:
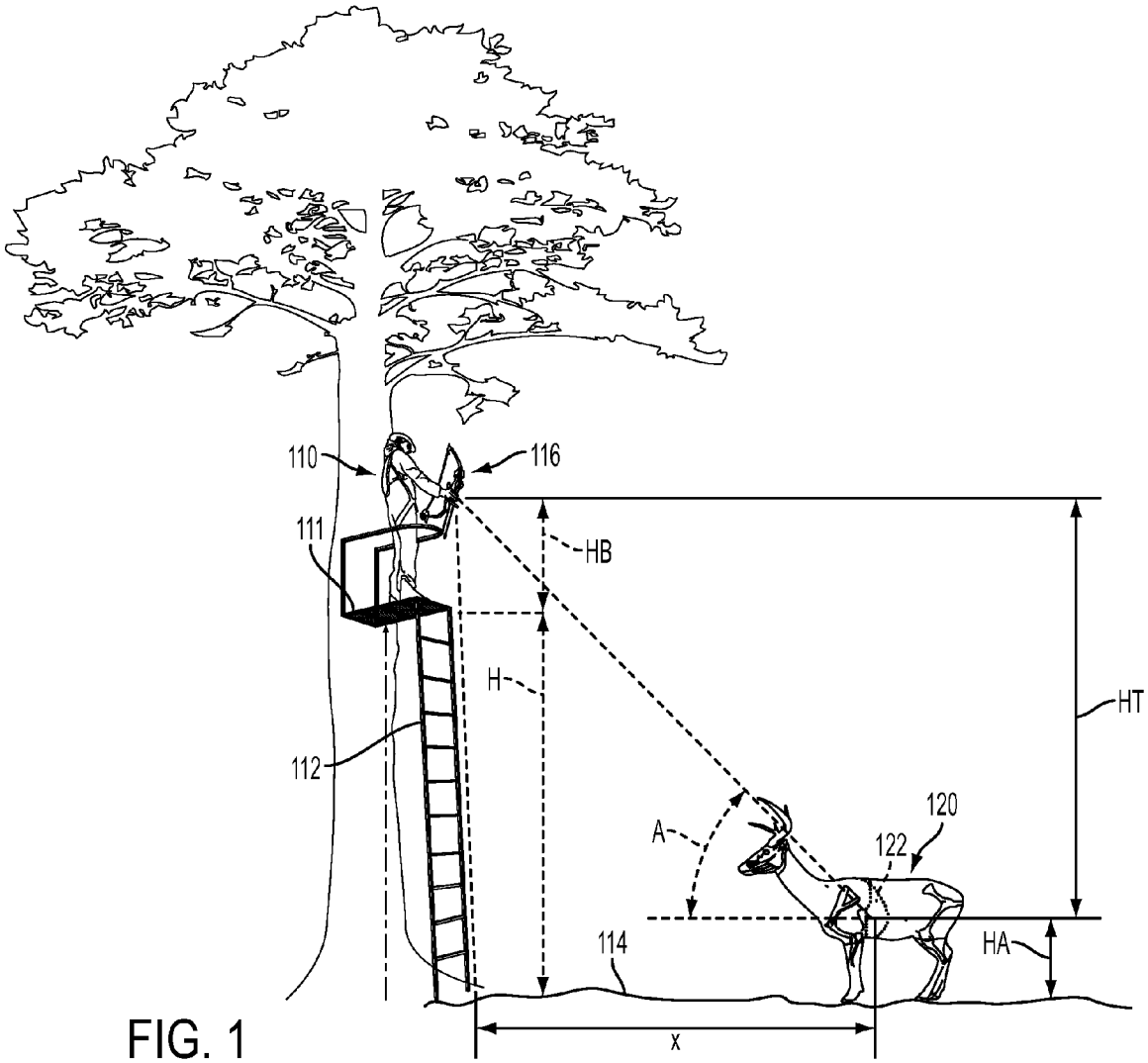
FIG. 1 is a side elevational depiction of an archer or bowhunter in a treestand preparing to shoot an arrow at a target example of one form of the present invention.

When pre-adjusting or "sighting in" these sighting devices, the archer generally relies on the "true horizontal distance" to the target for locating the sight pin(s). Thus, in the foregoing example, the yardage that corresponds to each sight pin setting represents the horizontal distance to the target. When the archer is elevated above the target, the archer still needs to know this horizontal distance to the target. This situation is depicted in FIG. 1. As can be seen in that Figure, the archer or bowhunter 110 is supported on a treestand 112 above the ground surface 114 upon which the target 120 is supported. The point from which the arrow is launched is referred to herein as a particular "shooting location". The height that an arrow, when supported on the archer's bow 116 (e.g., the "shooting location"), is above the target location 122 on the target 120 is represented by the distance "HT". In this example, the target location 122 is located a height "HA" above the ground 114. For aiming purposes, the distance that the archer is concerned with is the true horizontal distance between the archer 110 and the target location 122 on the target 120 is the "true shooting distance" represented as "X" in FIG. 1.

Over the years, handheld electronic laser range finders have been developed to assist the archer in quickly ascertaining a distance to a target. Prior laser range finders simply calculated the straight line distance to the target. In the FIG. 1, for example, that distance would represent the length of the hypotenuse of the imaginary triangle with legs "HT" and "X". The archer would place the crosshairs or aiming mark in the laser range finder on the target and activate the device. The device would then calculate and display the straight line distance to the target. Modern day laser range finders, however, can calculate the "true shooting distance" or "true horizontal distance" even when the archer is located above or below the target.

While the aforementioned laser range finders provide the archer with an effective means of quickly ascertaining the true shooting distance to a target, those archers who shoot at live animals (hereinafter referred to as "bowhunters") face additional challenges. Bowhunters typically use arrows that are tipped with cutting devices known in the industry as "broadheads" that are designed to cut tissue and organs as they pass through the animal. The animal then dies from hemorrhaging and loss of blood. To achieve a fast and humane kill, the bowhunter strives to place the broadhead tipped arrow through a vital organ such as, for example, the heart, lungs or liver. Simply knowing the true shooting distance to the animal, however, is not enough to ensure such a fatal hit. The bowhunter must know where to aim on the animal to ensure that the arrow strikes a vital organ and results in a quick, humane kill.

As indicated above, in an effort to assist bowhunters in practicing making fatal hits on their quarry, three dimensional animal targets have been developed. Such targets are often fabricated from foam-like material that will permit the arrow to pass therein without damaging the arrow and facilitating its relatively easy removal therefrom. A variety of different foam materials have been developed for this process and are known. Such target arrangements, however, typically lack anatomical accuracy and do not provide the bowhunter with a realistic scenario as the organs of a live animal are not viewable through its fur or skin. Some targets have been developed that include representations of the animal's organs that are printed on the exterior or otherwise formed on the exterior surface of the target. However, such targets fail to provide the bowhunter with an accurate point of aim when practicing from a treestand or elevated platform. Indeed, such arrangements can lead the hunter into adopting a method of aiming or placing an arrow that he or she believes will strike vital organs, when in fact, an arrow passing through a live animal in that location would miss the animal's vital organs.

FIGS. 2-5 illustrate one form of archery target 120 that comprises a three dimensional animal mannequin. While the target 120 is depicted herein in the shape of a whitetail deer, the unique and novel aspects of various implementations of the present inventions described herein may be embodied and employed in connection with other animal forms. Thus, the term "animal" as used herein not only encompasses whitetail deer, it also includes, but is not limited to, bear, moose, caribou, antelope, sheep, goats, elk, mountain lion, muskox, bison, fox, coyote, raccoon, etc. as well as birds such as turkey, geese, ostrich, etc. Indeed, as the present Detailed Description proceeds, those of ordinary skill in the art will appreciate that the various unique and novel aspects of the implementations disclosed herein may be applied to targets resembling a human-like form (e.g., zombies, sasquatch, etc.) or a reptilian form (dinosaur), etc. As can be seen in FIGS. 2-5, the target 120 includes a body portion 130 that is supported on leg assemblies 132 and 134. The body portion 130 may be molded out of or formed out of foam material supplied by, for example, North Carolina Foam Industries of Mount Airy, N.C., utilizing conventional molding/fabricating techniques. Other foam materials may also be employed. The body portion 130 and the legs 132 and 134 may be formed from the same material and comprise an integral unit. The legs 132, 134 may, for example, have a conduit or pipe member (not shown) to form a socket therein. The socket may be sized to receive therein a corresponding pin or rod (not shown) that has been inserted into the ground 114 or is mounted on a stand (not shown). Such arrangement serves to support the target 120 in an upright position. In alternative arrangements, the legs 132, 134 may be fabricated from a material that differs from the material from which the body portion 130 is fabricated. For example, the legs 132, 134 may be fabricated from a rigid polymer or plastic material, wood, metal, etc. and be attached to corresponding portions of the body portion 130 by pin/socket arrangements, fasteners, interlocking protrusions, adhesive, screws, etc.

The body portion 130 may have a first side 140 and a second side 160. The first side 140 may, for example, comprise a "fur" side and have a fur-like texture 142 formed therein. See FIG. 2. In addition, the first side 140 may also have formed thereon leg bone depictions 144, 146 and/or muscular, vein and/or artery formations 148. These depictions 144, 146, 148 may be formed in the same color as the remaining portions of the first side 140. For example, for a whitetail deer arrangement, the color of the target foam may be light brown to simulate the color of a whitetail deer's fur. In such arrangement, for example, such formations 144, 146, 148 may not be noticeable at a distance from the target such that when viewed from a distance, the first side 140 appears to mimic the fur side of a whitetail deer. In alternative arrangements, the formations may be provided in colors that differ from the color of the remaining portions of the first side. For example, formations 144, 146 may have a white or bone color and formations 148 may have a pink, red or muscle-like color. In addition, the formations may include descriptive indicia 149 such as, for example, "stay away zone", "humerus", "scapula", "olch", "penetrating scapula", "scapula cartilage", "paratido", "buccinator", "zygomatious", lac pouch, "lac duct", etc. in alternative implementations, the fur side or the first side may be formed without any of such anatomical features/formations thereon.

Figure 3:
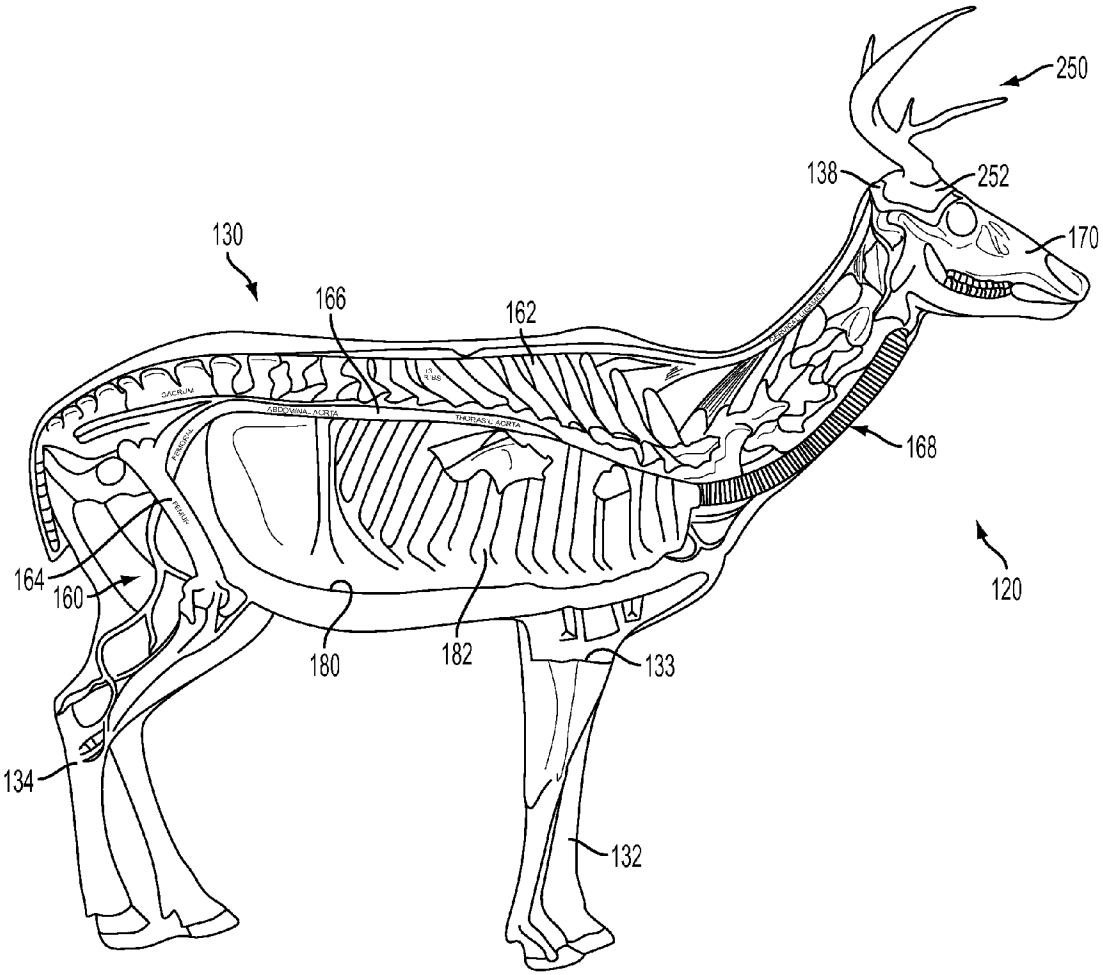
FIG. 3 is a side elevational view of a second side of the archery target of FIG. 2.

FIG. 3 illustrates a second side 160 of the body portion 130. In at least one implementation, the second side 160 may have various anatomically correct formations formed therein. For example, anatomically correct formation 162 represents the various spine vertebrae. Anatomically correct formation 164 represents the rear leg femur. Anatomically correct formation 166 represents the thoracic aorta, abdominal aorta and the femoral artery. Anatomically correct formation 168 represents the windpipe. Anatomically-correct formation 170 represents the skull of the animal. The second side 160 may also have a body cavity 180 formed therein. The inside surface may for example, contain anatomically-correct formations 182 on the inside surface thereof that may represent the animal's rib cage. In alternative implementations, the second side of the target may be formed without anatomically-correct formations thereon.

Figure 4:
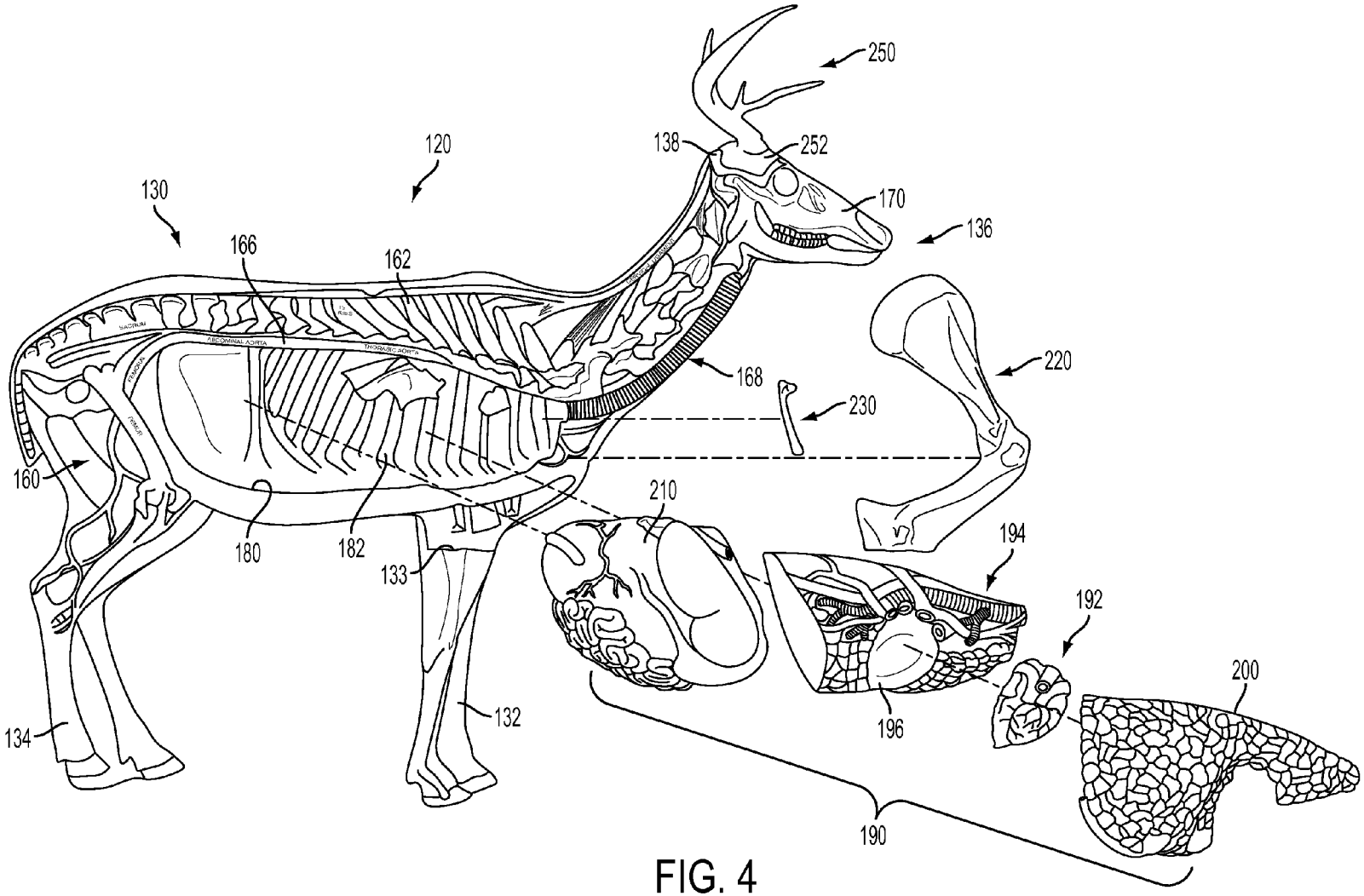
FIG. 4 is an exploded assembly view of the second side of the archery target of FIGS. 2 and 3 with an organ collection, scapula/humerus reproduction and front rib member removed therefrom.
Figure 5:
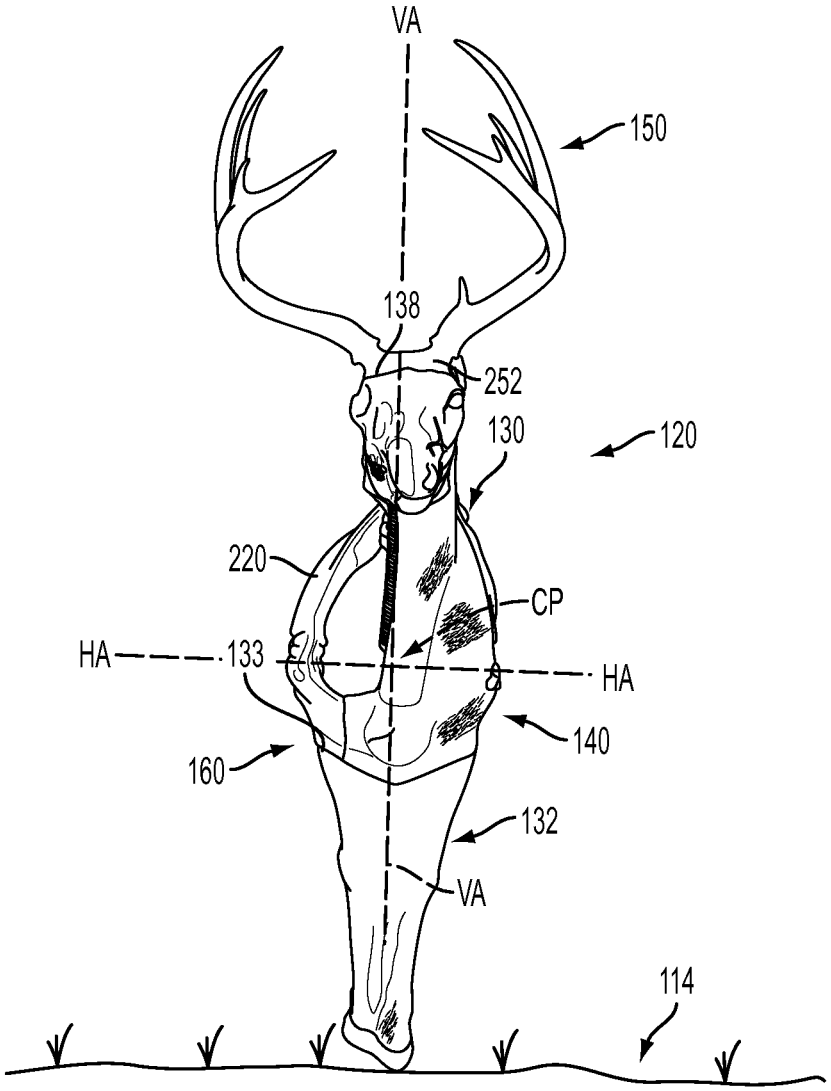
FIG. 5 is a front elevational view of the archery target of FIGS. 2-4 with the scapula/humerus reproduction attached thereto.

Referring to FIG. 4, the target 120 may also include a collection 190 of life-like, anatomically correct organ reproductions that are configured to be removably mounted within the body cavity 180. The collection of organs 190 may include one uniform assembly that is integrally molded or otherwise formed together. In the illustrated arrangement, however, each organ or at least some of the organs comprising the collection 190 of organs has been separately molded to comprise an accurate reproduction of the actual organ. For example, the collection 190 includes an anatomically-correct heart member 192 that may be molded from the foam target materials described above. The heart member 192 may be molded to accurately replicate the animal's heart. In one implementation, the heart may be molded in a red color. The organ collection 190 may further include an anatomically correct left lung assembly 194 that accurately replicates an actual left lung assembly 194 and has a section of the windpipe 168 and various pulmonary artery sections formed therein. The left lung assembly 194 has a heart cavity 196 formed therein for removably receiving the heart member 192 therein. The heart member 192 may be sized to be frictionally retained within the heart cavity 196. However, pins 240, similar in style to common "hat pins" may be inserted through the heart 192 to retain it within the heart cavity 196. In still other alternative implementations, various forms of adhesive or double-sided tape, etc. may be employed to removably retain the heart 192 within heart cavity 196. Similarly, the left lung assembly 194 may be positioned to be frictionally retained within the body cavity 180 by pins 240. See FIG. 6. Other attachment methods such as adhesive, double sided tape, etc. may also be employed. The left lung assembly 194 may, for example, be molded from a pink-colored material of the type described herein. The organ collection 190 may further include a right lung assembly 200 that replicates an inflated right lung of the animal and is configured to mate with the left lung assembly 194 after the left lung assembly 194 has been inserted into the body cavity 180. The right lung assembly 200 may frictionally interface with the left lung assembly 194 and portions of the edges of the body cavity 180 and/or pins 240, adhesive, double sided tape. etc. may be used to retain the right lung assembly 200 in accurate position. The organ collection 190 may further include a liver/intestine member 210 that has the vein-like and intestine like formations molded therein. The liver/intestine member 210 may also be fabricated from the target material described herein and may be colored in a manner so as to mimic or represent the exact colors of those organs. The liver/intestine member 210 is sized to be removably received within the corresponding portion of the body cavity 180 and be retained therein by friction and/or with the use of pins 240 or similar fasteners. Each of these organ assemblies/components may also be removably retained in their anatomically-correct positions by various forms of adhesive, double sided tape, etc.

Figure 6:
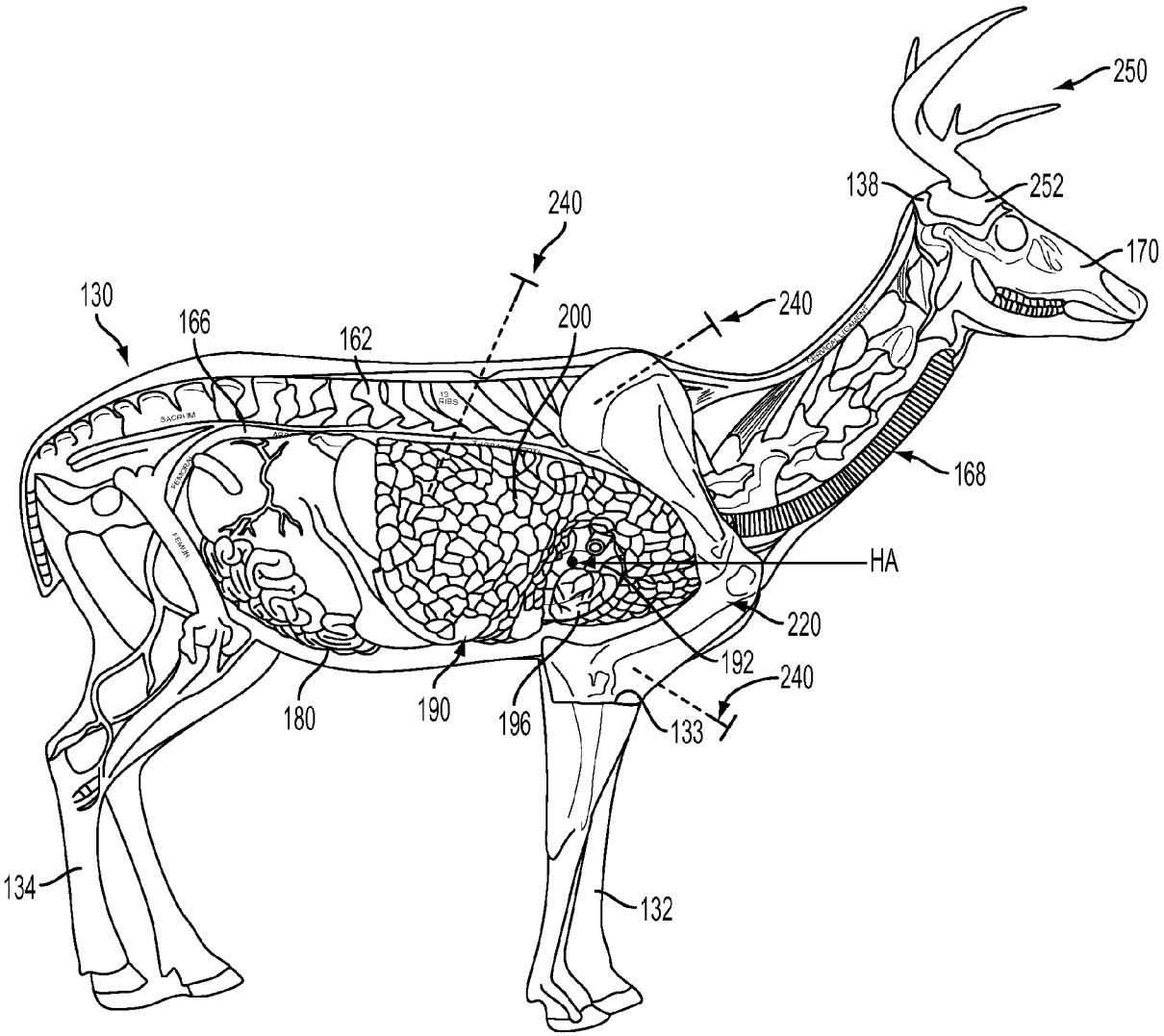
FIG. 6 is a side elevational view of the archery target of FIGS. 2-5 with the organ collection and scapula/humerus reproduction mounted in position to the second side of the target.

Also in various implementations, an accurate reproduction 220 of the animal's right scapula and humerus may also be molded out of the target material or different material such as rigid plastic. In addition, the target 120 may also include an accurate reproduction 230 of the animal's right front rib that may be molded from the target material or from different material such as rigid plastic. As can be seen in FIGS. 4 and 6, the scapula/humerus reproduction 220 is configured to mate with a ledge 133 formed by the front leg assembly 132. The top portion of the scapula/humerus reproduction 220 may be pinned to the upper portion of the target 120 by pins 240. The rib member 230 may also be pinned in position. Such arrangement offers the bowhunter an accurate representation of where the various bones and organs are located within the animal and are much more accurate than prior target arrangements that simply have portions of organs molded into the outer perimeter of the target.

Those of ordinary skill in the art will appreciate that such target implementations will afford the bowhunter or target archer with an ability to accurately assess whether an arrow hitting the target in a particular location and shot angle might strike an organ in such a way as to create a fatal hit. When using the target 120, the archer would locate the target 120 on a surface (i.e., the ground) 114 with the first side 140 facing him or her. When in such position, the archer will be unable to see any of the organ collection 290 and/or any of the bones or other formations on the second side 160 of the target 120. The archer may then shoot into the first side 140 of the target 120. When doing so, the arrow may be stopped in the target material or it may pass through the target. It is more preferable, however, if the arrow stops in the target 120. The archer may then determine which organs the arrow struck to ascertain the lethality of the shot. Even in occasions where the arrow passed completely through the target 220, the archer may assess the lethality of the shot by viewing the arrow's exit hole through the organ(s).

Figure 9:
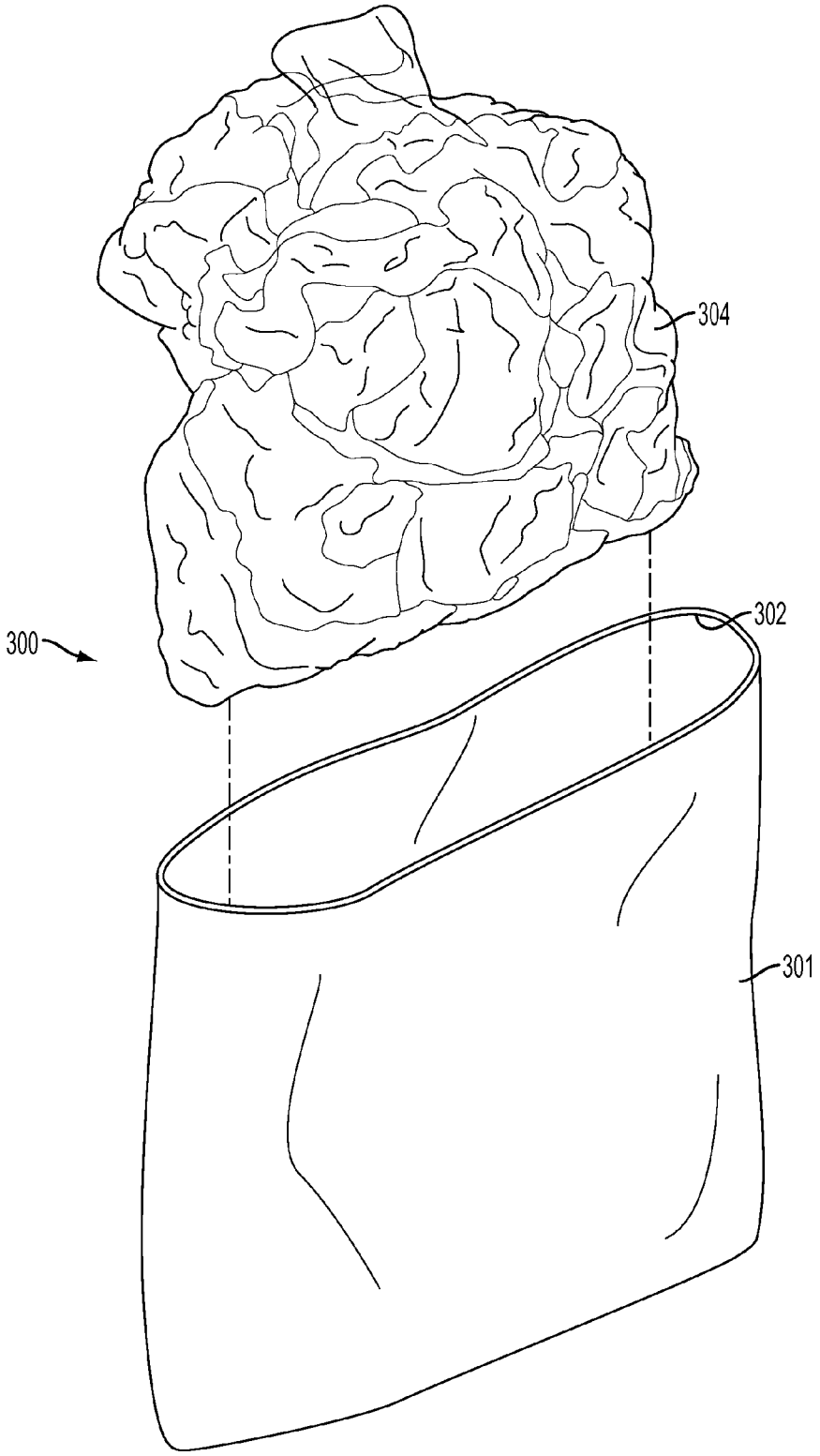
FIG. 9 is an exploded assembly view of a removable target core embodiment of the present invention.
Figure 10:
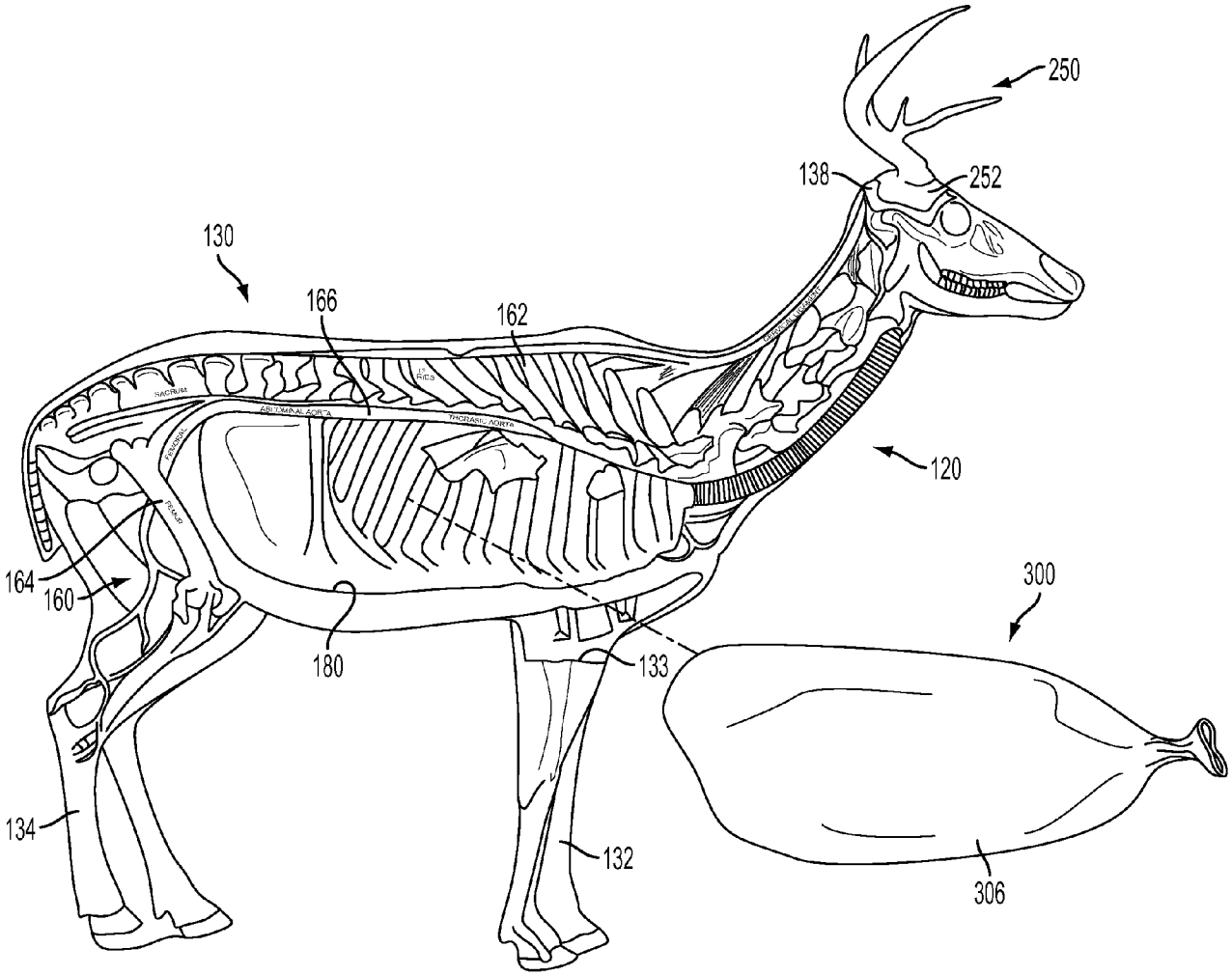
FIG. 10 is an exploded assembly view of the archery target and removable target core of FIG. 9.
Figure 11:
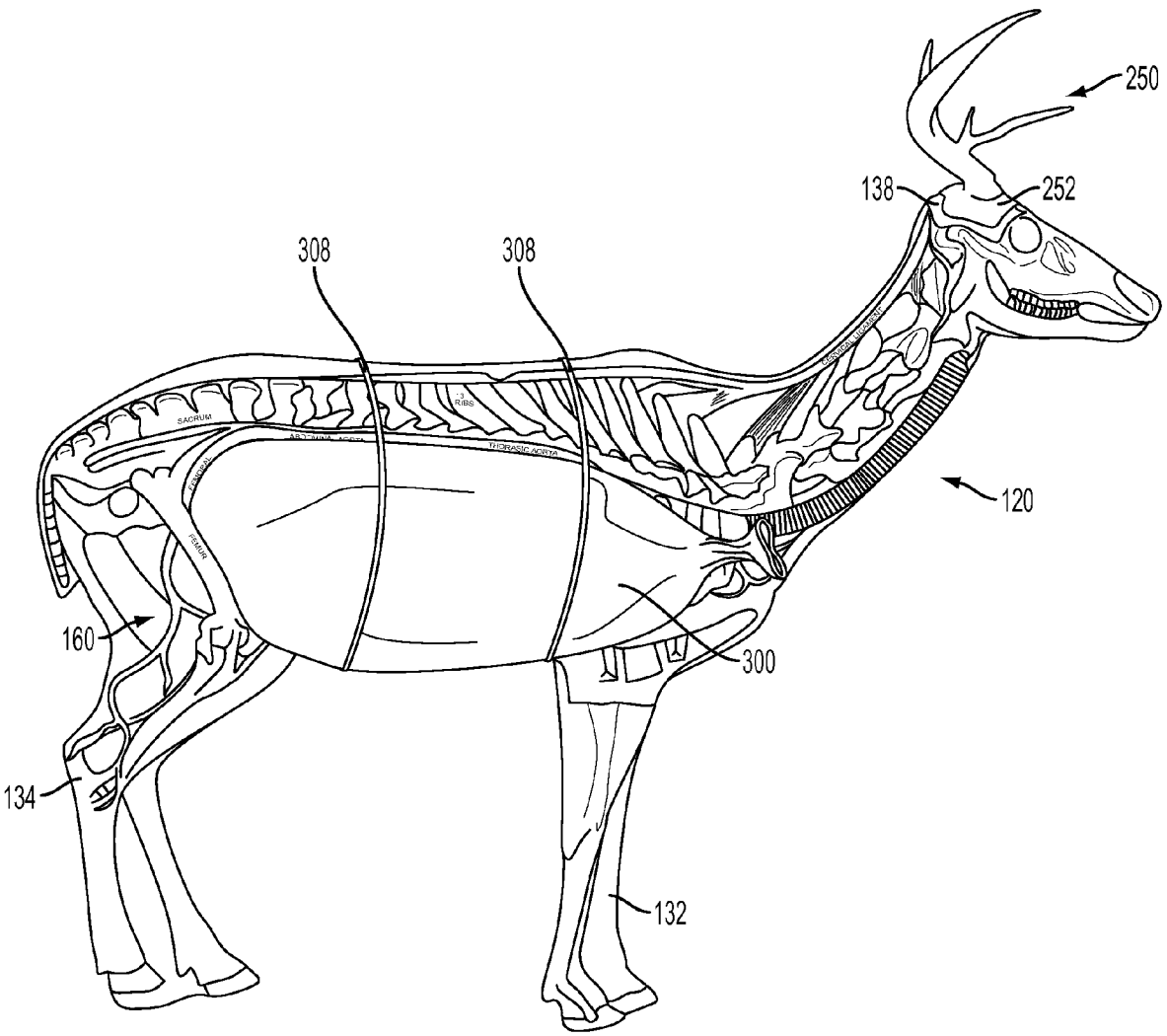
FIG. 11 is another side elevational view of the archery target of FIG. 10 with the target core mounted within the body cavity of the target and retained therein by bungee cords/straps.

The target 120 may also be provided with another removable target core 300 that is sized and shaped to be inserted into the body cavity 180 after the organ collection 190 has been removed therefrom. For example, referring now to FIGS. 9-11, the target core 300 may, for example, comprise a first bag 301 formed from, for example, plastic that has a sealable open end 302 into which bulk arrow stopping material 304 may be inserted. A variety of different bulky arrow stopping material may be used. One form of bulk arrow stopping material that may be effectively used is a collection of cloth strips or pieces of scrap cloth, cotton, denim, etc. However, straw, foam, etc. may also be used. The first bag 301 is sized such that when filled with the bulk arrow stopping material 304 and then evacuated, the final size of the target core 300 enables it to fit into the body cavity 180 and substantially fill it. See, for example, FIG. 11. After the arrow stopping material 304 has been placed inside the first bag 301, the first bag 310 is evacuated using a source of vacuum such as, for example, a conventional vacuum cleaner or other source of suction. Once the first bag 301 is evacuated, it is sealed and it may then be placed in a second outer bag 306. The second outer bag 306 may comprise, for example, a burlap bag. The burlap bag 306 may then be sealed to complete the target core 300. The target core 300 may then be placed inside the body cavity 180 and then retained therein by bungee cords 308, straps, adhesive, double sided-tape, etc. See FIG. 11.

Depending upon the particular target configuration, other removable target core arrangements may be employed. For example, in those target implementations that may have a rectangular or square-spaced cavity formed therein, the core may have a square or rectangular shape (or other shapes) that closely matches the size and shape of the cavity. In certain implementations, a cardboard box having a similar shape that is sized to fill the cavity may be employed, for example. The box may be filled with filler material such as cloth, straw, foam etc. and be wrapped with a tape such as a fiberglass tape, duct tape, etc. Depending upon the speed of the arrows and the density of the filler material placed within the box, the arrows shot into the box should be stopped therein. The archer may then pull the arrow out through the target foam on the first side of the target. To improve the arrow-stopping ability, the filler material may be compressed within the box to increase its density. For example, a hydraulically or other actuated press may be used to compress the filler material within the box or internal bag. The removable core may be installed within the cavity in the target and then covered up by a removable foam panel that is designed to cover the core and make the target realistic. The foam panel may be attached to the remaining portion of the target by glue, pins, plastic screws, etc. In other implementations, the core may comprise a foam core having a desired arrow-stopping density and be sized and shaped to fill the cavity and match the remaining portion of the target without the need for the removable panel.

The target core 300 may not be visible by the archer when the first side 140 is facing the archer and the target core is supported within the body cavity 180. Thus, the archer may shoot arrows into the first side 140 of the target 120 which will then be stopped or slowed by the target core 300. Use of the target core 300 enables the archer to continue to use the target 120 without damaging or replacing the organ collection 190. In alternative embodiments, the target core 300 may be fabricated from other suitable materials. For example, the target core 300 may be molded from the target materials disclosed herein or other target materials that are known. It may also have the shape of various organs molded into it. It may be of one color or several colors. It may be retained with the body cavity 180 by cords, straps, pins, adhesive, etc.

Figure 7:
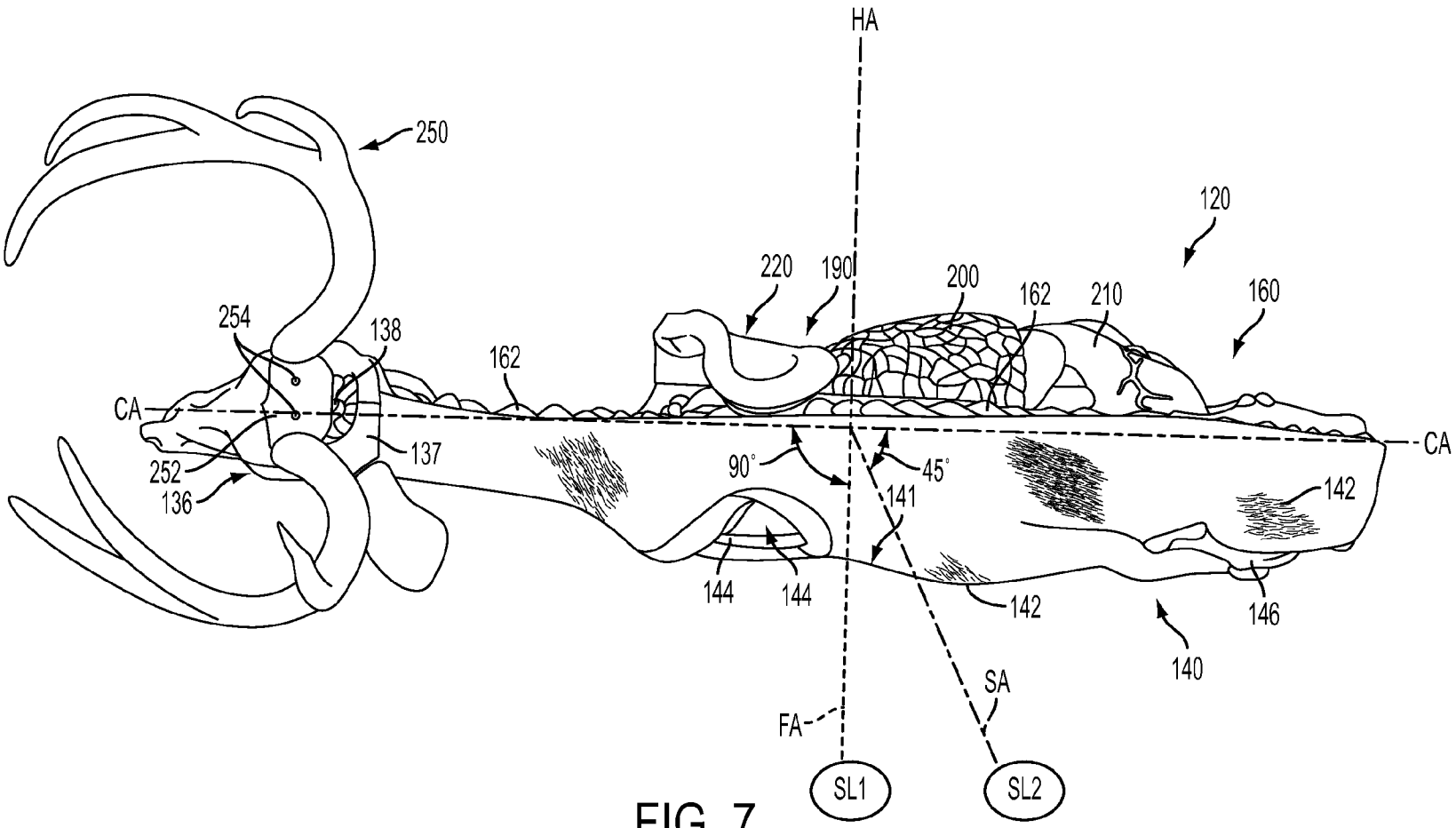
FIG. 7 is a top view of the archery target of FIG. 6.
Figure 12:
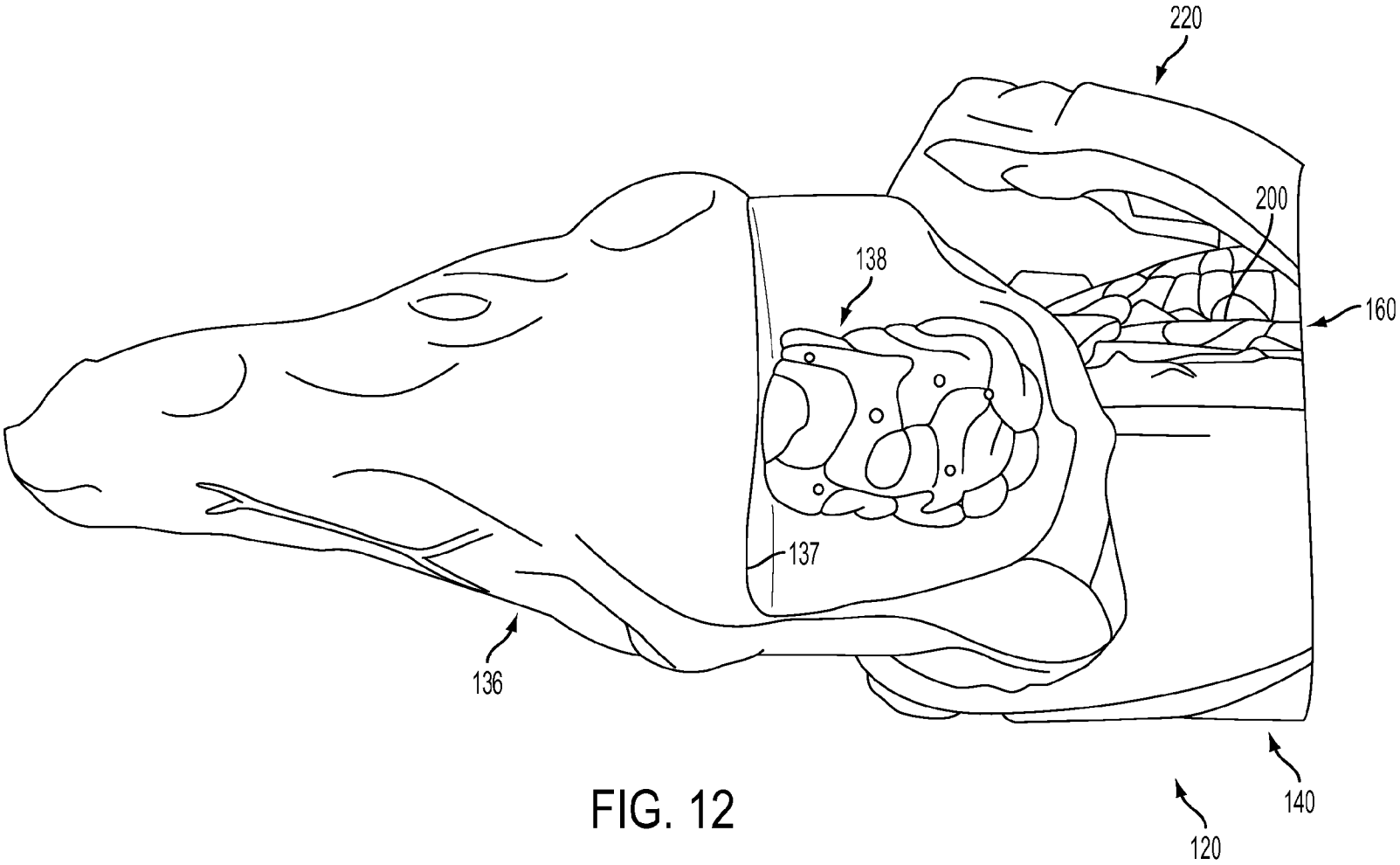
FIG. 12 is an enlarged top view of the head portion of one implementation of the archery target.

The target 120 may also be configured to enable the bowhunter to attach a real set of deer antlers 250 to the target 120. Referring now to FIG. 12, the head portion 136 of the target 120 may be formed with a ledge 137 that has a raised area 138 that may be molded, for example, to replicate the top of the animal's brain. The bowhunter may cut the portion 252 of the animal's skull that has the antlers 150 attached thereto. See e.g., FIGS. 10 and 11. The ledge area 137 is sized to receive that portion 252 of the animal's skull. The bowhunter may then attach the skull portion 252 to the head portion 136 of the target 120 by drilling holes through the skull portion 252 and attaching it to the target 120 with, for example, screws 254. See FIG. 7. Such arrangement serves to add even more realism to the target 120. In alternative embodiments, the antlers may be molded directly to the head portion 136. In still other embodiments, the antlers may be fabricated from rigid material such as rigid plastic or similar material and be detachably inserted into sockets formed in the head portion 136.

Those of ordinary skill in the art will appreciate that the aforementioned target arrangements represent vast improvements over prior target arrangements. The present target arrangements provide a vastly more accurate representation of the target animal and the target animal's organs and skeletal features when compared to prior target arrangements. For example, those prior target arrangements that simply have representations molded or otherwise formed into the side of a target do not offer the bowhunter with a means for accurately aiming so as to ensure that the arrow passes through an organ located within the body cavity. That is, shooting at a particular organ whose shape is formed on the perimeter of the target will not ensure that an arrow that strikes an animal at that point will actually pass through that organ located inside of the animal's body cavity. In addition, those prior target arrangements that have a bulls-eye or an area that corresponds to the vital organs of the animal printed or molded onto the target's perimeter does not provide an aiming spot that can be shot at from an elevated position that will ensure that the arrow will pass through the desired organ located within the body cavity.

Figure 13:
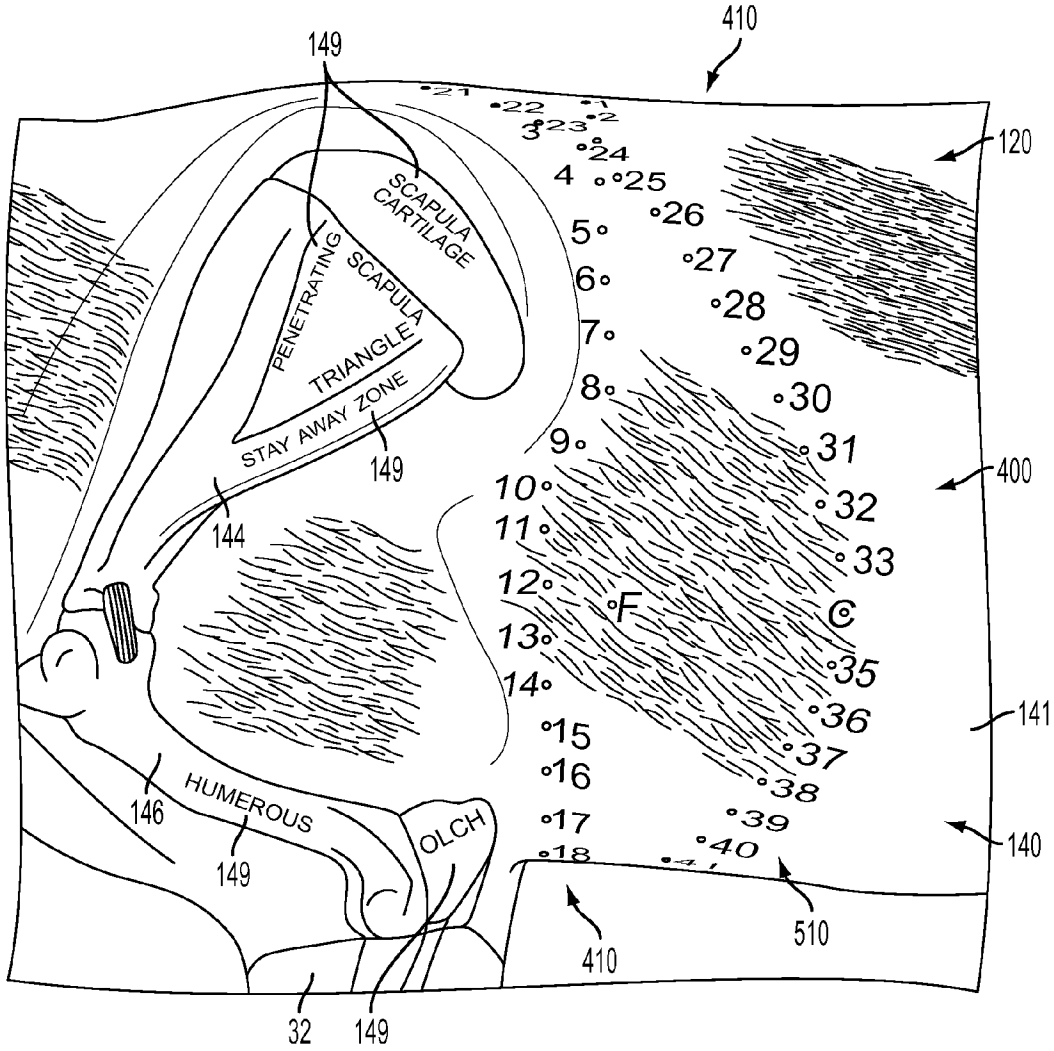
FIG. 13 is an enlarged view of a portion of a first side of one form of an archery target implementation of the present invention.

Referring now to FIG. 13, the target 120 may also be provided with a unique and novel aiming system 400 configured to teach a bowhunter where to actually aim on the target animal to hit a desired point located within the animal's body cavity, particularly when the bowhunter is shooting from an elevated shooting location or from a location that is below the animal. As used herein, the term "elevated shooting location" refers to a shooting location that is located above a particular aiming mark on the target. As can be seen in FIG. 13, for example, the first side 140 of the target 120 may be provided with a first series or line 410 of first aiming marks 1, 2, 3, 4, 5, 6, 7, 8, 9, 10, 11, 12, 13, 14, 15, 16, 17, 18. More specifically, the perimeter 141 of the first side of the target 120 may be provided with the first series 410 of aiming marks. Number 1 represents the top-most first aiming mark as can be seen in FIG. 13. In at least one implementation, the first series 410 of first aiming marks are molded into the perimeter 141. In other implementations, the first aiming marks may be printed or painted onto the perimeter 141. In still other applications, the first aiming marks may be printed on a medium such as a piece of tape, paper, Mylar®, etc. that may be attached to the perimeter 141 as will be discussed in further detail below.

As can be seen in FIG. 13, the first series 410 of first aiming marks may comprise a plurality of first aiming marks 1, 2, 3, 4, 5, 6, 7, 8, 9, 10, 11, 12, 13, 14, 15, 16, 17, 18 wherein each first aiming mark corresponds to a shooting location that is located at a particular height "H" above the first aiming mark and a particular horizontal distance "X" from the shooting location to the first aiming mark. See FIG. 1. FIGS. 14-20 comprise a series of charts that indicate which first aiming mark a bowhunter or archer should be aiming at depending upon the height that the shooting location is above the target 120 and the horizontal distance between the shooting location and the target 120. An arrow passing through a particular aiming mark that is shot from the corresponding shooting location set forth on the appropriate chart will ensure that the arrow passes through a desired "center kill zone" also referred to herein as a "target location" located within the target interior. For example, the "target location" may comprise a point or an area that corresponds to the geometric middle of the heart/lung and liver collection which would result in a fatal hit in a live animal. Such target location affords the bowhunter with the "largest effective target area" or, stated another way, affords the bowhunter with the largest margin for error while being reasonably sure that an arrow passing through that area will be fatal.

The present charts provide the bowhunter with height references "H" that refer to the height that the treestand platform 111 is above the ground 114. See FIG. 1. The horizontal distance that the shooting location (e.g., the position of the bow from which the arrow will be released) is from a particular aiming point is set forth as distance "X" on the charts. For calculation purposes, the true height HT" includes the treestand platform height "H" plus the height above the treestand platform 111 from which the arrow is launched "HB" less the distance above the ground that the aiming point is located "HA". Thus, HT=H+HB−HA. The locations of the aiming marks on the perimeter 141 of the first side 140 of the target 120 may be located using the true height calculations plus the horizontal distances "X". For the series of charts in FIGS. 14-27, the height that the bow is held above the treestand platform "HB" was based on the bow shooting position normally used by a hunter who is 5'-10" tall. Of course, these calculations could be conformed to a particular bowhunter and even more particularly to bow positions of bowhunters with other heights.

Figure 28:
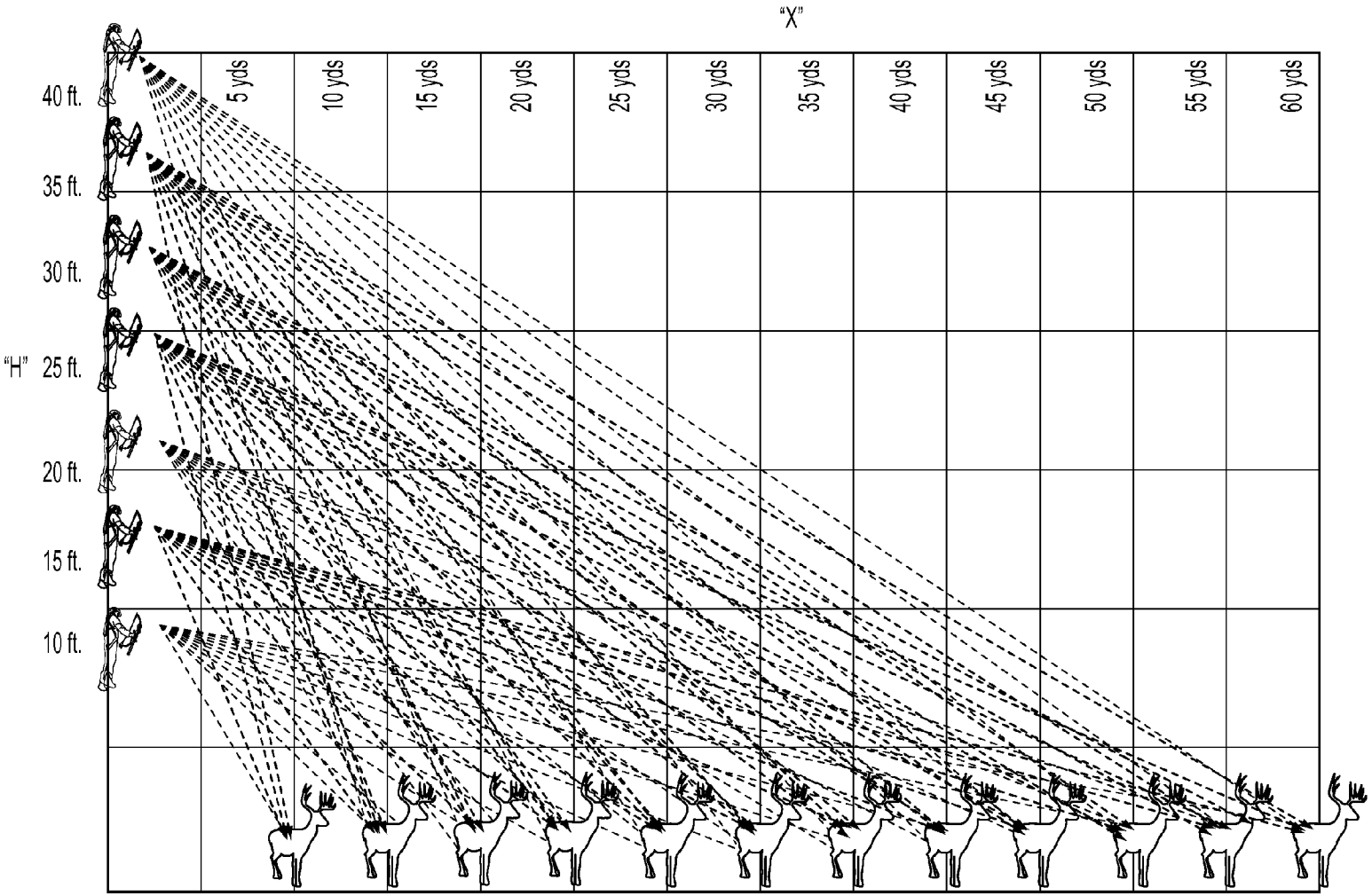
FIG. 28 is a graph comparing treestand platform height "H" to the horizontal distance "X" of a target from the base of the tree holding the platform and illustrating various shot angles for each location.
Figure 29:
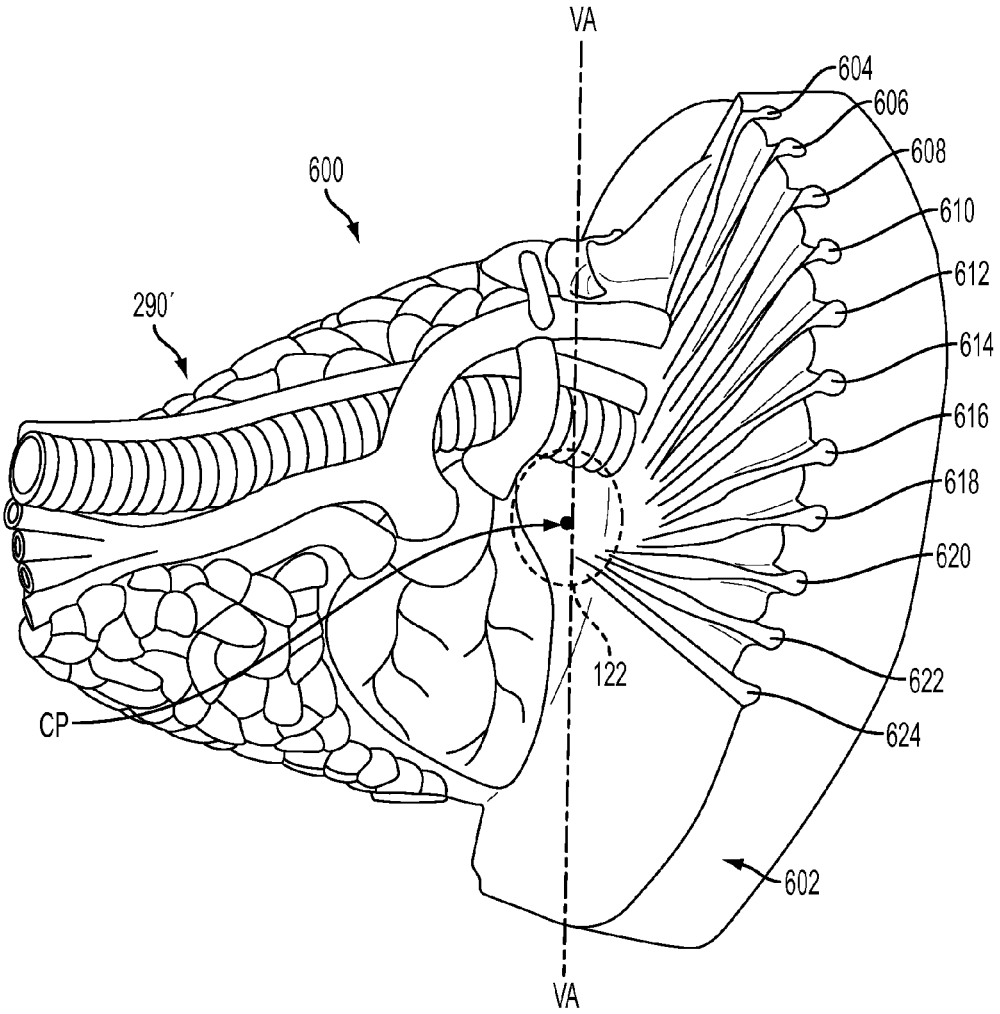
FIG. 29 is a side view of a model used to illustrate arrow paths and aiming marks relative to the collection of organs and the center kill zone referred to herein as the internal target location.
Figure 30:
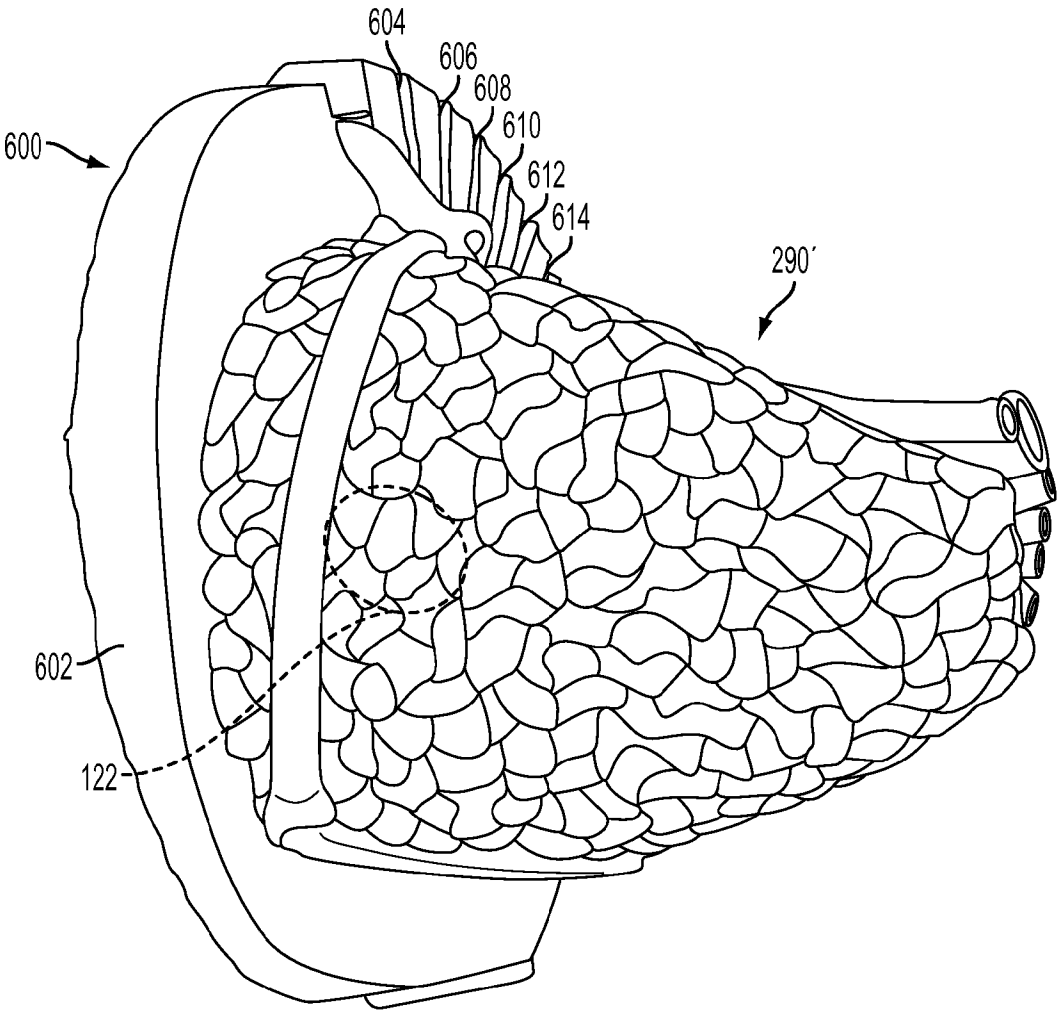
FIG. 30 is an opposite side view of the model of FIG. 29.

FIG. 28 comprises a graph that illustrates the various shooting angles for arrows shot from treestand platform heights "H" ranging from 10 feet to 40 feet above the ground and located at horizontal distances "X" from the target 120 ranging from 5 yards to 60 yards. The charts depicted in FIGS. 14-20 are for use when the target 120 is located broadside to the shooting location. For example, referring to FIG. 7, the first shooting location "SL1" is located along an imaginary first axis "FA" that it ninety degrees from the center axis CA-CA of the animal or target 120. The first shooting location SL1 would represent a location from which a "broadside shot" would be taken. The second shooting location "SL2" is located along a second imaginary axis "SA" that is located at a forty-five degree angle from the center axis CA-CA. The second shooting location SL2 would represent a location from which a "quartering away shot" would be taken. Each chart also sets forth the "# on the body" which represents the particular aiming point for a corresponding treestand platform height "H" and horizontal distance "X". While only two shooting locations have been illustrated, those of ordinary skill in the art will recognize that additional shooting locations may be employed at different angles relative to the target. For example, a third shooting location located along an axis that is sixty degrees relative to the center axis CA-CA may be employed.

The first set 410 of the first aiming marks 1, 2, 3, 4, 5, 6, 7, 8, 9, 10, 11, 12, 13, 14, 15, 16, 17, 18 correspond to first shooting locations "SL1" that are located broadside to the target 120. As can be seen in FIG. 13, the first set 410 of first aiming marks 1, 2, 3, 4, 5, 6, 7, 8, 9, 10, 11, 12, 13, 14, 15, 16, 17, 18 jog around the scapula areas 144, 150. When aiming at a live animal, a bowhunter wants to avoid hitting the scapula areas 144, 150 which could cause the arrow to deflect and adversely effect the arrow's penetration into the animal's body cavity. As can be further seen in that Figure, the first set 410 of aiming marks comprise a series of numbered dots 1, 2, 3, 4, 5, 6, 7, 8, 9, 10, 11, 12, 13, 14, 15, 16, 17, 18 that correspond to the "# on the body column" in the chart. Those of ordinary skill in the art will recognize that the dots or marks 1, 2, 3, 4, 5, 6, 7, 8, 9, 10, 11, 12, 13, 14, 15, 16, 17, 18 go to the bottom portion of the first side 140 of the target 120. A bowhunter shooting at the target 120 from ground level would likely aim at any one of the first aiming marks located between the first aiming marks 10 and 15, for example, to ensure that the arrow would strike a vital organ (e.g., the heart and/or lungs) of the animal. While the target 120 does include first aiming marks located below the first aiming mark labeled 15 (i.e., first aiming marks 16, 17, 18), those aiming marks might be used by a bowhunter who was actually located at a first shooting location "SL1" that was located below the target 120. Stated even more succinctly, the first shooting location SL1 would be below the level of the first aiming marks 16, 17, 18 (whichever the case may be). For example, those first aiming marks might be employed when the bowhunter was located down hill from the target 120. Although the charts of FIGS. 14-20 do not provide horizontal distance, height and angle calculations for those lower first aiming marks 16, 17, 18, similar chart figures may be determined and provided using the same techniques employed to develop the charts in FIGS. 14-27.

By way of example, referring to the chart depicted in FIG. 16, that chart would be used when the treestand platform height "H" was 20 feet above the ground 114. The target 120 may, for example, be located at a distance "X" of 25 yards from the shooting location. In this particular example, the target 120 would be positioned relative to the shooting location SL1 for a broadside shot. That is, the arrow would travel along an imaginary first axis "FA" that is essentially perpendicular to the center axis CA-CA of the animal or target 120. The bowhunter would then see from the chart in FIG. 16 that he or she should be aiming at the first aiming mark labeled 10 and that the entry or shooting angle "A" of the arrow to the first aiming mark 10 was seventeen degrees. An arrow shot from that shooting location SL1 and passing through the first aiming mark labeled 10 will also pass through the target location 122 located within the interior of the target 120.

The target 120 may also be provided with a second series 510 of second aiming marks 21-41 which are to be used when the target 120 is positioned to "quarter away from" the shooting location (e.g., shooting location "SL2"). The charts of FIGS. 21-27 are designed to be used for such shooting locations "SL2". By way of example, referring to the chart depicted in FIG. 22, that chart would be used when the treestand platform height "H" was 15 feet above the ground 114. The target 120 may, for example, be located at a distance "X" of 30 yards from the shooting location. In this particular example, the target 120 would be positioned relative to the shooting location SL2 for a "quartering away" shot. That is, the arrow would travel along an imaginary second axis "SA" that is essentially located at a forty-five degree angle relative to the center axis CA-CA. See FIG. 7. The bowhunter would then see from the chart in FIG. 23 that he or she should be aiming at the second aiming mark labeled 32 and that entry or shooting angle "A" of the arrow to the second aiming mark 32 was eleven degrees. An arrow shot from that shooting location SL2 and passing through the second aiming mark labeled 32 will also pass through the target location 122 located within the interior of the target 120. The numbers on the chart that include "0.5" indicate that the correct aiming spot is halfway between that number and the next larger number. That is 32.5 means that the correct aiming spot is halfway between 32 and 33.

Figure 31:
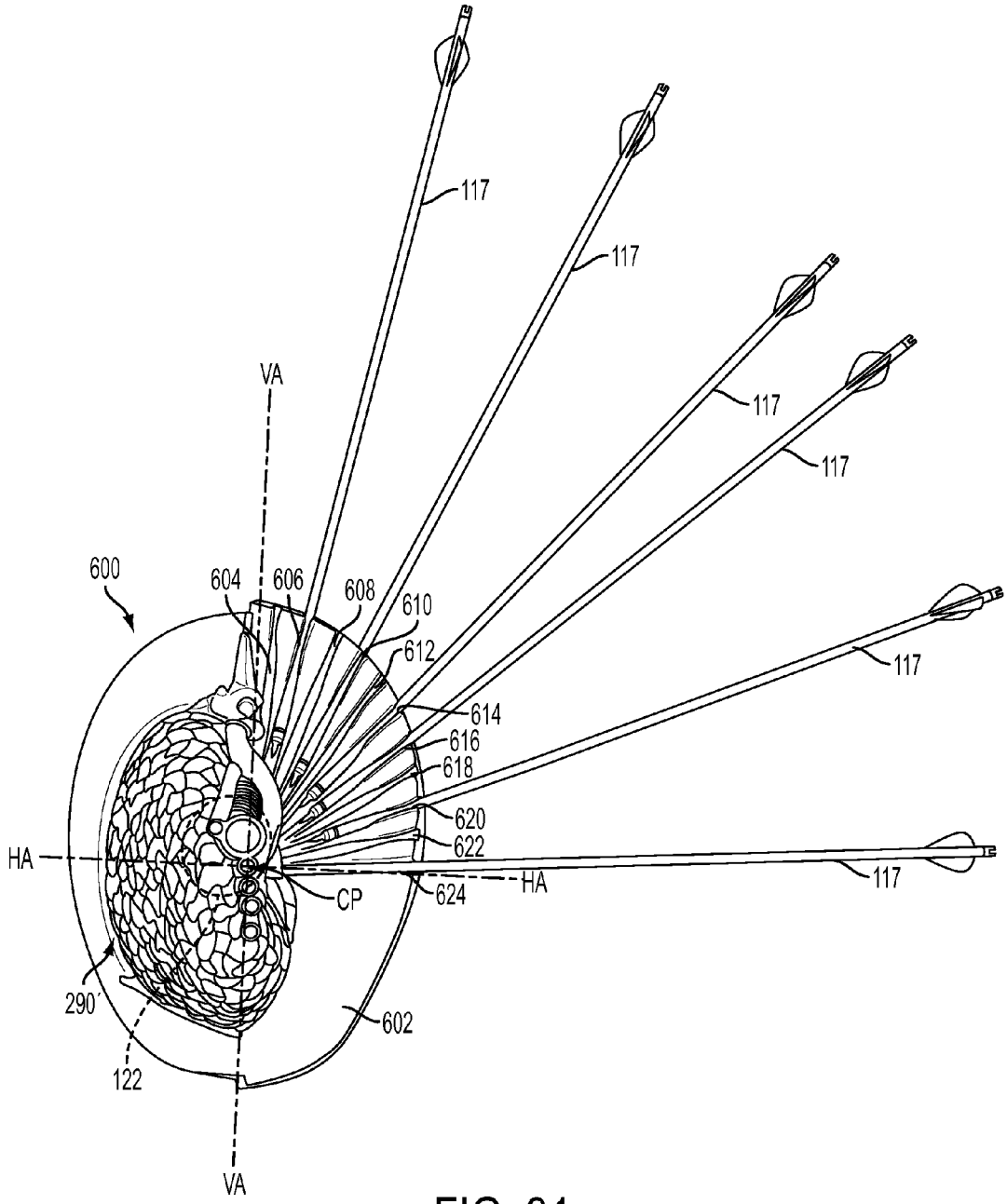
FIG. 31 is a front view of the model of FIGS. 29 and 30 with arrows inserted into some of the paths.
Figure 32:
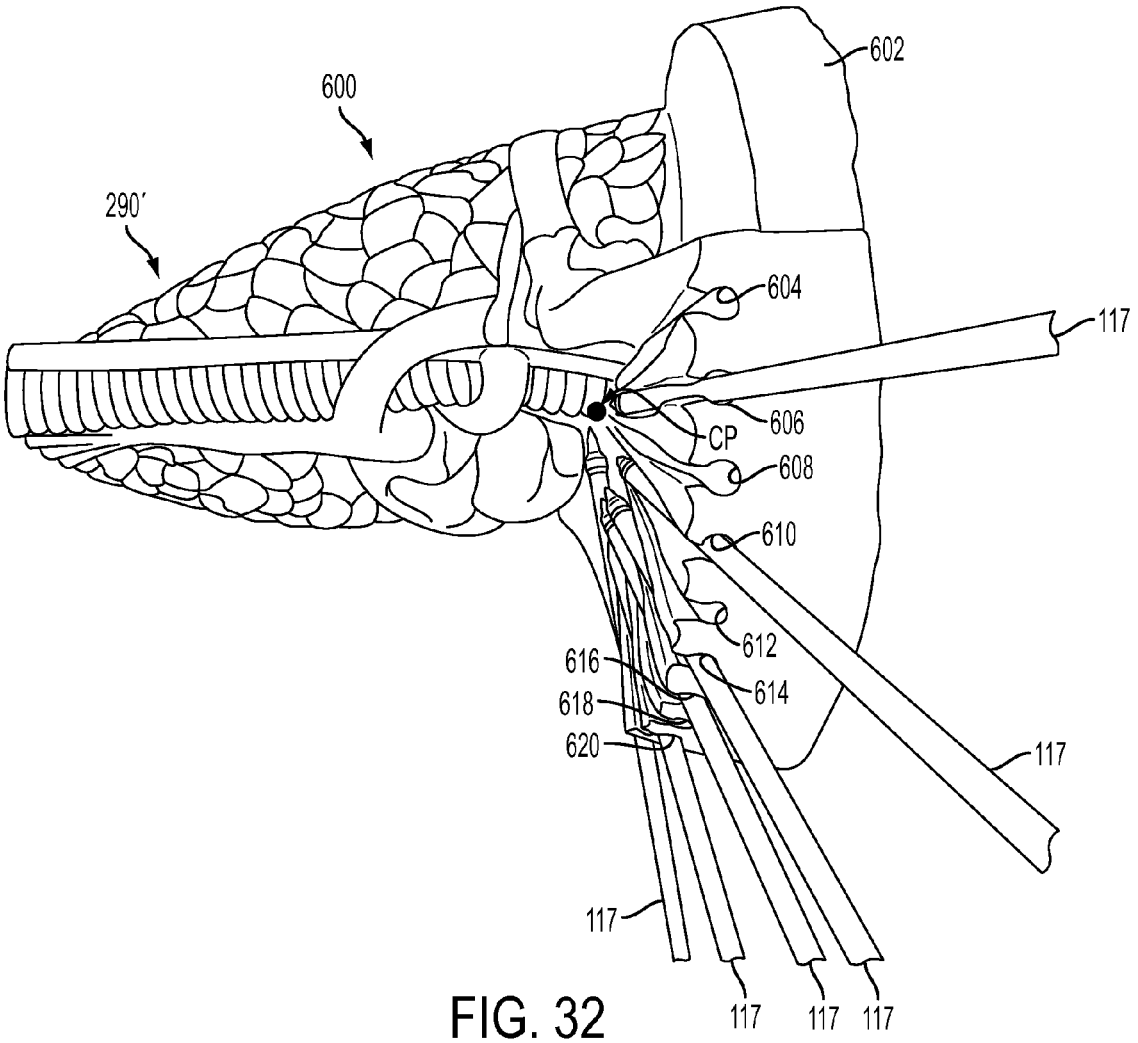
FIG. 32 is a top view of the model of FIGS. 29-31 with arrows inserted into some of the paths.

In effort to further explain this unique and novel target system, FIGS. 29-32 illustrate a model 600 that accurately represents an organ collection 290' of a whitetail buck, for example. The model 600 includes a flange portion 602 that has a series of passages 604, 606, 608, 610, 612, 614, 616, 618, 620, 622, 624 formed therein. Each passage may correspond to a first aiming mark. For example, passage 604 may correspond to first aiming mark 1. Passage 606 may correspond to first aiming mark 2. Passage 608 may correspond to first aiming mark 3. Passage 610 may correspond to first aiming mark 4. Passage 612 may correspond to first aiming mark 5. Passage 614 may correspond to first aiming mark 6. Passage 616 may correspond to first aiming mark 7. Passage 618 may correspond to first aiming mark 8. Passage 620 may correspond to first aiming mark 9. Passage 622 may correspond to first aiming mark 10. Passage 624 may correspond to first aiming mark 11. FIGS. 31 and 32 illustrate arrows 117 inserted into some of the passageways 604, 606, 608, 610, 612, 614, 616, 618, 620, 622, 624 to demonstrate how those arrows 117 will pass through the target location 122 that is located in the center of the organ collection 290'. Thus, any one of those arrows 117 that are shot into the target 120 such that it will pass through those corresponding first aiming marks 1, 2, 3, 4, 5, 6, 7, 8, 9, 10, 11 will be assured to also pass through the target location 122.

The target location 122 in this example is located "center mass" of the organ collection 290'. Conventional wisdom suggests that an arrow that passes through or at least into both lungs, or through at least one lung and into or through the heart or into or through the heart and/or through the liver will result in a quick kill of the animal. The target location 122 is selected with this mind. The target location 122 is located along a vertical axis VA-VA that extends through the center axis CA-CA of the animal or target. See e.g., FIGS. 7 and 8. A horizontal axis HA-HA is selected to extend laterally through the animal such that the axis HA-HA is adjacent to or passes through a portion of the heart 192. See e.g., FIGS. 5, 6 and 8. The point where the vertical axis VA-VA and the horizontal axis HA-HA intersect is the center point "CP" of the target location 122. Any arrow passing through that target location in a corresponding live deer will be assured, for example, to pass through or enter at least both of the lungs, one lung and the heart, or the heart and/or the liver which should lead to a quick humane harvest of the representative animal. Such target location affords the bowhunter with the largest margin of error in that an arrow passing through the target location should be reasonably assured to result in a fatal hit in a corresponding live animal.

Figure 2:
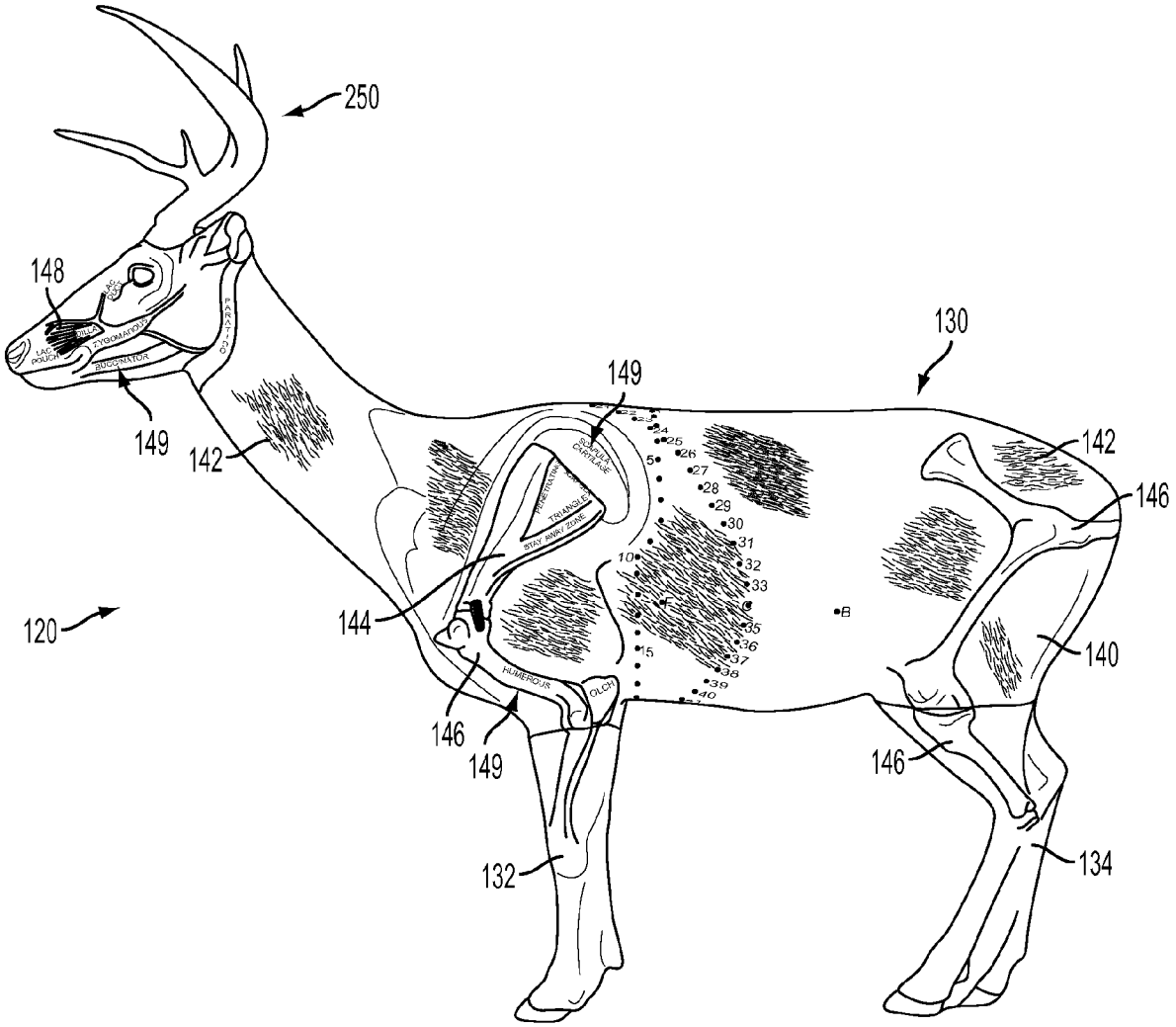
FIG. 2 is a side elevational view of a first side of one form of an archery target embodiment of the present invention.
Figure 33:
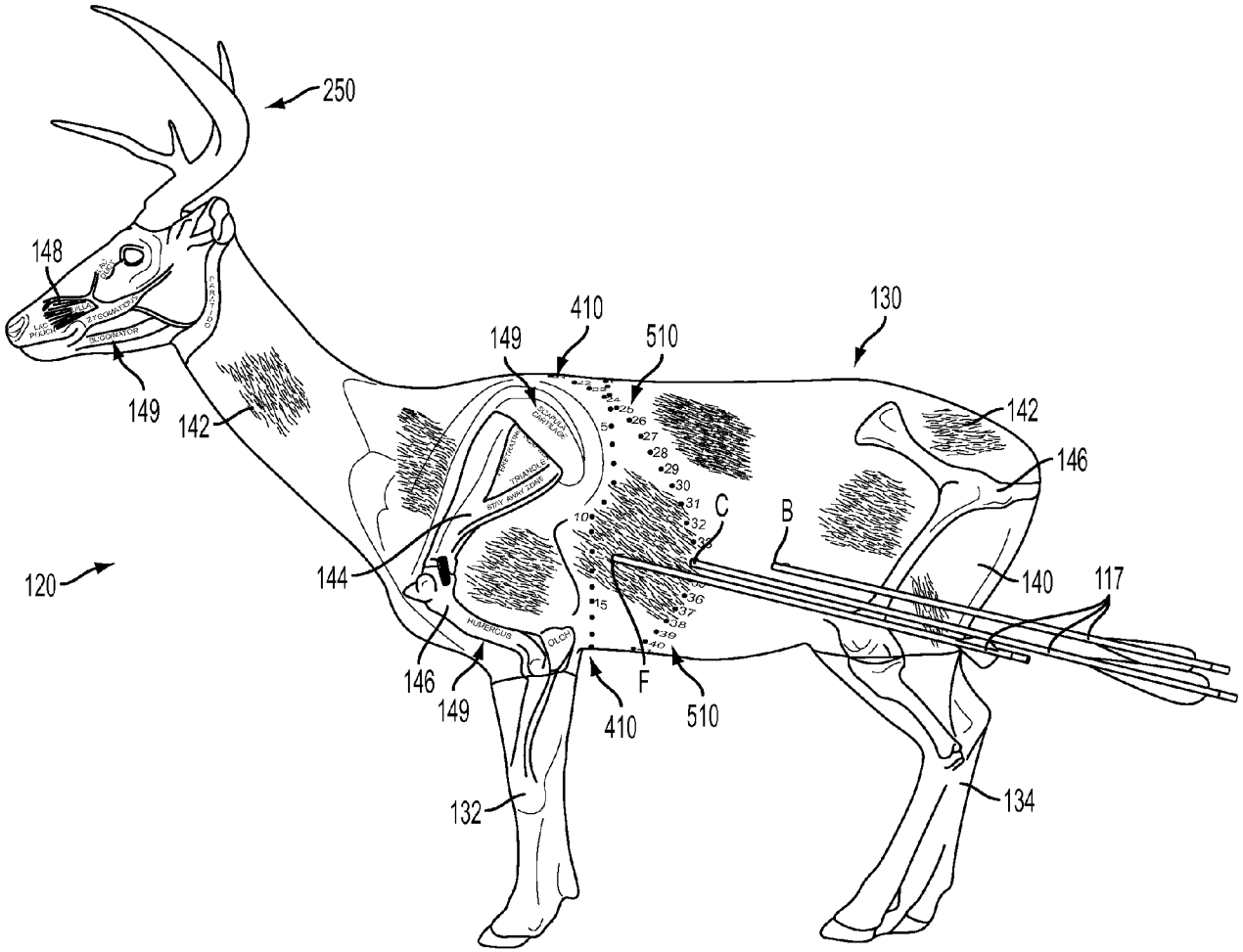
FIG. 33 is a side elevational view of an archery target implementation of the present invention with arrows entering the forward ("F"), center ("C") and back ("B") marks on the first side of the target.

As can also be seen in FIGS. 2, 13 and 33, the first side 140 of the target 120 may also be provided with a forward aiming mark "F", a center aiming mark "C" and a back aiming mark "B". Those marks represent the aiming marks that a bowhunter may aim at when the target is quartering away from the bowhunter at a 45 degree angle and when the bowhunter is located on the same level as the target 120. The forward aiming mark "F" represents a forward-most point at which an arrow 117 may enter the body cavity at a 45 degree angle and be assured to pass through the target location 122 and be reasonably assured to create a fatal hit. The center mark "C" represents the point at which an arrow 117 may enter the body cavity at a 45 degree angle and be assured to pass through the target location 122 located within the interior of the target 120 and create a fatal hit. The back aiming mark "B" represents a rear-most point at which an arrow 117 may enter the body cavity at a 60 degree angle and be assured to pass through the target location 122 so as to be reasonably assured to create a fatal hit. See FIG. 33.

Figure 8:
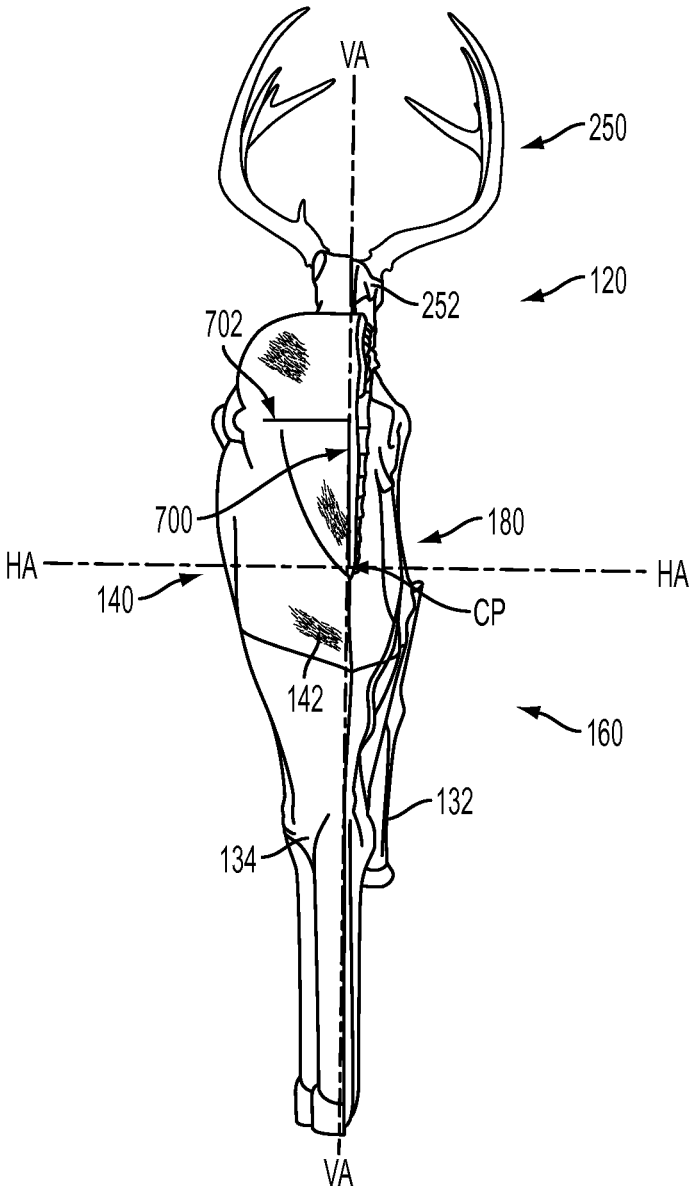
FIG. 8 is a rear elevational view of the archery target of FIG. 3.

The target 120 may also be provided with a plumb mark 700 and leveling mark 102 for ensuring that the target 120, when mounted on a surface such as the ground 114 or other surface is vertically oriented relative to the shooting location. Referring to FIG. 8, for example, the plumb mark 700 and the level mark 702 may be provided on the portion of the target 120 as shown. The user may then place a carpenter's level or other leveling device on the plumb mark 700 and or leveling mark 702 to adjust the position of the target 120 until it is plumb. That is the vertical axis VA-VA passing through the target location 122 is plumb.

Figure 34:
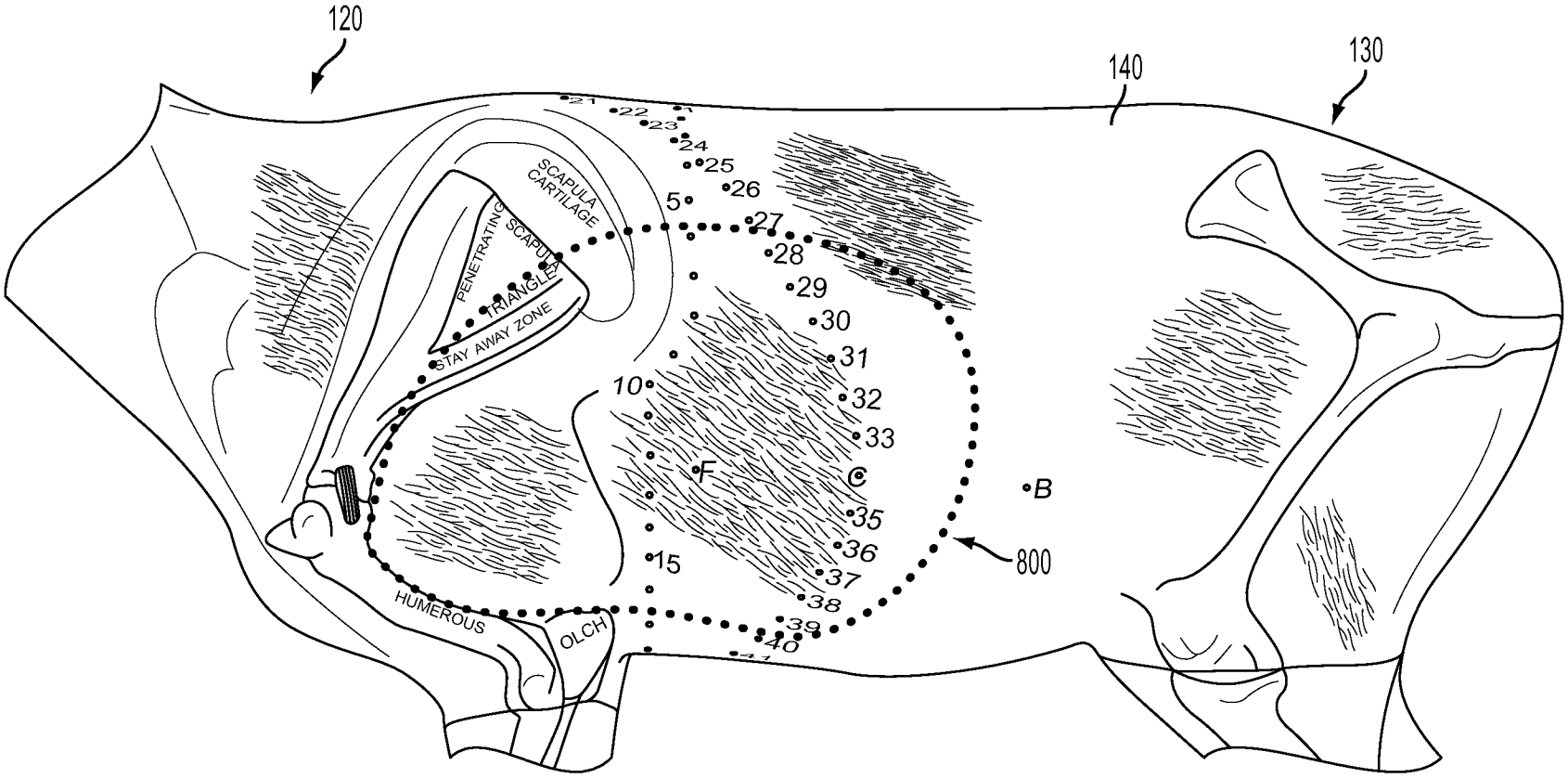
FIG. 34 is a partial side elevational view of a first side of an another archery target implementation of the present invention.
Figure 35:
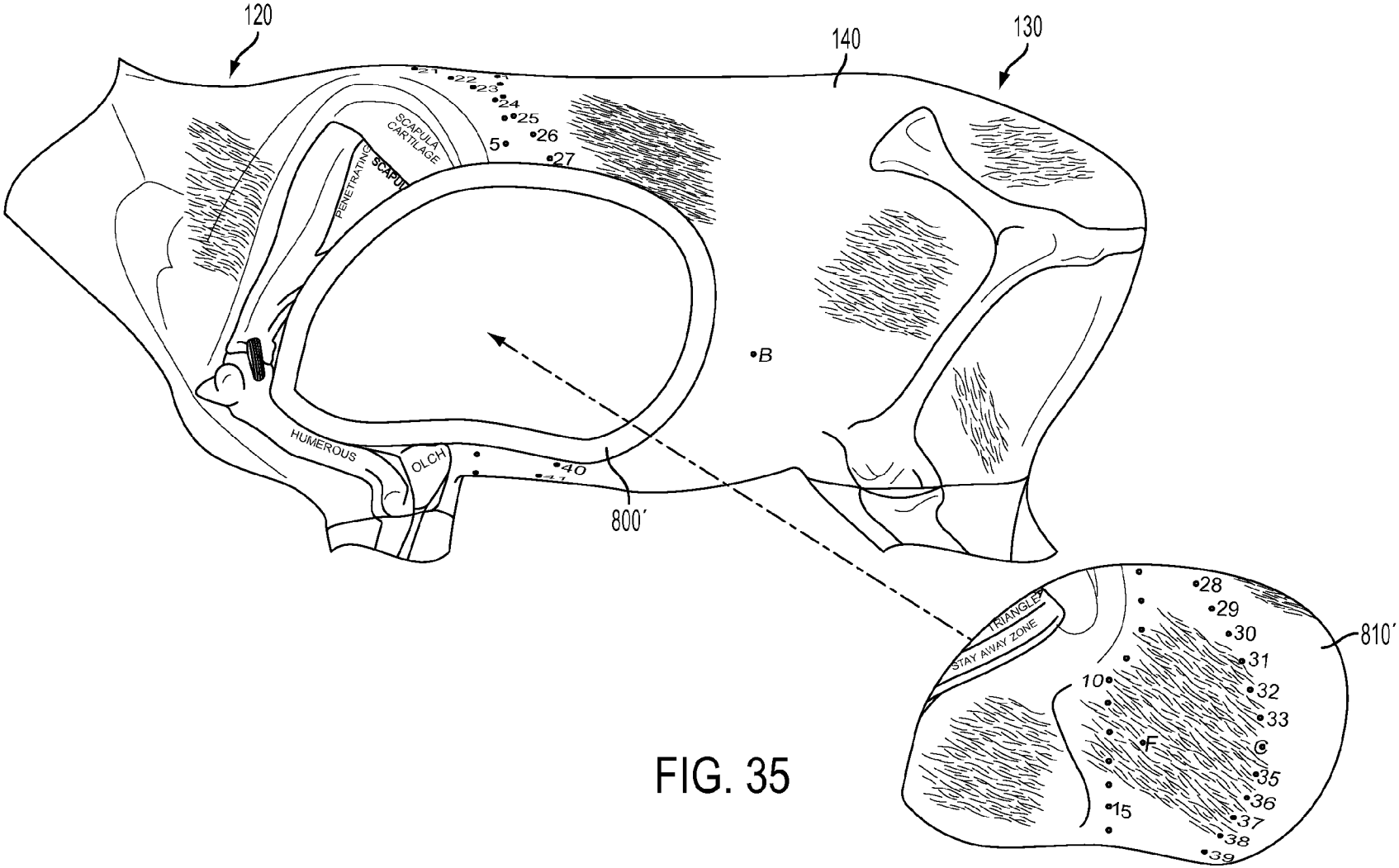
FIG. 35 is an exploded side elevational view of the archery target implementation of FIG. 34 illustrating the insertion of a replacement core into the target.
Figure 36:
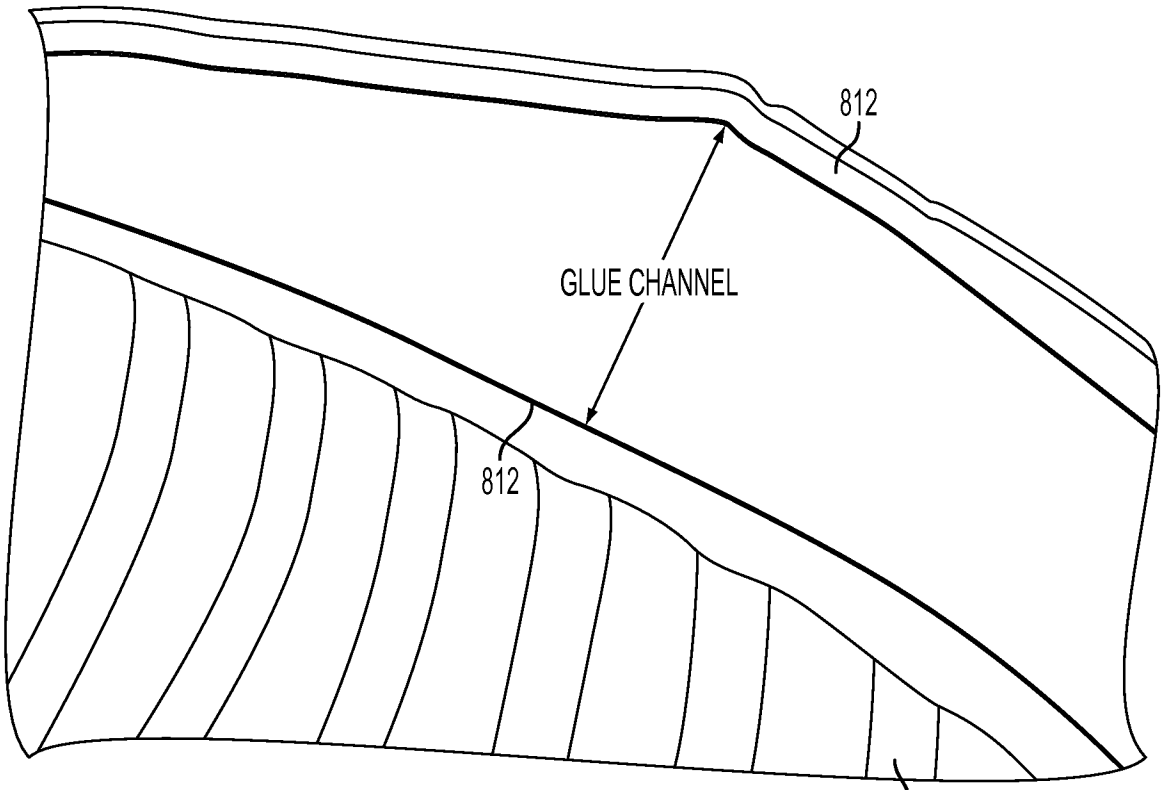
FIG. 36 is a partial perspective view of the replacement core shown in FIG. 35 illustrating glue channels therein.
Figure 37:
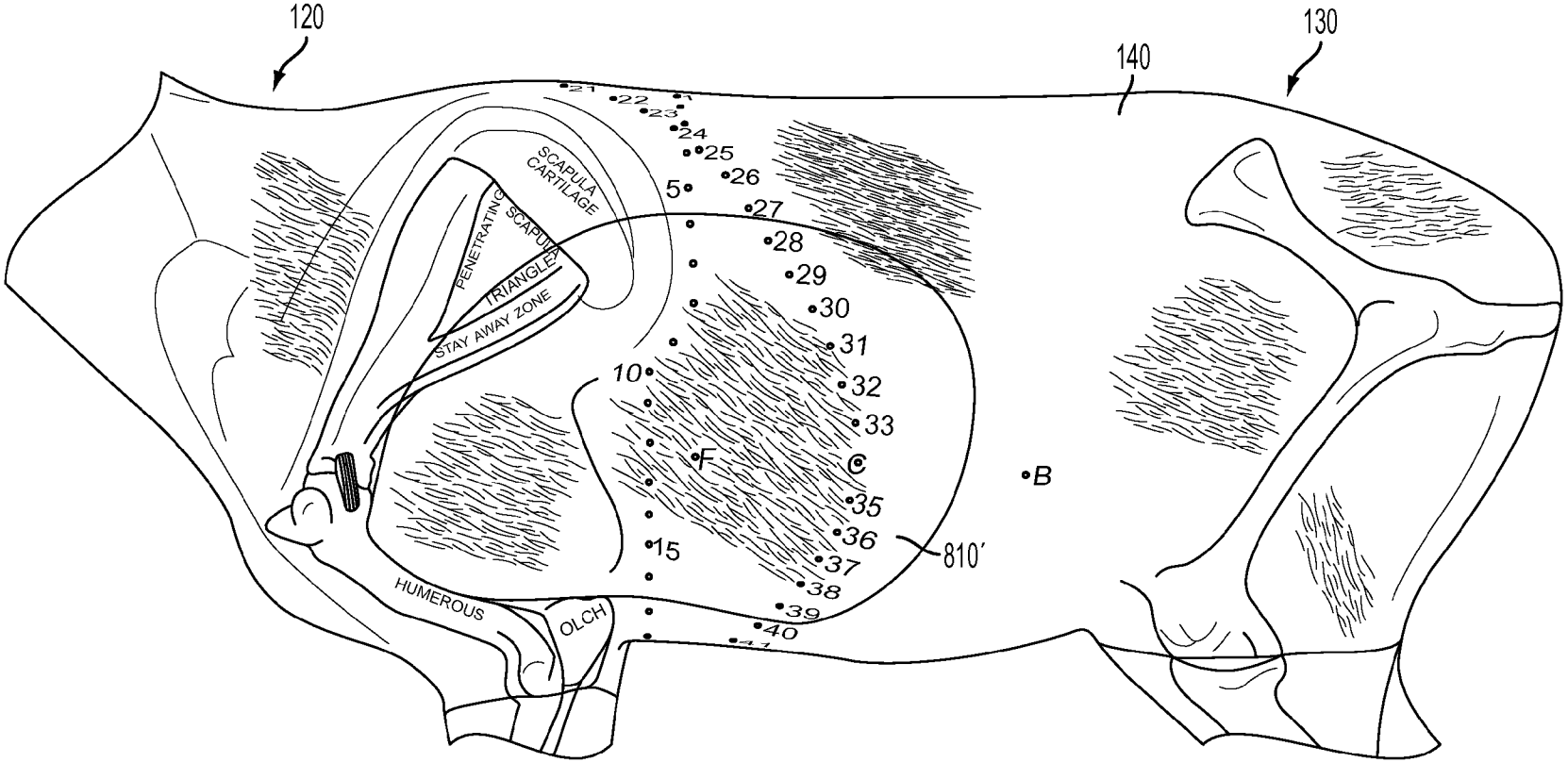
FIG. 37 is another partial side elevational view of the archery target implementation of FIGS. 35 and 36 with the replacement core installed therein.
Figure 38:
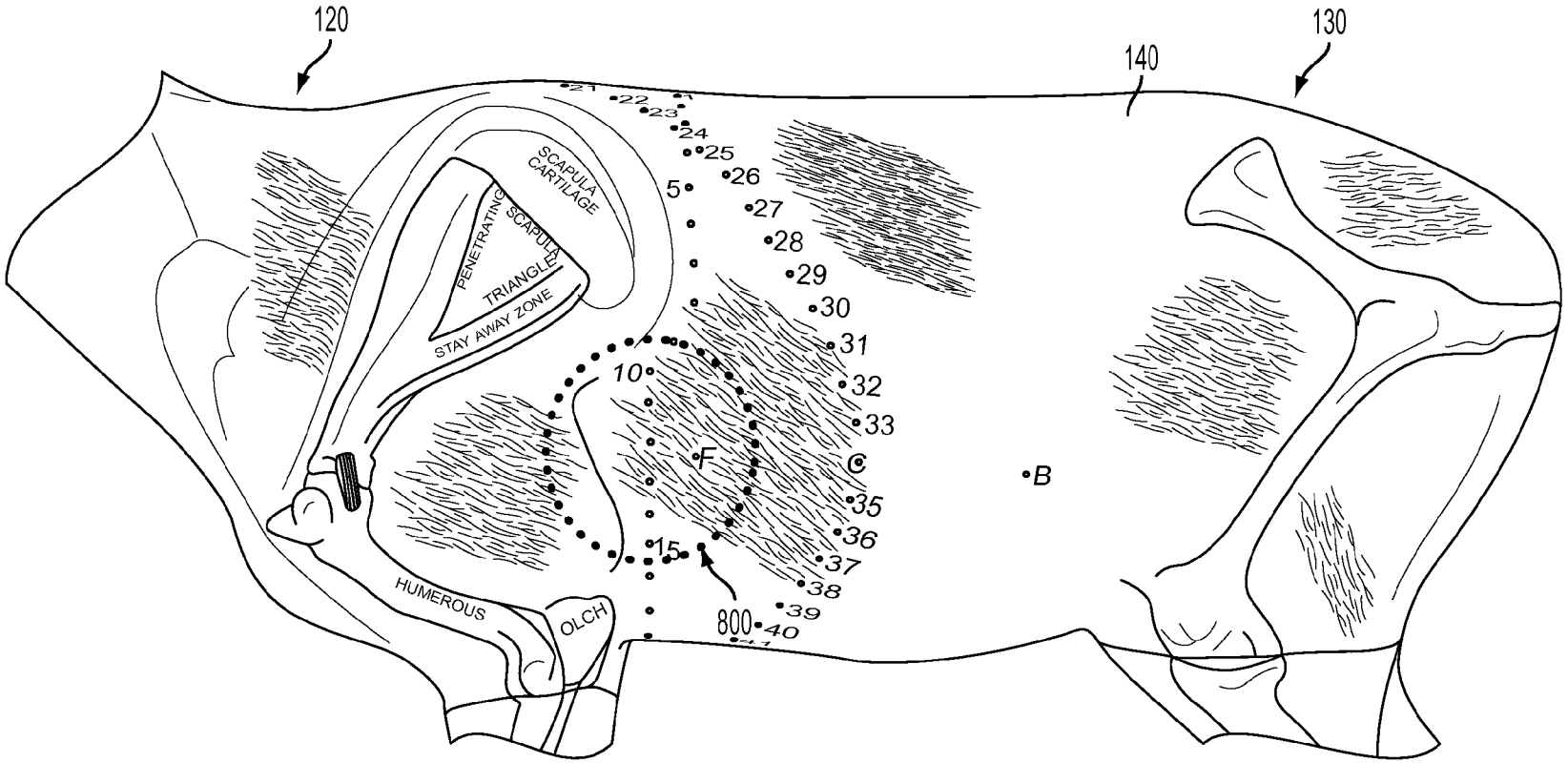
FIG. 38 is a side elevational view of a portion of another archery target implementation of the present invention.
Figure 39:
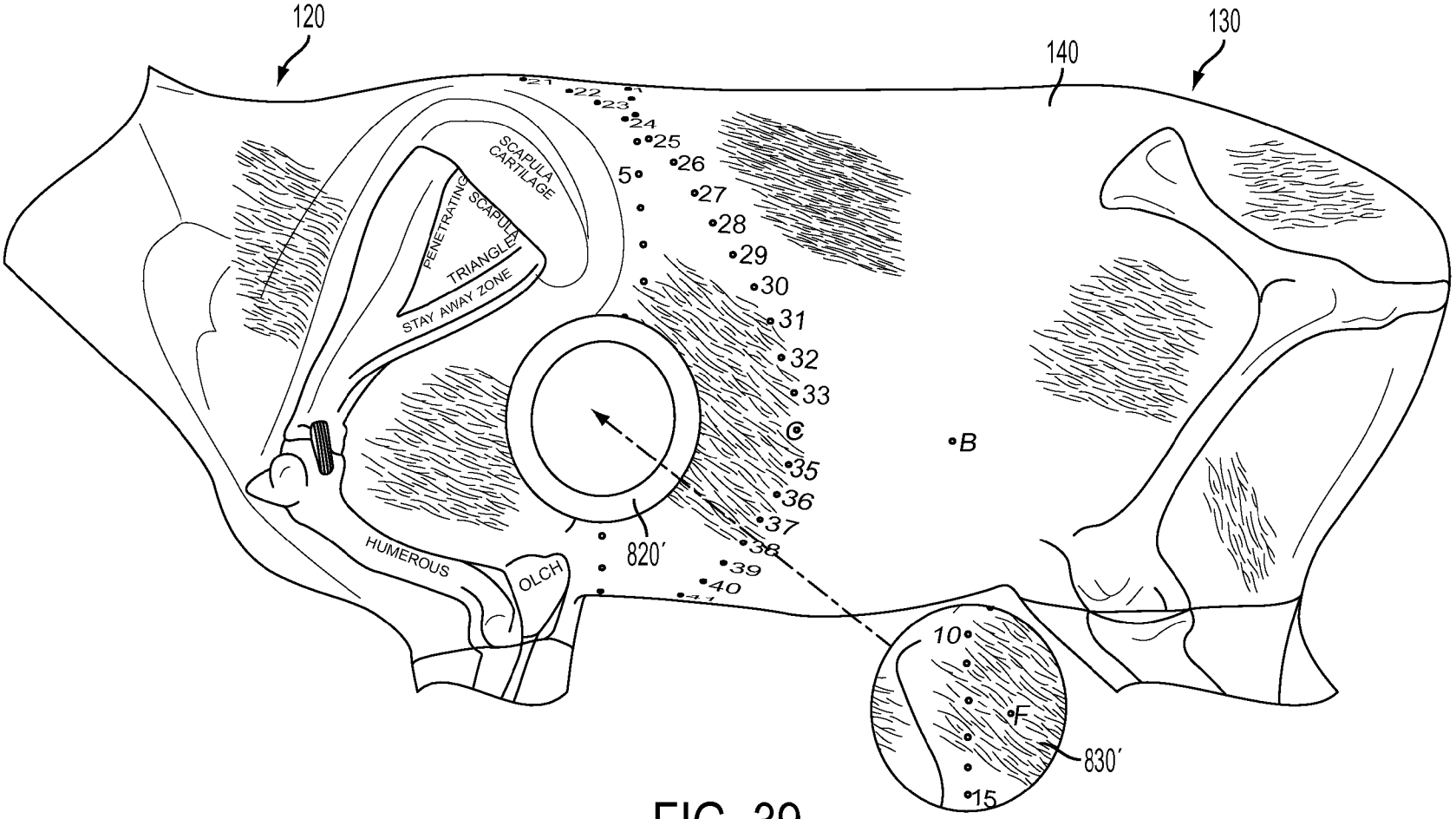
FIG. 39 is an exploded side elevation view of the archery target implementation of FIG. 38 illustrating the insertion of a replacement core into the target.
Figure 40:
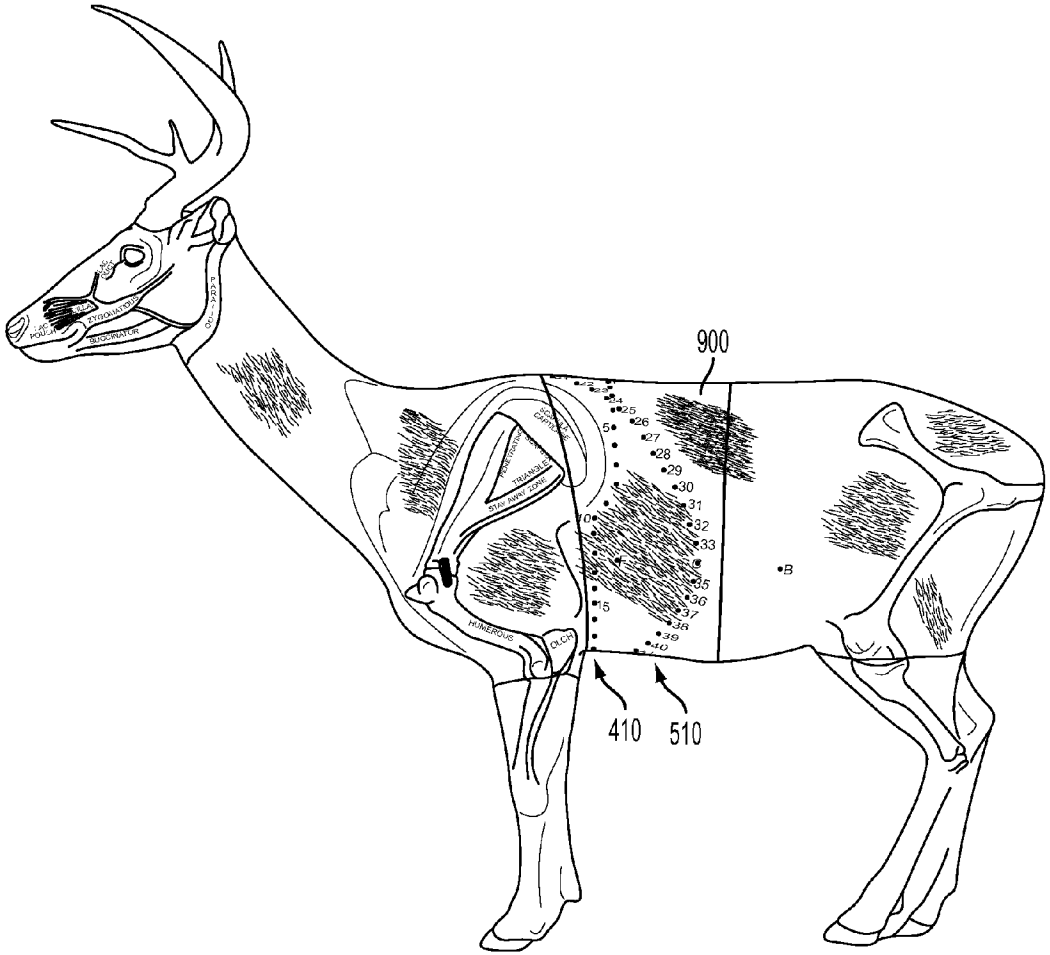
FIG. 40 is a side elevational view of an archery target implementation of the present invention.
Figure 41:
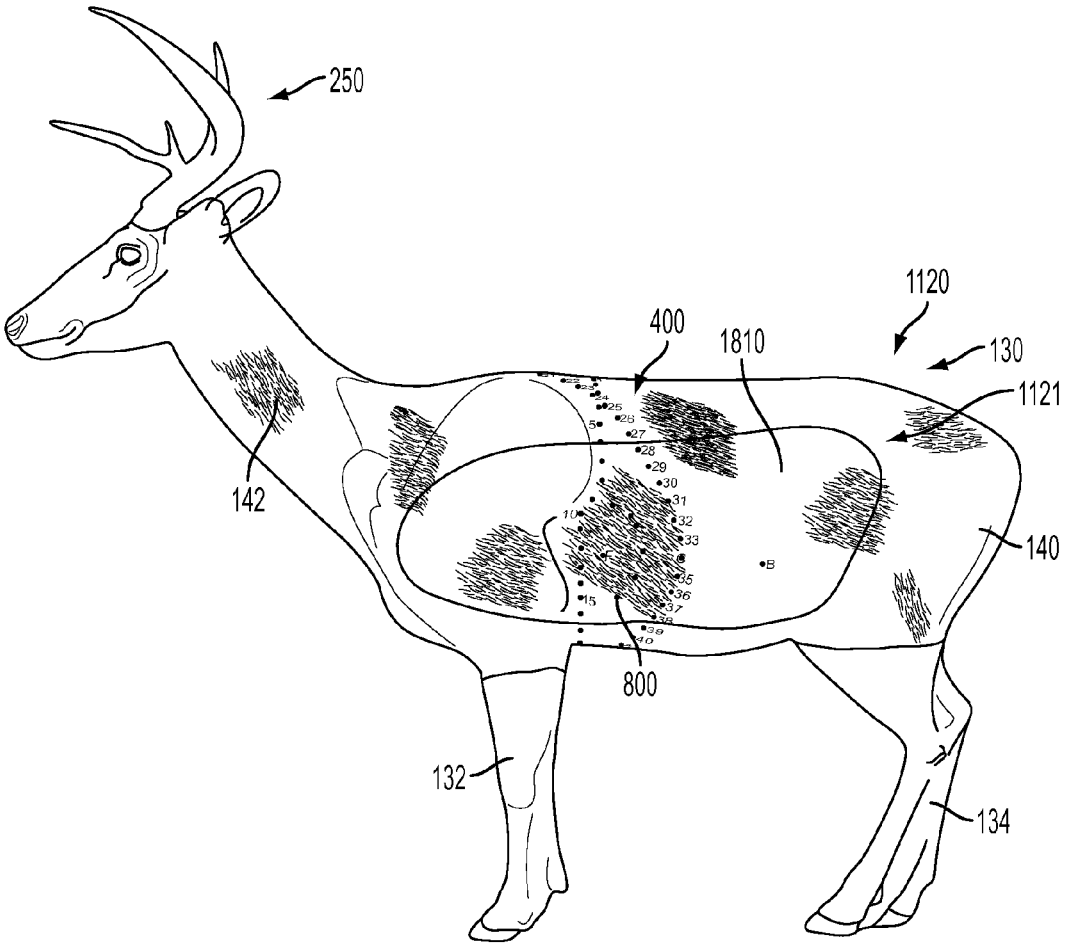
FIG. 41 is a first side elevational view of another archery target implementation of the present invention.

Another implementation of target 120 is illustrated in FIG. 34. As can be seen in that Figure, the first side 140 of the target has a series of detents or marks 800 formed or otherwise provided on the perimeter 141 that may correspond generally to the size of the left lung assembly 194 and/or right lung assembly 200 or at least a portion of the organ collection 190. This is a portion of the target 120 that will likely get shot out or deteriorate first from repeated passage of arrows therethrough. Once that portion of the target 120 has been shot out, the user may cut through the first side 140 of the target using a knife, saw or other suitable utensil along the marks 800 to remove that section of target 810 therefrom. The user may then replace that portion of the target 120 with a replacement section or replacement core 810' of the same size. The replacement core 810 may be provided with glue channels 812 around at least portions of its perimeter for receiving a suitable adhesive or glue therein. See FIG. 36. For example, that commercially available adhesive sold under the trademark Gorilla Glue™ may be employed. However, other suitable adhesives may also be employed. The user simply applies the adhesive in the glue channels 812 around the perimeter of the replacement core 810' and then inserts the replacement core into the cavity 800' that was created in the target 120 as shown in FIGS. 35 and 37. Once the adhesive sets, the user can once again shoot the target 120 as described herein. In alternative arrangements, the replacement core 810' may be retained with the target 120 by mechanical fasteners such as pins 240 or by other suitable fastener arrangements. FIGS. 38 and 39 illustrate an alternative sized core arrangement. As can be seen in FIG. 39, for example, the detents 800 form a smaller circular "bulls-eye-type" area that corresponds to the center of the organ collection 190 and target location 122 also referred to as the center kill zone therein. The user simply cuts along the detents 800 to remove the damaged section. The user then places the adhesive in the glue channels (not shown) in the replacement core 830' and then inserts it into the opening 820' as described above. In yet another alternative embodiment, the replacement core 810' may also include a replacement core 830' therein. Thus, in such an arrangement, there is a replacement core within a replacement core. Various implementations are contemplated. One embodiment may only contain portions of the aiming system or just include the replacement core arrangements described above or some combination of the core and aiming system.

In various implementations, the target 120 may be provided as a kit along with the collection of charts described above. When a bowhunter purchases the kit, he or she may set up the target relative to a treestand and then practice shooting arrows at the target from various distances and from various treestand platform heights.

A variety of other three-dimensional animal archery targets exist, but they lack the unique and novel aiming systems of the present invention. To address this need, another implementation of the present invention comprises an aiming strip 900 that has a collection of first aiming marks 410 and/or the collection of second aiming marks 510 thereon. The aiming strip 900 may comprise, for example, adhesive tape and have the markings printed thereon. In alternative arrangements, the aiming strip 90 may comprise a Mylar® material with the markings thereon that may be attached to a side of an existing animal target. The Mylar® strip may be attached to the target with pins, adhesive, etc. The locations of the markings on the aiming strip 900 would be calibrated to the perimeter of a particular target such that, when the aiming strip 900 is attached to a side of the target, arrows passing through the marks on the strip from distances and heights set forth on accompanying calibrated charts would be assured of passing through the same "target location" within the target interior. The "target location" may correspond to the center mass of or at least a center location within the vital organs of an animal of similar body size and shape that are located within the body cavity. Thus, if a bowhunter owns a target that lacks the unique and novel aiming features of the present invention, he or she may obtain a kit that has been created for that particular target based on the type of animal and the size and shape of the target. The kit would contain a strip 900 that contained aiming marks that have been calibrated for that particular target. The kit would also contain a collection of charts similar to those described herein that are calibrated for that particular target and relate treestand platform heights "H" and corresponding horizontal distances "X" that relate to all of those aiming marks on the strip. To avoid damage to the aiming strip resulting from arrows passing therethrough, the user may use the strip to make the proper reference marks on the perimeter of the target and then remove the aiming strip. For example, once the aiming strip has been installed on the target in the desired location, the user may insert pins through the marks on the strip to mark the underlying target. Once all of the marks have been made on the target in that manner, the user may remove the aiming strip. If desired, the marks may be highlighted with paint or a marker and the aiming numbers added in a similar manner. Or the aiming marks may be marked with pins or similar markers inserted into the target.

Figure 42:
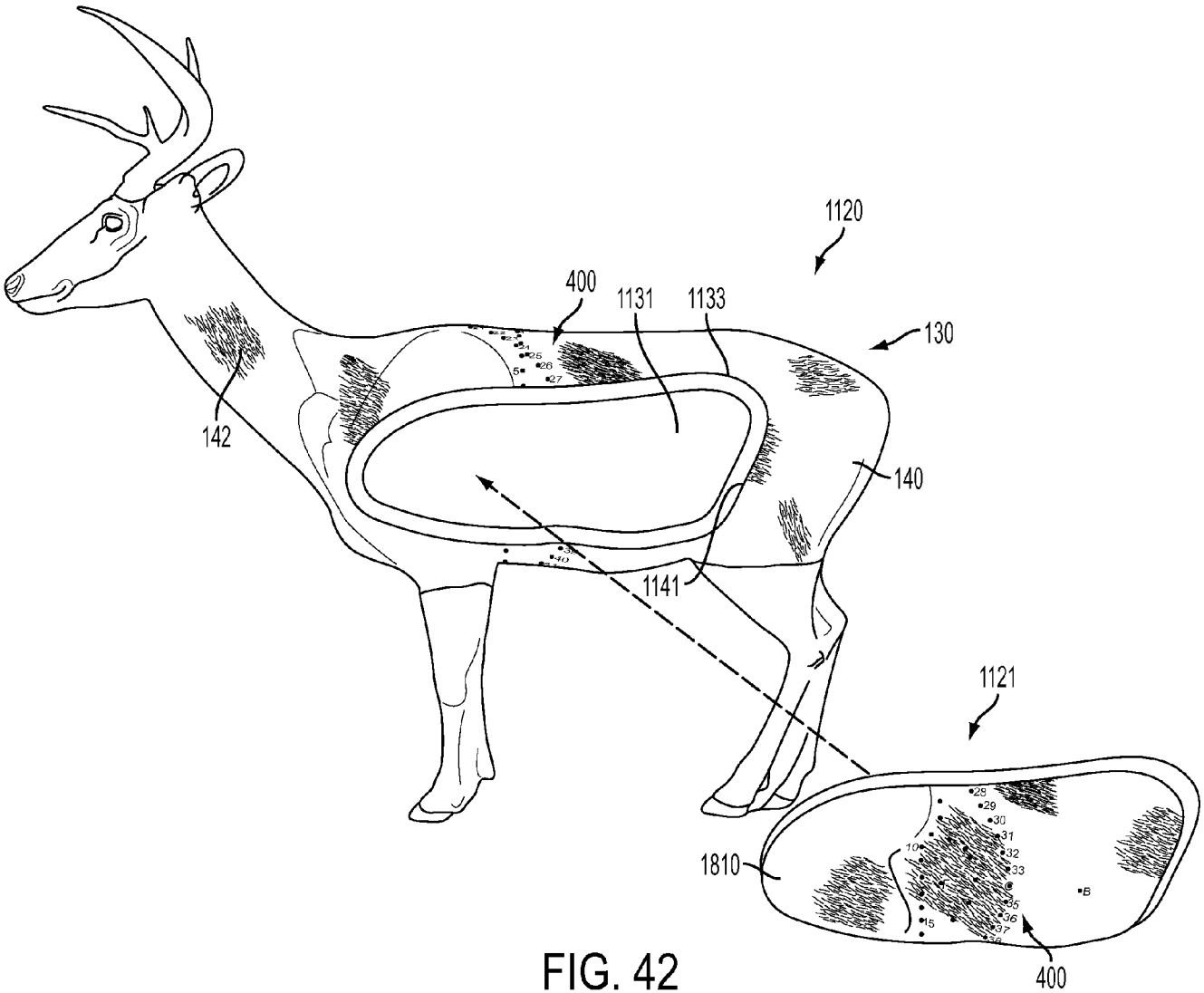
FIG. 42 is another first side elevational view of the archery target implementation of FIG. 41 with the first target panel removed therefrom.
Figure 43:
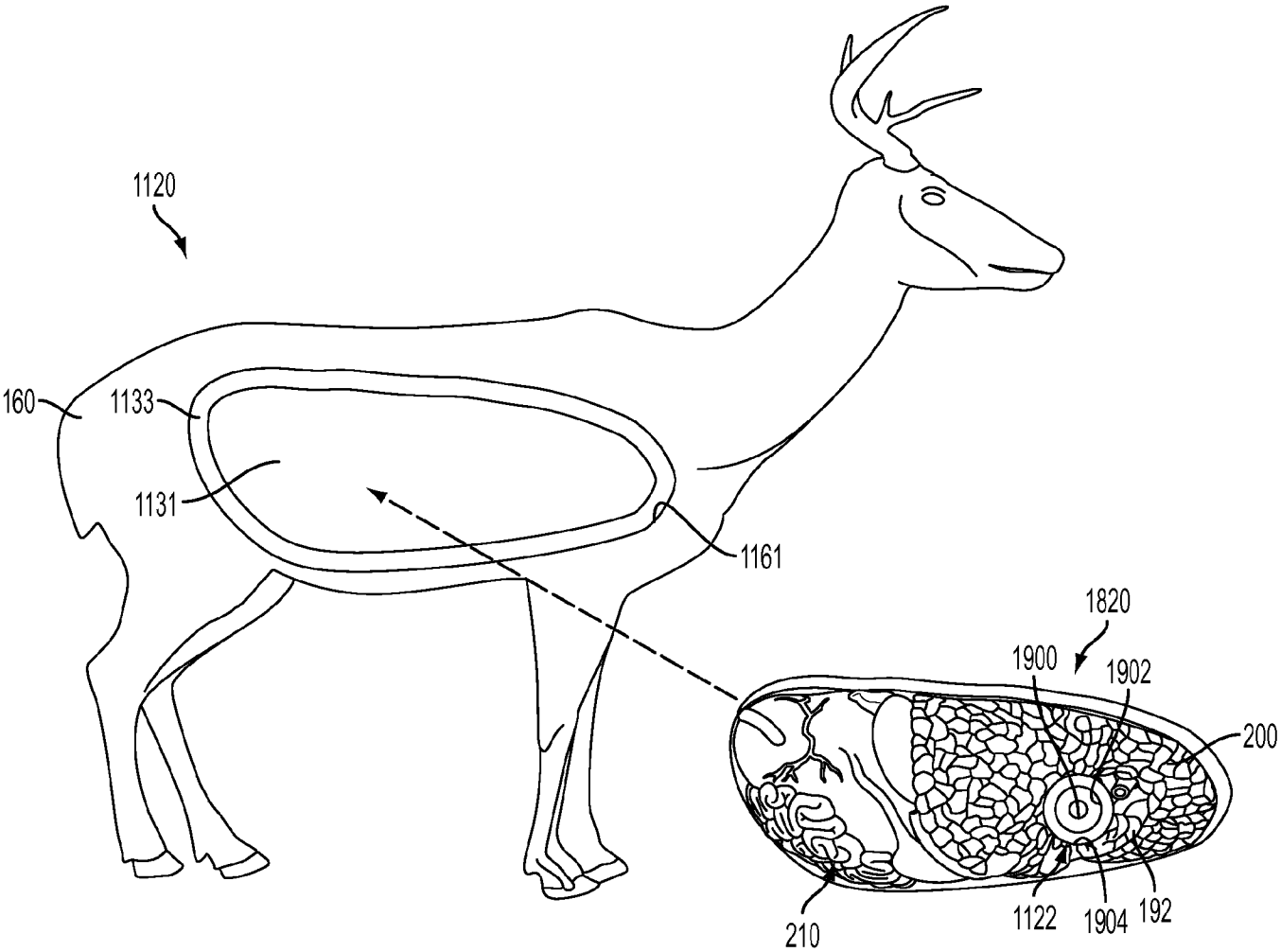
FIG. 43 is a second side elevational view of the archery target implementation of FIGS. 41 and 42 with the second target panel removed therefrom.
Figure 44:
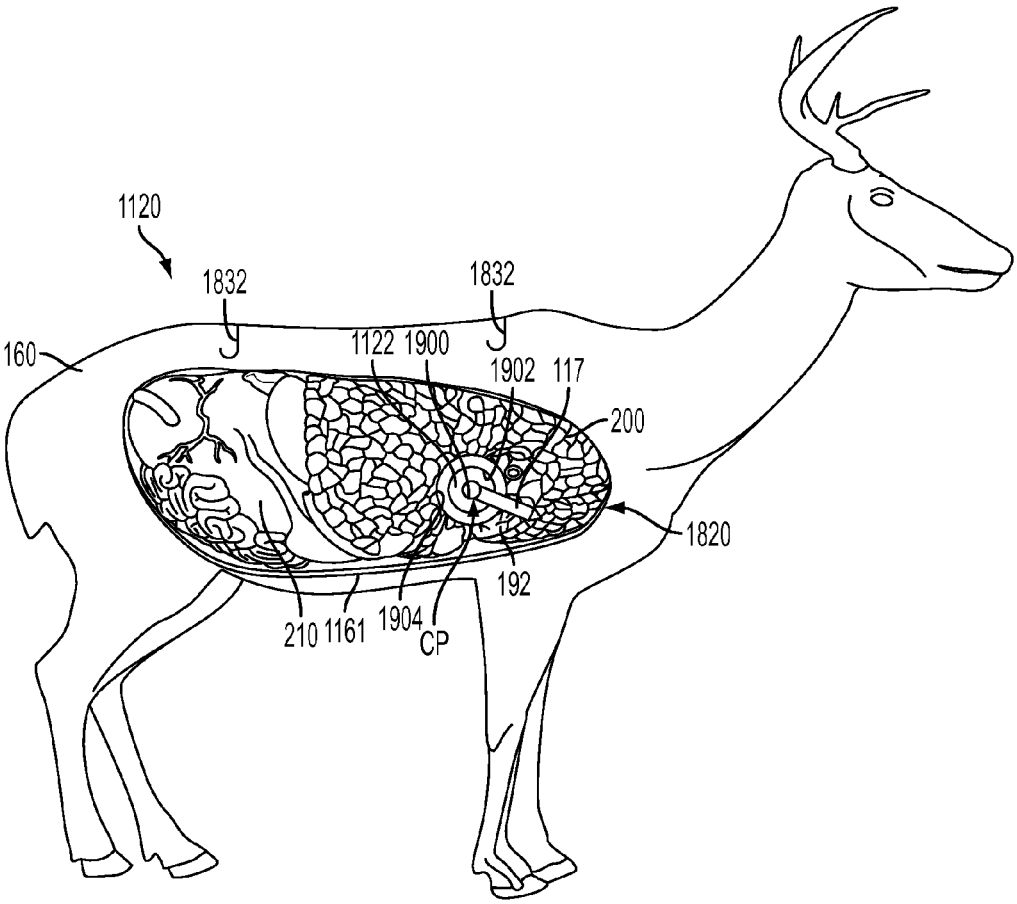
FIG. 44 is another second side elevational view of the archery target implementation of FIGS. 41-43 with the second target installed within the target and an arrow passing partially through a target location on the second target panel.
Figure 45:
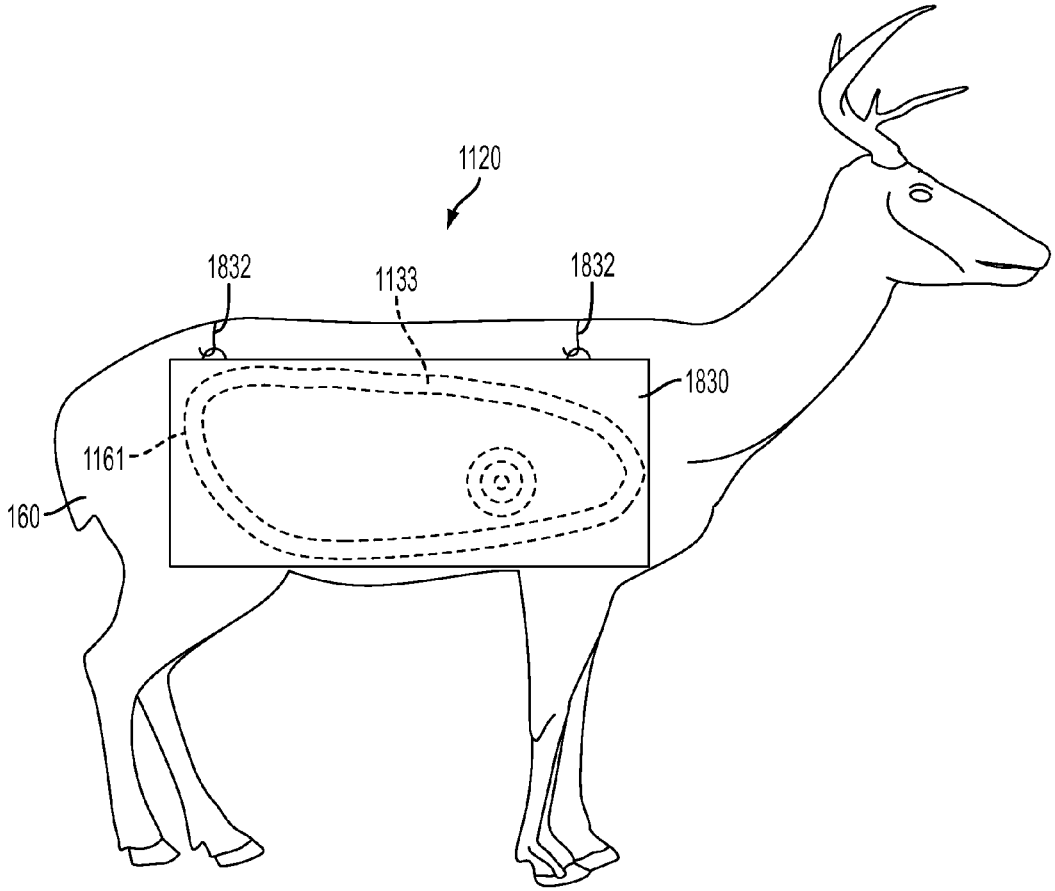
FIG. 45 is another second side elevational view of the archery target implementation of FIGS. 41-44 with a third target panel hanging therefrom.

FIGS. 41-47 illustrate another target 1120 that includes a unique and novel target panel arrangement 1121. Those portions of the target 1120 that are the otherwise the same as portions of the various targets described above have the same element numbers and their various functions and constructions will not be repeated for the sake of brevity. The body portion 130 may have a first side 140 and a second side 160. The first side 140 may, for example, comprise a "fur" side and have a fur-like texture 142 formed therein. The body 130 includes a central body cavity 1131 that forms a first side opening 1141 and a second side opening 1161. A centrally disposed attachment ledge 1133 may be formed within the body 130 the central body cavity 1131 as shown in FIGS. 42 and 43, for example. The target 1120 also includes a pre-made or preformed first target panel 1810 that is sized to closely fit into the first side opening 1141 and abut the attachment ledge 1133. The first target panel 1810 may be fabricated from the same foam material comprising the body 130 with the same density or it may be fabricated from a different foam composition having a lesser or greater density than the foam used to form the body 130. In one implementation, the first target panel 1810 may be an inch thick to reduce cost. Once the user shoots out the first target panel 1810, it may be replaced with a new one. In at least one implementation, the first target panel 1810 may be provided with detents 800 as was discussed above, so that the user may cut out that portion of the first panel 1810 and replace the cut out portion with a new smaller insert in the various manners discussed above. The first side 140, as well as the first target panel 1810, may be formed with the aiming system 400 as described in detail above. The first target panel 1810 may be retained within the first side opening 1141 with a frictional fit or with adhesive, pins, plastic screws, etc. When the first target panel 1810 is installed within the first side opening 1141, it matches the adjoining perimeter and shape of the first side 140 of the body 130. See FIG. 41.

Figure 47:
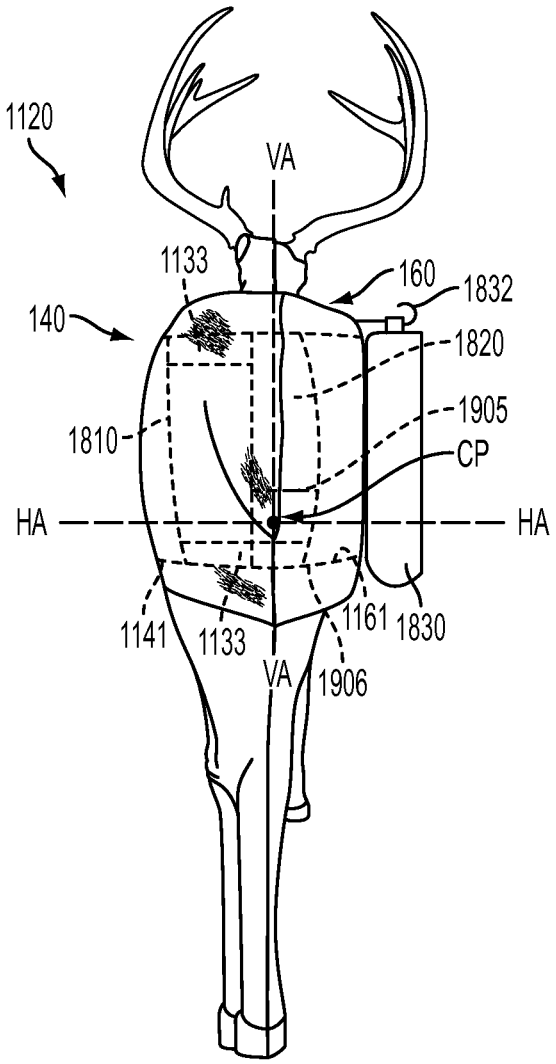
FIG. 47 is a rear elevational view of the archery target implementation of FIGS. 45 and 46.

As can be seen in FIG. 43, the target 1120 includes a second target panel 1820 that has organs 192, 200, 210 replicated thereon. In addition, a target location 1122 is defined by three concentric scoring rings 1900, 1902 and 1904. The second target panel 1820 may be fabricated from the same foam material comprising the body 130 with the same density or it may be fabricated from a different foam composition having a lesser or greater density than the foam used to form the body 130. The second target panel 1820 is sized to closely fit into the second side opening 1161 and abut the attachment ledge 1133 or another attachment ledge or ledges formed inside the cavity. The second target panel 1820 may be retained within the second side opening 1161 with a frictional fit or with adhesive, pins, plastic screws, etc. In one implementation, the scoring ring 1904 serves to define a cavity 1905 in the second target panel 1820. When the second target panel 1820 is installed within the target 1120 as shown in FIG. 47, the bottom surface 1906 of the cavity 1905 lies alone the vertical axis VA-VA of the target that corresponds to the center of the representative animal. The horizontal axis HA-HA extends through the target 1120 such that when the second target panel 1820 is properly installed the horizontal axis passes through the center of the scoring ring 1900. The center point "CP" or center mass of the target may lie on the bottom surface 1906 of the cavity 1905 where the vertical axis VA-VA and horizontal axis HA-HA intersect to define the target location 1122 which is located in the center of the target 1120. See FIG. 47.

In use, the archer shoots into the first side 140 and cannot see the second target panel 1820 mounted therein. From the archer's perspective, the target 1120 looks like a real deer. Depending upon the poundage of the bow being used, an arrow 117 may stop within the first and second target inserts 1810, 1820. See e.g. FIG. 44. Thus, once the archer makes the shot, he or she can assess the accuracy of the shot by viewing the location of the arrow 117 relative to the target location 1122 by viewing the second side 160 of the target 1120. However, if higher poundage bows are employed, the arrows may pass completely through the first and second target panels 1810, 1820 making the arrows susceptible to becoming lost and/or damaged. Thus, to stop such arrows, a third target panel 1830 may be employed. The third target panel 1830 may be fabricated from dense foam that is configured to stop such faster arrows therein. In other arrangements, the third target panel 1830 may comprise a box that has filler material compressed therein as was discussed in detail above. In the illustrated implementation, the third target panel 1830 is configured to be hung from hooks 1832 attached to the second side of the target 1120 as shown. Other removable attachment methods such as patches of hook and loop material, etc. may be employed to removably affix the third target panel 1830 to the second side 160 of the target 1120. The third target panel 1830 is sized to cover the opening 1161 in the second side 160 to stop arrows passing therethrough. Once an arrow is shot into the target 1120 and is stopped in the third panel 1830, the archer may unhook the third target panel 1830 from the hooks 1832 and pull the panel 1830 away from the arrow 117. The user may then remove the arrow 117 from the first side of the target 1120 to prevent damage to the arrow's fletching. Once the third target panel 1830 is removed, the archer can assess the accuracy of the shot from the second side 160 before removing the arrow from the front side 140.

Figure 46:
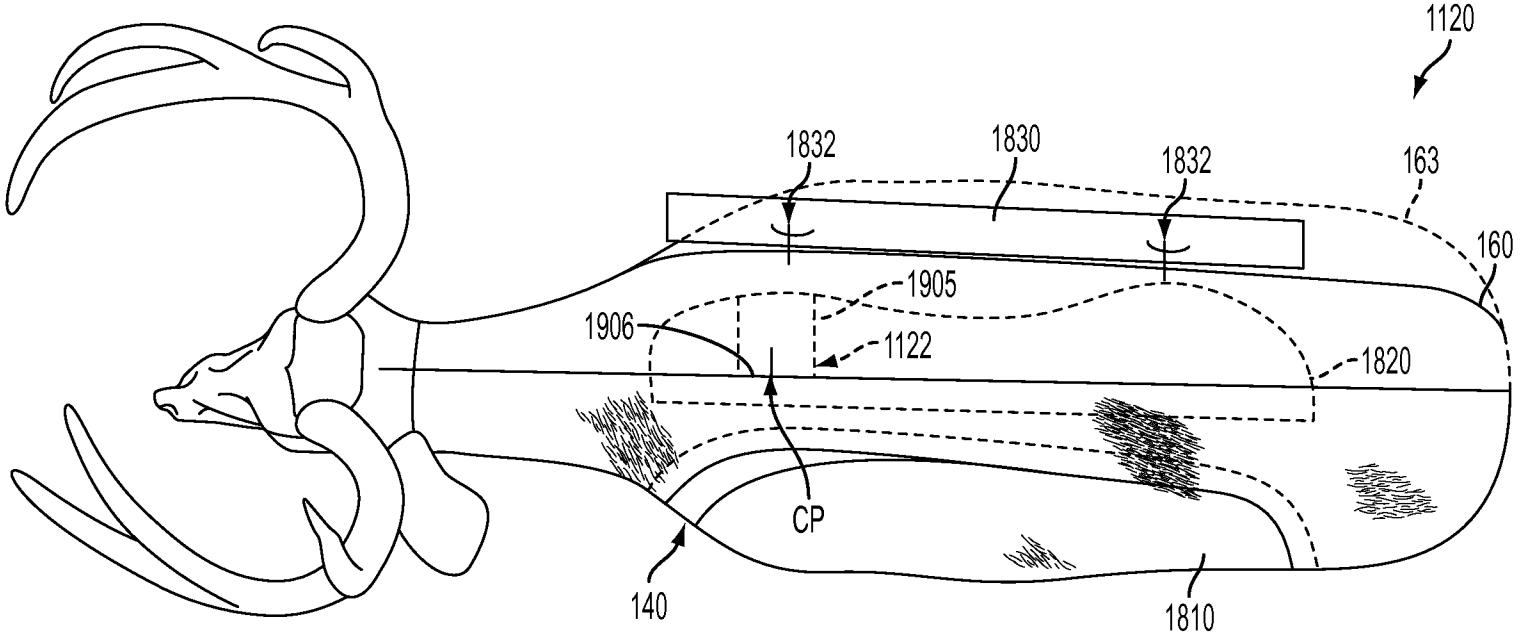
FIG. 46 is a top view of the archery target implementation of FIG. 45.

FIG. 46 is s top view of the target 1120. The first side 140 is configured to accurately represent one side of a whitetail deer. The opposite side of the whitetail deer is represented by the broken line 163. To reduce the amount of foam required to manufacture the target, the target may be made such that the second side 160 may not extend out to the line 163. However, those of ordinary skill in the art will understand that the second target panel 1820 and more particularly, the center point "CP" defined thereby is located "center mass" within the body cavity of the target 1120. Stated another way, the center point "CP" is located within the target such that it corresponds to the same center location in a whitetail deer of similar size. Thus, an arrow passing through that center point or the target location defined thereby would be reasonably assured to pass through at least both lungs or one lung and the heart or into or through the heart and/or liver or some combination of these organs if shot through the same position in a like-sized whitetail deer. This represents a vast improvement over prior target arrangements that have depictions of organs printed or molded into the perimeter of the second side of the target. In addition, each of the three target panels 1810, 1820, 1830 may be replaced if they get shot out. Moreover, the shot out aiming spots and target locations may be cut from the panels 1810, 1820, and replaced with premade inserts to extend the life of the panels. The premade inserts may be glued in position within the panels.

Archery shoots are commonplace across America. Local archery clubs set out approximately thirty various animal targets in a wooded setting making an archery course. Archers then "shoot the course". Shooting stakes are provided so the archer knows where to shoot from. The targets have "score rings" built into the foam, which represent where to shoot at the animal. Each ring is given a score number with the higher number representing the smallest inner circles. Typical scores represent a five for a shot anywhere in the body outside the "circle bulls-eye" area. The larger circle is usually an eight with the smallest circle being the perfect bulls-eye represented by a score of ten. The archer records his or her score on a prescribed form for each target and then totals the numbers at the end of the shoot. The perfect score is 300 based upon 30 targets scored up to 10 points per target.

When the archery club places the targets on the course, they place them at various distances, angles, and heights to simulate real life hunting situations. The problem with the prior scoring system is that it only represents one kill zone when the animal is on level ground and is perfectly broadside. If the target is placed so that the animal is angling away, the perfect ten shot is in the wrong position and in real life the "perfect shot" for the prior scoring system would have the arrow hit the animal too far forward and in real life it may actually cripple the deer.

Various implementations of the unique and novel archery target disclosed herein are designed for perfect shot placement while compensating for various heights, distances, and angle variations. As described earlier, the built in three dimensional number system compensates for various heights, length, and animal tilt positions showing perfect aiming spots that gives the largest kill area possible in the center of the animal.

Figure 48:
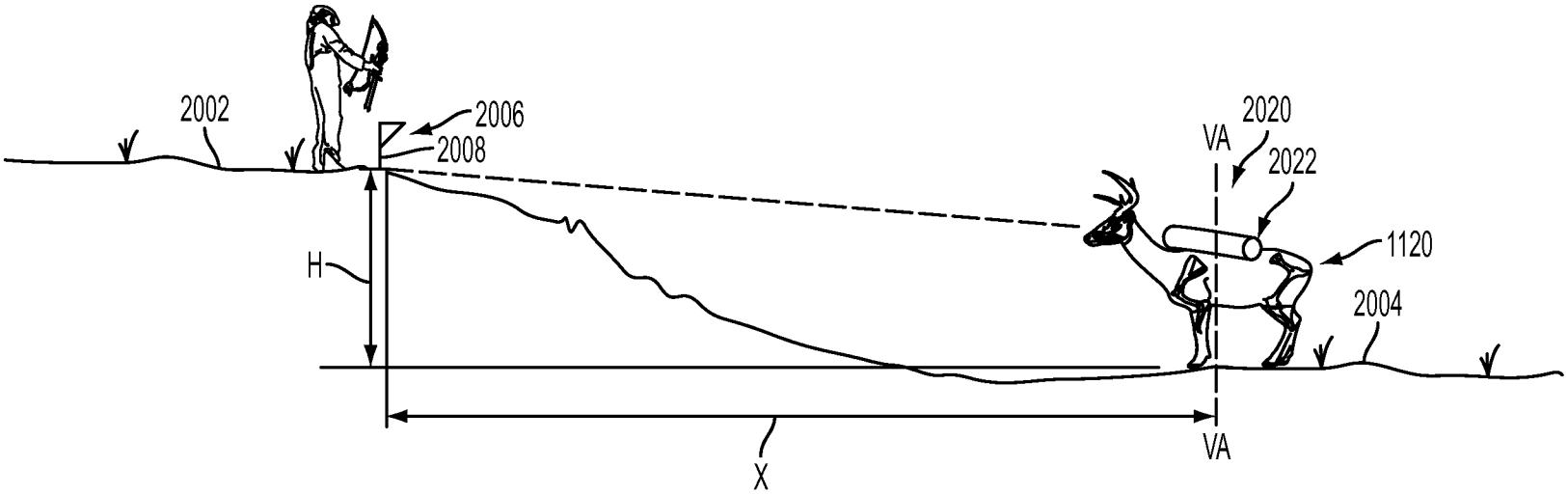
FIG. 48 depicts an archer preparing to shoot at a target implementation from a shooting location that is located on an elevation that is above the target.
Figure 49:
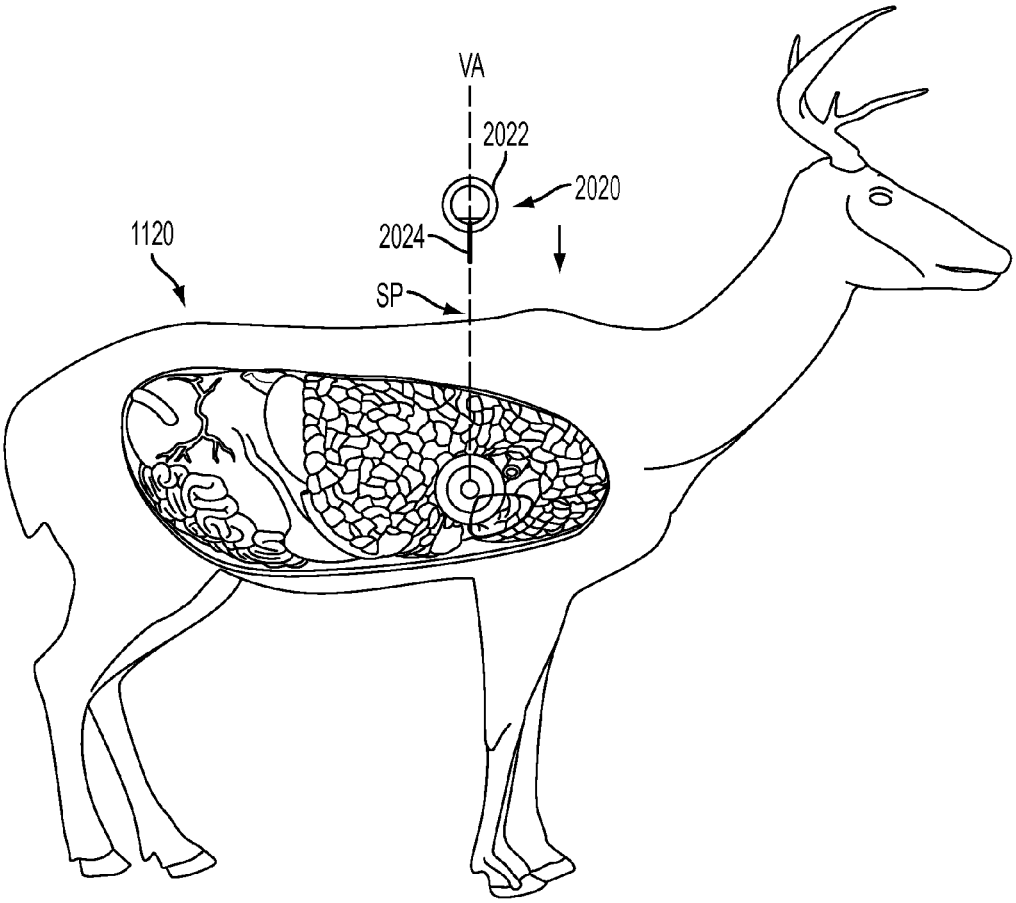
FIG. 49 is a second side elevational view of an archery target implementation an illustrating installation of a positioning guide implementation thereon.
Figure 50:
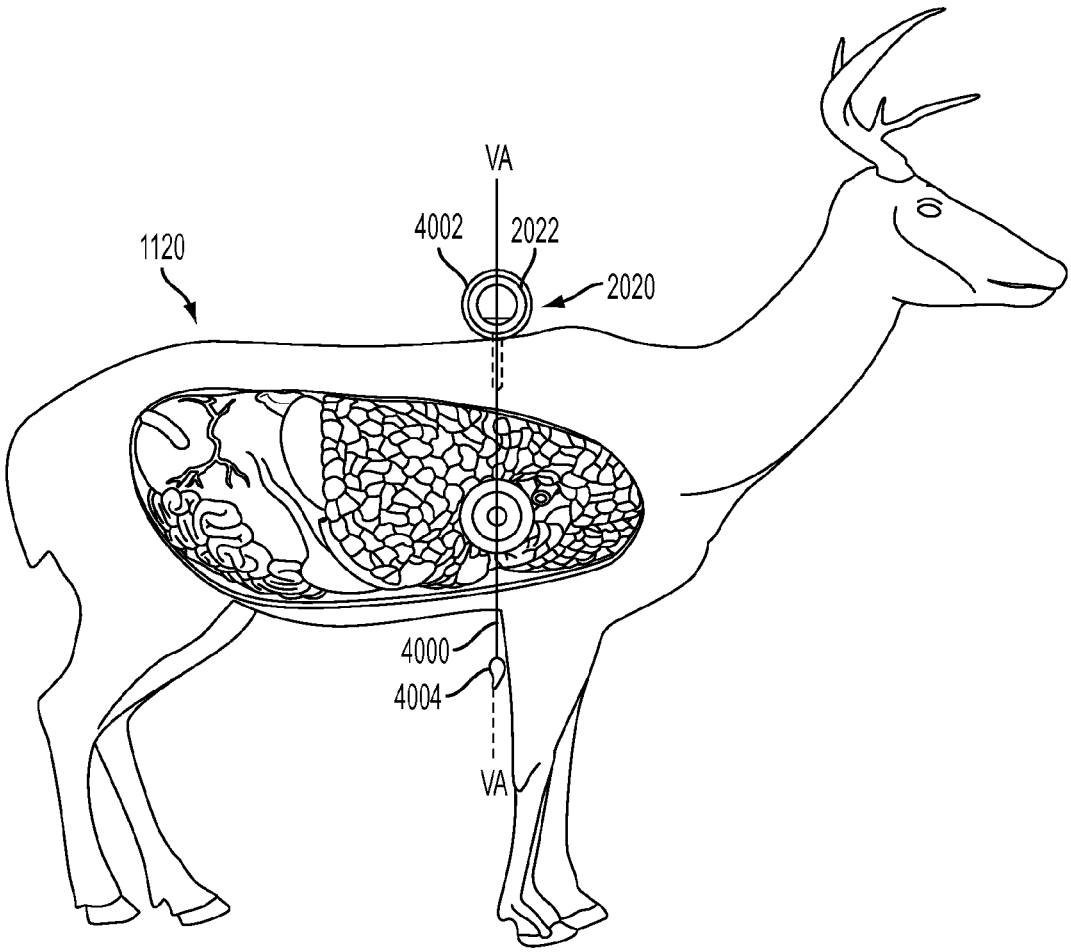
FIG. 50 is another second side elevational view of the archery target implementation of FIG. 49 with the positioning guide installed thereon.
Figure 51:
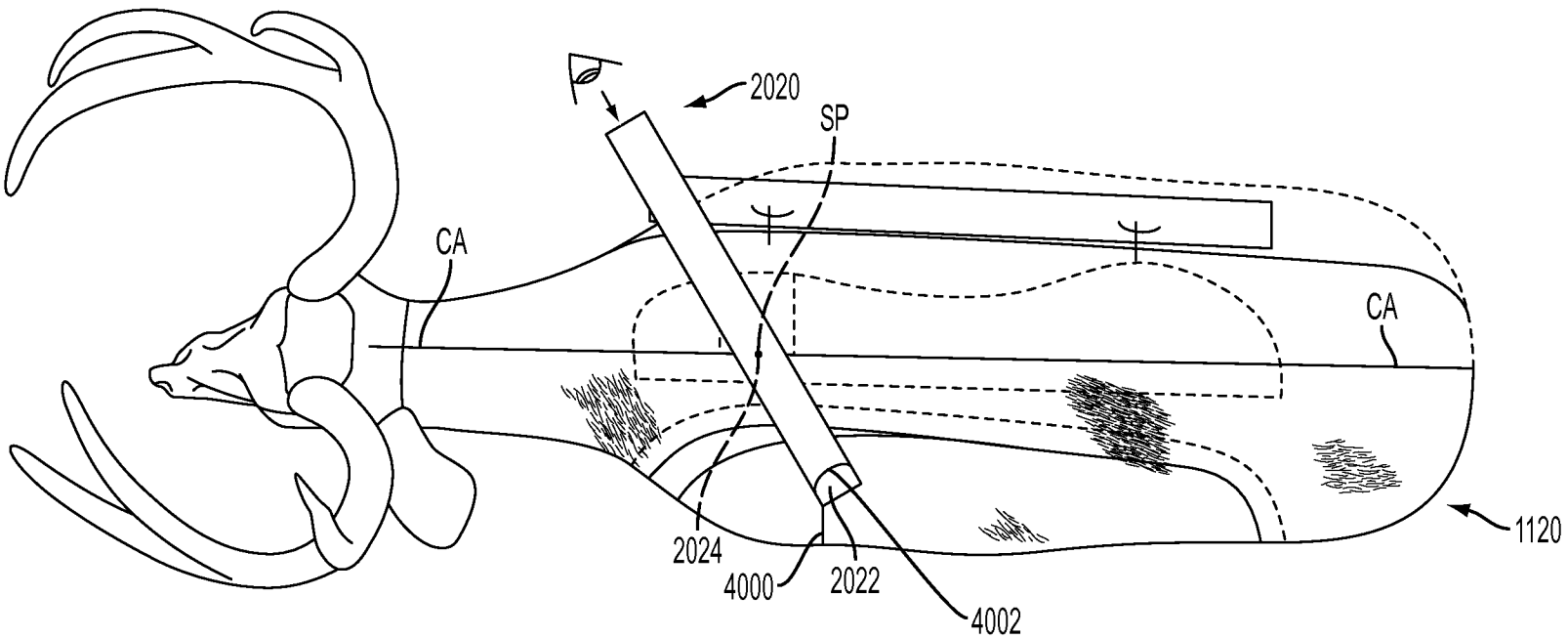
FIG. 51 is a top view of the archery target and positioning guide implementations of FIG. 50.

FIG. 48 illustrates an archer 2000 located on a level 2002 that is above a level 2004 in which a target 1120 is mounted. The shooting location is marked with a stake or flag 2006. When establishing this shooting location, a positioning guide 2020 may be employed to ensure that target 1120 is set at a desired angle relative to the stake 2006. In one implementation, the positioning guide 2020 comprises a sighting tube or conduit 2022 that has a spike or locating pin 2024 attached thereto. The conduit 2022 may be freely rotated about the locating pin 2024. To install the positioning guide 2020, the user inserts the locating pin 2024 into the top of the target 1120 into a sighting point "SP" marked on the top of the target 1120. The sighting point "SP" is where the vertical axis VA-VA intersects the central axis CA-CA on the top of the target 1120 and is directly above the center point "CP". Once the positioning guide 2020 is installed on the target 1120, the sighting tube 2022 is rotatable about the vertical axis VA-VA. The user can look through the sighting tube 2022 to locate the shooting position 2006 represented by stake 2008 and then rotate the target 1120 to the desired angle orientation relative thereto before mounting the target in place. As indicated above, the target 120 may be mounted by inserting rebar segments into the ground so that conduits in the legs may be inserted thereon. In other implementations, the target 1120 may be installed on a conventional stand. Once the target is mounted in a desired position, the user may then place a string 4000 that has a loop 4002 on one end and a weight such as a plumb bob weight 4004 on the opposite end on one end of the tube 2022 such that the string 4000 hangs down on the fur side or first side of the target. The string 4000 now identifies the vertical axis VA for locating the desired aiming mark. See FIGS. 50 and 51. Then using a conventional range finder or other means, the user can determine the height that the shooting location is located relative to the desired aiming mark and the horizontal distance therebetween. After these distances and angle are determined, the user can use the appropriate chart (FIGS. 15-27) to determine where to locate the aiming mark along the string (vertical axis VA). The user can position the target such that the desired aiming mark on the target is positioned at a desired location and angle relative to the stake 2008. Once the target 1120 is properly located relative to the shooting location 2006, the positioning guide 2020 may be removed form the target. It will be understood that the positioning guide 2020 may be effectively employed with a variety of target implementations disclosed herein.

The archery targets disclosed herein may also be effectively employed at archery shoots of the type described above, for example, This is easily accomplished with various ways of attaching independent scoring rings to the proper place on the target body that correlates with the perfect shot placement determined by the center kill technology system described above. The scoring ring can be as simple as a printed scoring ring that is cut out and glued or pinned to the target. A different technique would be to trace scoring rings onto the target with a removable ink. Very thin wire circles can be attached to the first side of the target for example, by pinning or adhesive.

Use of the targets and target systems disclosed herein will change completely, the present shooting process. For example, presently, the better shooters study the various "bulls-eye circles" on the different animal targets. They memorize where those "score rings" are by noting the various fur textures and muscles sculptured into the target. They then know where to aim to make a perfect ten shot. However, many times the perfect ten shot on the archery course would actually cripple the animal in real life.

The targets disclosed herein may also be used in connection with a unique and novel scoring system disclosed herein. For example, when setting up a target for a competition, the person setting up the target may position the target relative to the shooting location utilizing the positioning guide disclosed herein. The person then determines the height "H" that the shooting location is above or below the surface on which the target is mounted. The horizontal distance "X" from the shooting location to the target is also determined. See FIG. 48, for example. Then utilizing the appropriate charts (FIGS. 14-27), the exact aiming mark is determined. This mark will assure that an arrow shot from the shooting location and passing through the mark on the target will pass through the center point of the target location inside the target as was discussed in detail above. That aiming mark may then be marked with a hat pin or other marking arrangement that will not damage an arrow that may hit it. In at least one implementation, the archers will be unable to see that pin or marker from the shooting location.

Figure 52:
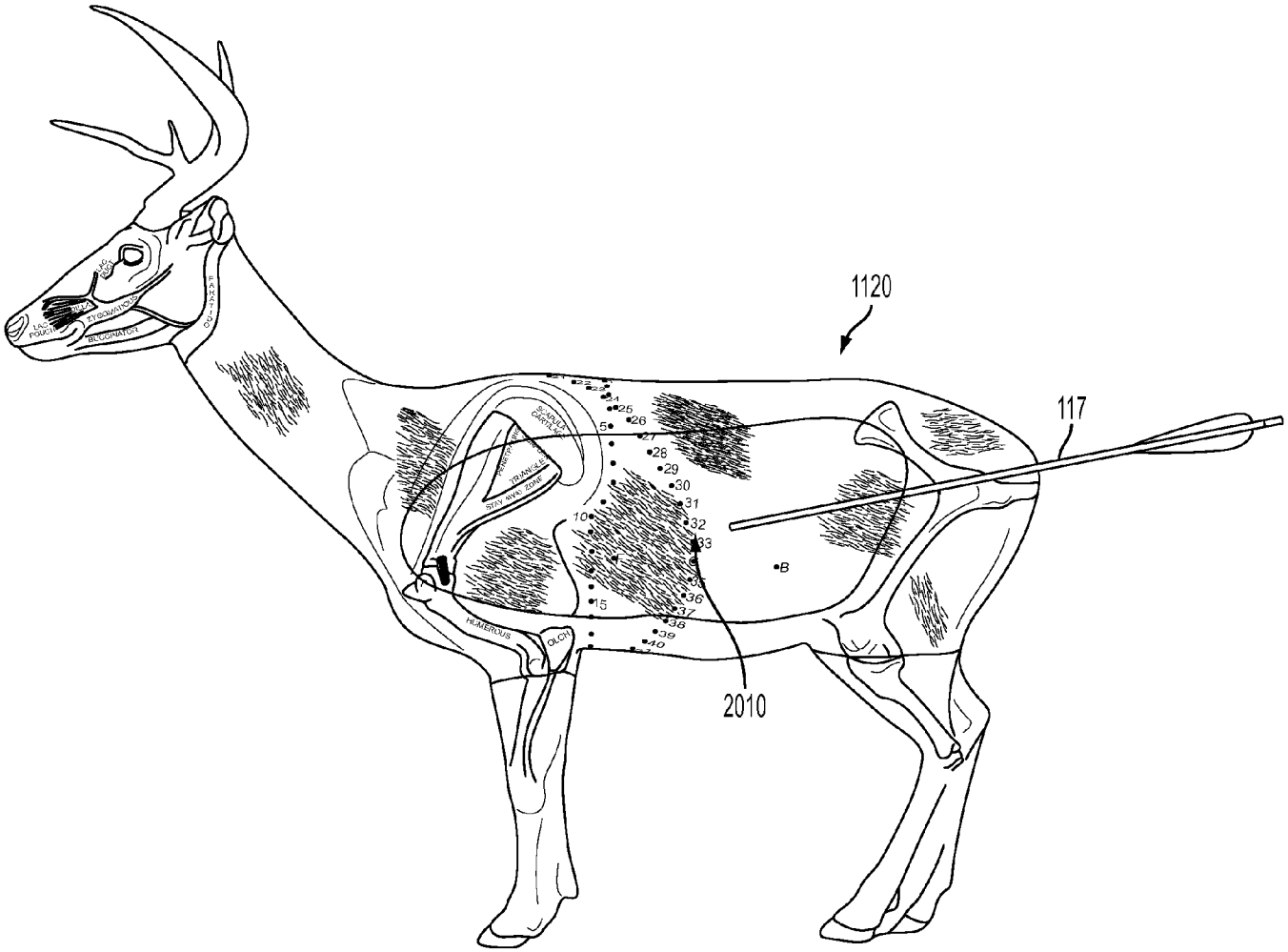
FIG. 52 is a side elevational view of the archery target implementation of FIGS. 41-47 with an arrow shot into the first side.

By away of an example, assume a target 1120 shown in FIG. 48 is positioned quartering away from the shooting location 2006 (45 degree angle) as was discussed above. Assume that the shooting location 2006 is located on a hill that is ten feet above the ground on which the target 1120 is mounted. That is "H"=ten feet. Further assume that the shooting position 2006 is located 60 yards from the vertical axis VA-VA of the target. Thus "X"=60 yards. Using the chart of FIG. 21, the correct aiming mark or # on body is 33. Thus, a hat pin 2010 or other marker is place through the number 33 on the target 1120. See FIG. 52. Now assume that the archer shoots an arrow 117 into the target at the position shown in FIG. 52. The archer may then "score" the shot using the scoring tool 2100 depicted in FIG. 54.

Figure 53:
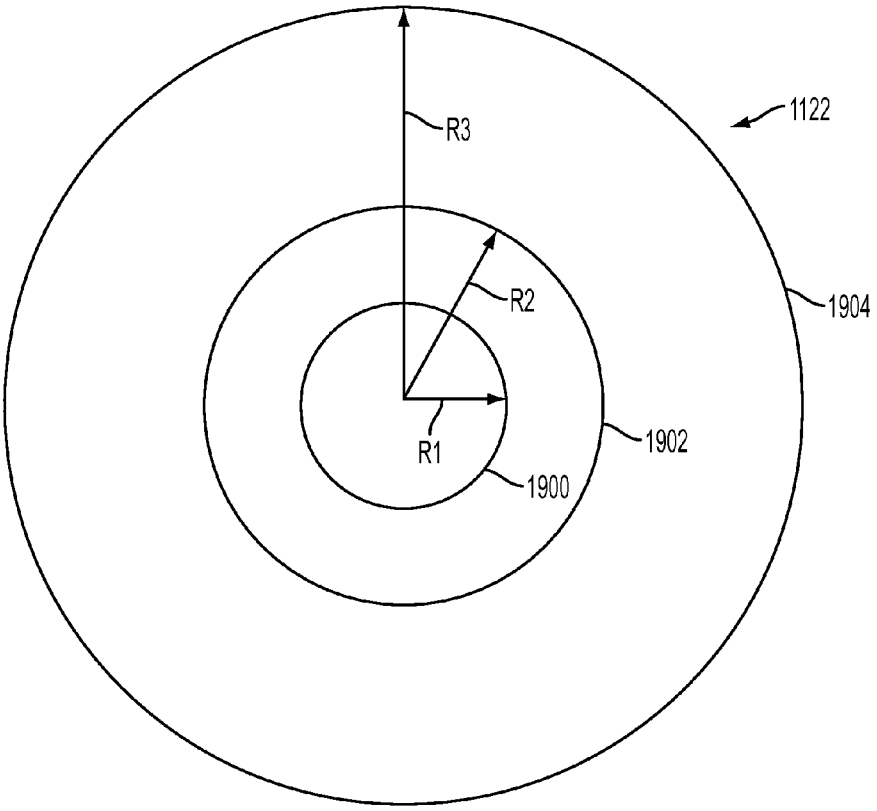
FIG. 53 illustrates one shooting location implementation.

FIG. 53 represents a series of three concentrically positioned score rings 1900, 1902, 1904. The diameters of those score rings may be selected to match the scoring conventions of any existing archery organizations or they may differ from those scoring conventions. In the illustrated embodiment, the first score ring 1900, which is the centermost and smallest score ring has a radius designated as R1. The second score ring 1902 has a second radius R2. R2 is greater than R1. The third score ring 1904 has a third radius R3 that is greater than the second radius R2. Further, each score ring is assigned a point value such that an arrow that would land in a particular score ring would be awarded the number of points associated with that particular score ring. In one implementation, the first score ring 1900 may be assigned a point number of 14. The second score ring 1902 may be assigned a point number of 12 and the third score ring 1904 may be assigned a point number of 10. The scoring tool 2100 of FIG. 54 may be employed to determine how many points an arrow should be awarded depending upon the arrow's location relative to the selected aiming mark.

Figure 54:
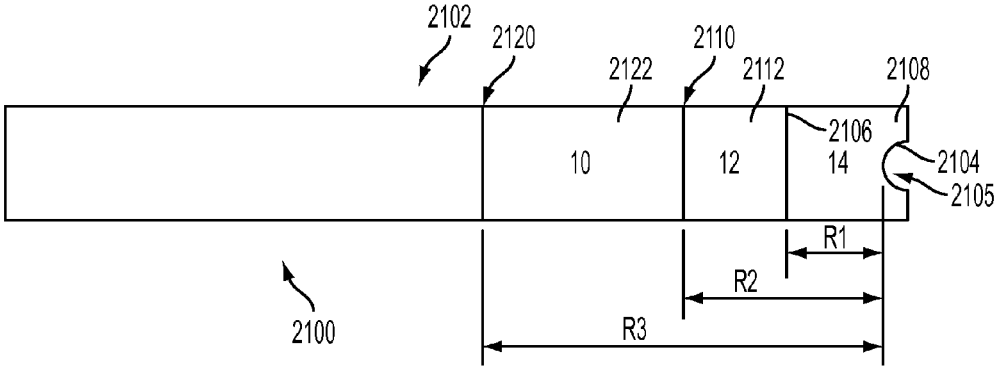
FIG. 54 illustrates one scoring tool implementation.

Referring to FIG. 54, the scoring tool 2100 includes a tool body 2102. In one implementation, the scoring tool 2100 may be fabricated from a piece of flexible Mylar® or flexible clear plastic, etc. An arrow cradle 2104 is formed in one end of the tool body 2102. The tool body further has a first scoring line 2106 printed thereon which defines a first score area 2108. The distance that the first scoring line 2106 is from the apex 2105 of the cradle 2104 is equal to R1. The first scoring area 2108 is equivalent to placing an arrow in the first score ring 1900 and has the point number "14" printed thereon. A second scoring line 2110 is placed on the tool body 2012. The second scoring line 2110 is located a distance equivalent to R2 from the apex of the cradle 2104 and defines a second scoring area 2112. An arrow falling in the second scoring area 2112 is equivalent to an arrow landing in the second scoring ring 1902. The second scoring area 2112 has the point number "12" printed thereon. A third scoring line 2120 is printed or placed on the tool body 2102 a distance from the apex 2105 of the arrow cradle 2104 that is equal to R3 to define a third scoring area 2122. An arrow falling in the third scoring area 2122 is equivalent to an arrow landing in the third scoring ring 1904. The third scoring area 2122 has the point number "10" printed thereon.

Figure 55:
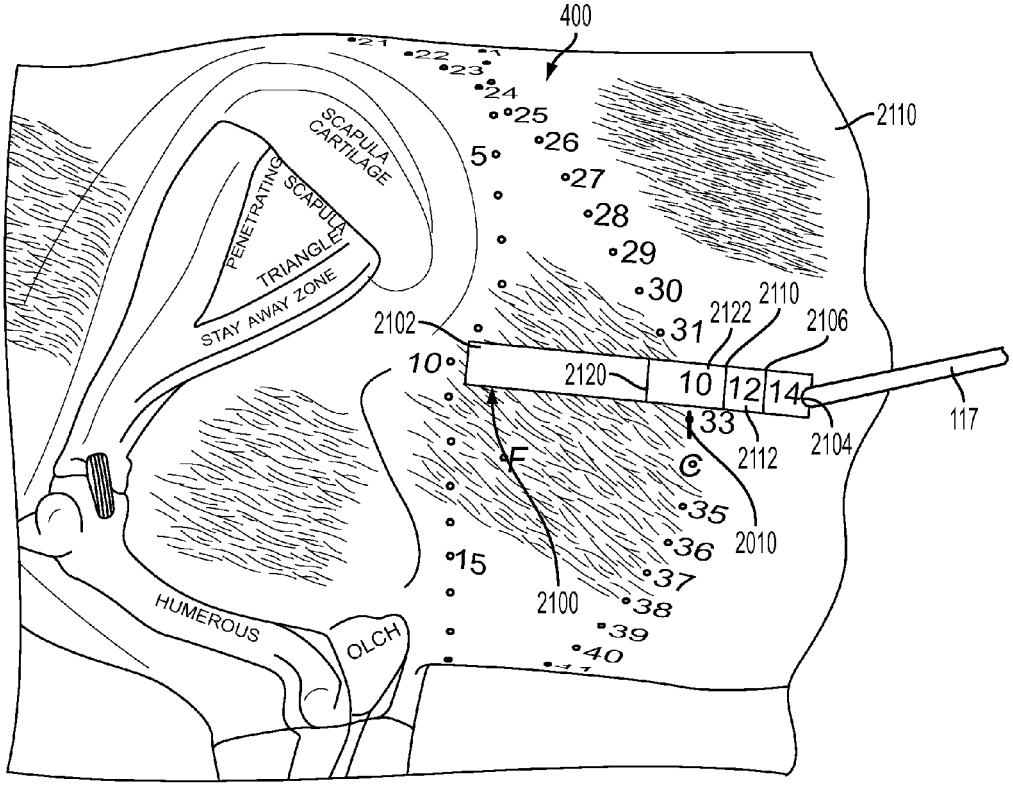
FIG. 55 is an enlarged view of a portion of the first side of the target of FIG. 52 illustrating use of the scoring tool to score the position of the arrow.
Figure 56:
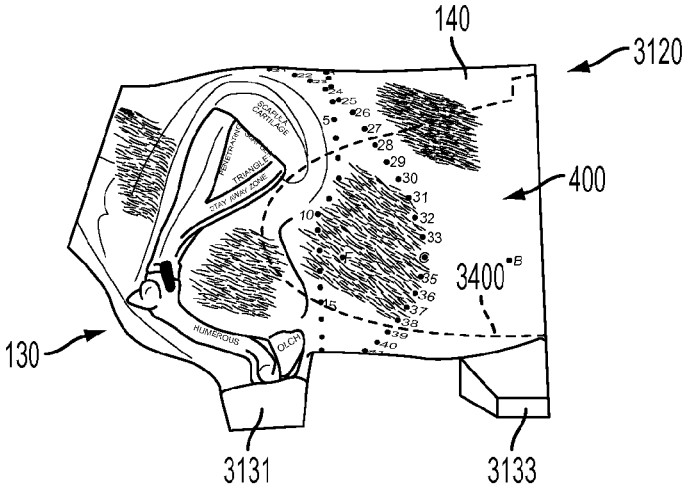
FIG. 56 is a first side elevational view of another archery target implementation.
Figure 57:
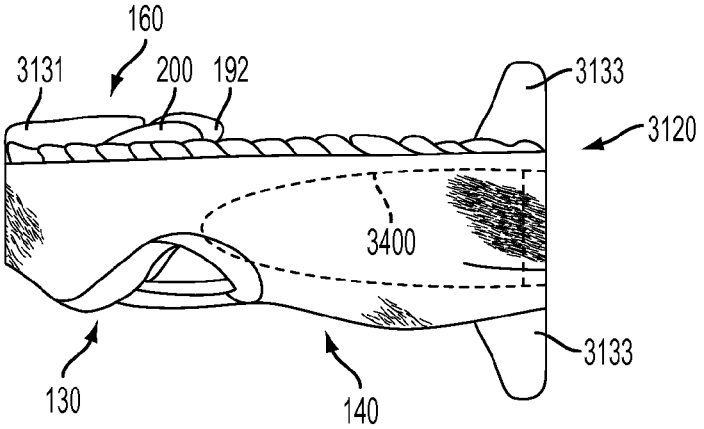
FIG. 57 is a top view of the archery target implementation of FIG. 56.
Figure 58:
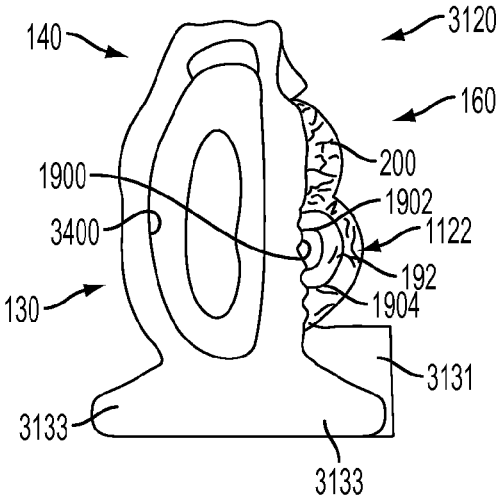
FIG. 58 is a rear end view of the archery target implementation of FIGS. 56 and 57.

In the above example, a hat pin or other marker 2010 was placed in the aiming number 33 on the target 1120. The archer shoots an arrow 117 into the target without knowing that mark number 33 is the correct place to hit the target. That is, in a real life situation, if the arrow where to enter a similar sized deer in that mark from that particular shooting location, the archer would be reasonably sure that the shot would be fatal to the deer. Assume that the arrow 117 strikes the target at the position shown in FIGS. 52 and 55. When the archer gets to the target, he or she places the scoring tool 2100 on the side of the target such that the arrow is received within the cradle 2104 and then rotates the tool 2100 to determine whether the pin 2010 and, more precisely, the correct aiming mark (33 in the example) falls within any of the scoring areas 2108, 2112, 2122. As can be seen in this example, the pin 2010 falls within the third scoring area 2122 and thus, the shot is awarded 10 points. If the pin 2010 fell within the second scoring area 2112, the shot would have been awarded 12 points, for example. If the pin 2110 falls outside of all of the scoring areas, no points may be awarded or a set number of points may be simply awarded for hitting the target. The numbers of points, the sizes and numbers of scoring areas may vary and are intended to be encompassed by the claims appended hereto. Thus, a scoring tool 2100 may be given to each competitive archer to be used on each target throughout the shoot. The archers total up the numbers of points attained for each target and the archer with the most points at the end wins the shoot.

Figure 59:
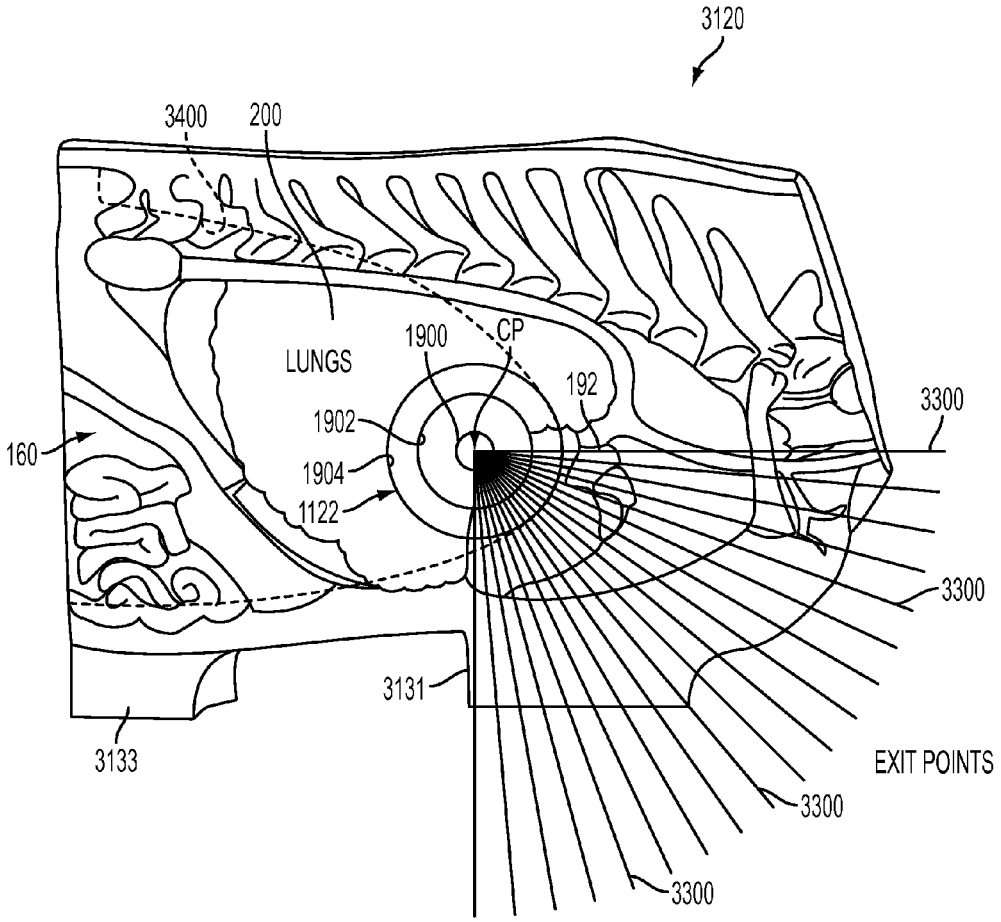
FIG. 59 is a second side elevational view of the archery target implementation of FIGS. 56-58 illustrating exit points of arrows shot through the center point of the target location.
Figure 60:
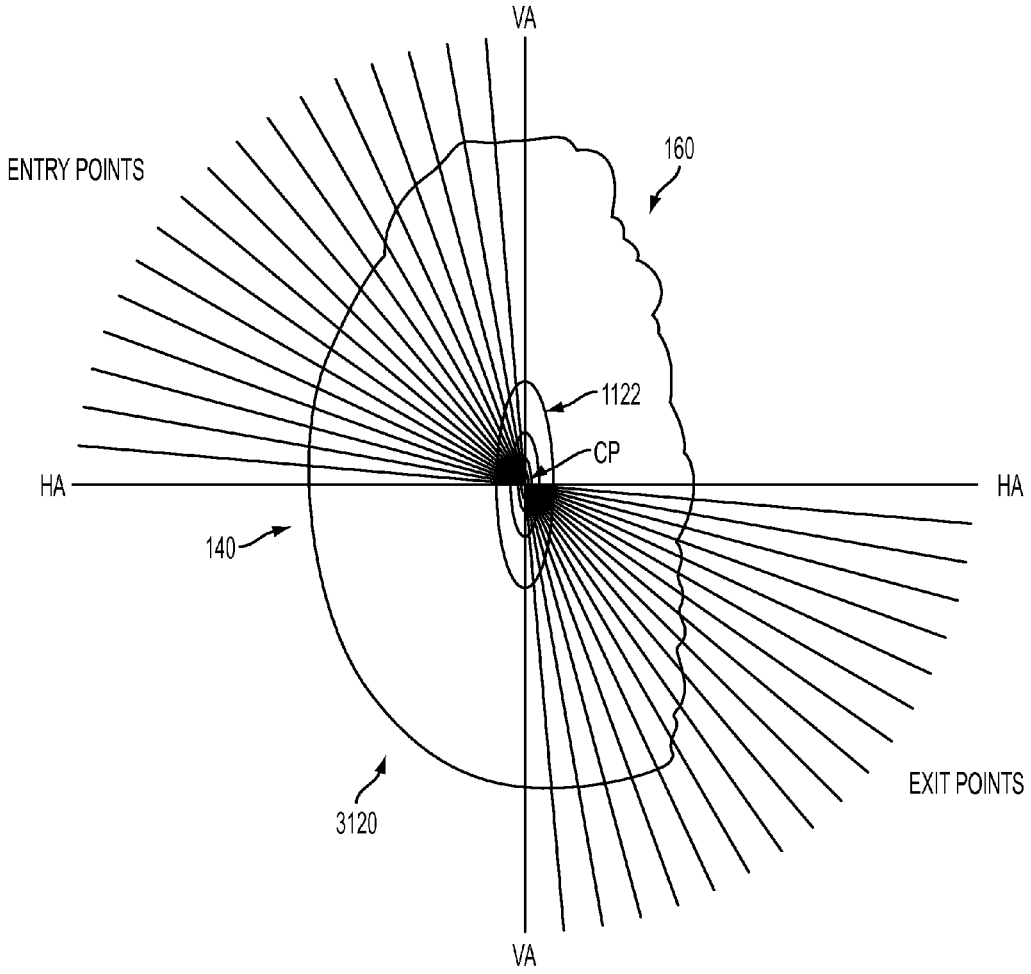
FIG. 60 is a diagrammatic end elevational view of the target implementation of FIGS. 56-59 illustrating entry and exit points of arrows shot through the center point of the target location.

FIGS. 56-60 illustrate another target 3120 that employs the aiming system 400 described herein. As can be seen in those Figures, however, the target 3120 only replicates part of the deer, namely from a portion of the neck and the body. Such arrangement requires less foam materials and less is less expensive to manufacture than the full size targets. The target 3120 includes a body portion 130 that has a first side 140 and a second side 160. The various aiming marks of the aiming system 400 are provided on the first side 140 as was discussed above. The body portion 130 may be formed with front leg formations 3131 and rear leg formations 3133. The second side 160 has a lung portion 200 and the heart 192 formed thereon with the target location 1122 formed therein. FIG. 59 is a side elevational view of the second side 160. The axis lines 3300 represent the exit patterns of arrows shot from varied angles. All of the axis lines 3300 all exit from the center point "CP". FIG. 60 is a diagrammatic rear end elevational view of the target 3120. The axis lines 3300 represent the angle of the shot from horizontally (along horizontal axis HA-HA) in 5 degree increments. Each axis 3300 passes through the target location 1122 and more particularly through the center point "CP" which is at the intersection of the horizontal axis HA-HA and the vertical axis VA-VA. The body 130 of the target may be fabricated from solid foam—particularly when bows with poundages sufficient enough to drive an arrow at least partially out of the second side of the target are used. To facilitate passage of arrows shot from lower poundage bows at least partially through the second side 160 (at least far enough to enable the archer to determine where the arrow hit relative to the target location), a cavity 3400 may be molded or otherwise provided in the body 130. By providing the cavity 3400, the arrow will have to travel through less foam material to enter the second side 160 of the target 3120. By referring to FIGS. 57 and 58, it will be understood that the location of the heart 192 and more particularly the target location 1122 is accurately located relative to the outer perimeter of the first side 140 of the target body 130. This represents a vast improvement over prior target arrangements that merely have representations of the vital organs such as the heart and or lungs formed into the outer perimeter of the one side of the target as those representations are not in anatomically accurate positions relative to the side of the target through which the arrows are shot.

The targets and aiming systems disclosed herein not only solve this and other problems encountered when using prior target arrangements, but also have built into the system to give the actual largest target kill area possible. This teaches proper shot placement based upon real life situations of the animal being at various heights, lengths, and tilt angles. Now the archer who understands anatomy, angles and height variations will have an advantage over the "crack" shots. Another advantage to the archery clubs is that they will save money utilizing the moveable scoring rings. Presently when the shooting rings are shot up a new insert needs to be purchased to replace the old one. With the use of adjustable scoring rings other areas of the body can be utilized for perfect ten ring shots thus extending the life of the target. The target is made with a softer rubber foam type material that allows the arrow to penetrate into the individual organs. The targets disclosed herein may be so life-like and anatomically accurate enabling the archer to examine arrow location and to determine whether the arrow would have struck bone, blood vessels, lungs, liver, etc. on a live animal.

What is claimed is:

1. An archery target, comprising:

a three dimensional animal mannequin configured to be supported on a surface and including a perimeter defining an interior including a target location located within the interior, said mannequin including a horizontally extending central axis and a vertically extending central axis intersecting said horizontally extending central axis to define a center point of said target location within said mannequin;

a plurality of exposed aiming marks on at least one side of said perimeter; and at least one reference chart for a plurality of shooting locations located at at least one height above or below said surface relative to said mannequin, said reference chart correlating each of said plurality of exposed aiming marks to a corresponding horizontal distance between each of said shooting locations and said center point such that an arrow shot from each of said shooting locations through the corresponding aiming mark for that particular shooting location at a velocity sufficient to cause at least a portion of the arrow to pierce through the perimeter will be in axial alignment with the center point of said target location within the interior.

2. The archery target of claim 1 wherein one side of the perimeter contains the exposed aiming marks and another side of the perimeter includes an open cavity defining the interior and wherein the archery target further comprises a removable target assembly mountable within the open cavity and only viewable from the other side of the perimeter, the removable target assembly including the target location therein when the removable target assembly is removably mounted within the open cavity.

3. The archery target of claim 2 wherein the removable target assembly comprises an artificial reproduction of an animal organ.

4. The archery target of claim 3 wherein the artificial reproduction of an animal organ comprises:

an artificial heart;

an artificial lung assembly configured to removably support the artificial heart therein; and an artificial liver and digestive system assembly, the artificial heart, lung assembly and artificial liver and digestive assembly to be removably retained within open cavity and be viewable from the other side of the perimeter.

5. The archery target of claim 3 wherein the removable target assembly is configured to stop arrows that are shot through the one side of the perimeter.

6. The archery target of claim 5 wherein the removable target assembly comprises a first bag containing bulk material therein.

7. The archery target of claim 6 wherein the bulk material is vacuum sealed within the first bag and the sealed first bag is received within a second bag.

8. The archery target of claim 7 wherein the removable target assembly is retained within the open cavity by fasteners selected from the group of fasteners consisting of: pins, straps, rubber bands, and bungee cords.

9. The archery target of claim 1 further comprising means for determining when a horizontal reference plane passing through the target is level and when a vertical reference plane intersecting the horizontal plane is plumb relative to the surface.

10. The archery target of claim 4 further comprising a three dimensional bone formation removably coupled to the other side of the perimeter.

11. The archery target of claim 1 wherein the perimeter has two exposed opposing sides wherein one exposed side of the perimeter replicates a fur side of an animal and wherein the other exposed side of the perimeter has anatomical features formed therein.

12. An archery target, comprising:

a three-dimensional life-sized mannequin formed in the shape of an animal and configured to be supported on a surface wherein the mannequin includes first perimeter replicating a fur side of the animal and a second side including an exposed chest cavity having an interior wall defining at least some life-like skeletal features of the animal;

at least one life-like, three dimensional organ reproduction removably supported within the chest cavity in an anatomically-correct location therein;

a target location within the chest cavity, said mannequin including a horizontal extending central axis and a vertically extending central axis intersecting said horizontally extending central axis to define a center point within said target location within said mannequin;

a plurality of aiming marks on the fur side; and a reference chart for a plurality of shooting locations located at at least one height above or below said surface relative to said mannequin, said reference chart correlating each of said plurality of exposed aiming marks to a corresponding horizontal distance from said center point to each of said shooting locations such that an arrow shot from any one of the shooting locations through the corresponding aiming mark for that shooting location at a velocity sufficient to penetrate the fur side through a corresponding aiming mark will be axially aligned in pass through alignment with the center point.

13. The archery target of claim 12 further comprising a removable target assembly sized to be mounted within the chest cavity when the three-dimensional organ reproduction has been removed therefrom, the removable target assembly configured to stop arrows that are shot through the first side of the perimeter.

14. The archery target of claim 13 wherein the removable target assembly comprises a first bag containing bulk material therein.

15. The archery target of claim 14 wherein the bulk material is vacuum sealed within the first bag and the sealed first bag is received within a second bag.

16. An aiming kit for use with a life-like three dimensional target in the shape of an animal and including an outer perimeter having a first side and a second side and defining a center point therebetween, said target being supported on a surface, the aiming kit comprising:

a reference member attachable to at least one of the first and second sides of the outer perimeter, the reference member comprising a plurality of aiming marks; and at least one chart defining a plurality of shooting locations apart from the target, each said shooting location located a height above or below the surface, each said chart correlating each of the aiming marks to a corresponding horizontal distance between each of said shooting locations and said center point for a corresponding said height such that an arrow shot from the particular shooting location through the corresponding aiming mark at a velocity sufficient to pierce through at least a portion of the outer perimeter will be in pass-through alignment with the center point.

17. The aiming kit of claim 16 wherein the reference member comprises an adhesive strip.

18. The aiming kit of claim 16 wherein the at least one at least one chart comprises:

at least one first chart defining a series of first horizontal distances from a target that is mounted broadside to a first shooting location located at a first height above the surface upon which the target is mounted for a set of first aiming marks on the target; and at least one second chart defining a series of second horizontal distances from a target that is mounted quartering away from a second shooting location located at a second height above the surface upon which the target is mounted for a set of second aiming marks on the target.

* * * * *